US011859851B2

(12) United States Patent
Voysey

(10) Patent No.: US 11,859,851 B2
(45) Date of Patent: Jan. 2, 2024

(54) SYSTEM, APPARATUS AND HYBRID VAV DEVICE WITH MULTIPLE HEATING COILS

(71) Applicant: ALBIREO ENERGY, LLC, Edison, NJ (US)

(72) Inventor: Keith Stanley Voysey, Yorba Linda, CA (US)

(73) Assignee: ALBIREO ENERGY, LLC, Edison, NJ (US)

( * ) Notice: Subject to any disclaimer, the term of this patent is extended or adjusted under 35 U.S.C. 154(b) by 287 days.

(21) Appl. No.: 17/213,203

(22) PCT Filed: Sep. 27, 2019

(86) PCT No.: PCT/US2019/000048
§ 371 (c)(1),
(2) Date: Mar. 25, 2021

(87) PCT Pub. No.: WO2020/068150
PCT Pub. Date: Apr. 2, 2020

(65) Prior Publication Data

US 2023/0151998 A1 May 18, 2023

Related U.S. Application Data

(60) Provisional application No. 62/741,690, filed on Oct. 5, 2018, provisional application No. 62/737,251, filed on Sep. 27, 2018.

(51) Int. Cl.
*F24F 13/02* (2006.01)
*F24F 11/80* (2018.01)
(Continued)

(52) U.S. Cl.
CPC ..... *F24F 13/0236* (2013.01); *F24F 11/64* (2018.01); *F24F 11/74* (2018.01);
(Continued)

(58) Field of Classification Search
CPC ..... F24F 13/0236; F24F 13/10; F24F 11/64; F24F 11/74; F24F 11/80; F24F 11/89
See application file for complete search history.

(56) References Cited

U.S. PATENT DOCUMENTS 2,806,675 A 9/1957 Conradi
3,568,760 A 3/1971 Hogel
(Continued)

FOREIGN PATENT DOCUMENTS

CN 103940091 A 7/2014
DE 299 20 574 U1 4/2000
(Continued)

OTHER PUBLICATIONS

A. Bhatia, Design Options for HVAC Distribution Systems, CED Course No. M06-017, 2017, pp. 28-34, Continuing Education & Development Inc., Stony Point, NY.

*Primary Examiner* — Mohammad Ali
*Assistant Examiner* — Vincent W Chang
(74) *Attorney, Agent, or Firm* — BRENEMAN & GEORGES

(57) ABSTRACT

An energy efficient hybrid variable air volume terminal system with multiple heating coils to enhance temperature control in each individual room in a plurality of rooms. The hybrid variable air volume terminal system includes a novel hybrid variable air volume box that has one inlet duct and a plurality of outlet ducts coupled to the novel hybrid variable air volume box. Each outlet duct has a heating coil operably connected thereto which can be operably connected to any number of the plurality of rooms to provide an energy efficient building management system. In certain embodiments, either an actual or a virtual thermostat is operably connected to the hybrid variable air volume terminal system to control the operation of the system remotely. In certain embodiments, the hybrid variable air volume terminal sys-
(Continued)

tem comprises an automated air balance system or an automated space control damper and demand response control system to control and/or vary the amount of air flow.

43 Claims, 45 Drawing Sheets

(51) Int. Cl.

| | |
|---|---|
| ***F24F 11/74*** | (2018.01) |
| ***F24F 11/64*** | (2018.01) |
| ***F24F 11/89*** | (2018.01) |
| ***F24F 13/10*** | (2006.01) |
| *F24F 120/10* | (2018.01) |
| *F24F 110/40* | (2018.01) |

(52) U.S. Cl.
CPC ..... *F24F 11/80* (2018.01); *F24F 11/89* (2018.01); *F24F 13/10* (2013.01); *F24F 2110/40* (2018.01); *F24F 2120/10* (2018.01); *F24F 2221/34* (2013.01)

(56) References Cited

U.S. PATENT DOCUMENTS

| | | | | |
|---|---|---|---|---|
| 3,934,795 | A | 1/1976 | Ginn et al. | |
| 4,182,484 | A | 1/1980 | Stanke et al. | |
| 4,630,670 | A | 12/1986 | Wellman | |
| 4,876,858 | A | 10/1989 | Shaw et al. | |
| 4,917,174 | A | 4/1990 | Ring | |
| 4,928,750 | A * | 5/1990 | Nurczyk | F24F 11/76 236/46 F |
| 5,117,900 | A | 6/1992 | Cox | |
| 5,259,553 | A | 11/1993 | Shyu | |
| 5,558,274 | A | 9/1996 | Ben-Aissa et al. | |
| 5,564,626 | A | 10/1996 | Kettler et al. | |
| 5,564,980 | A | 10/1996 | Becker | |
| 6,213,867 | B1 | 4/2001 | Yazici et al. | |
| 6,296,193 | B1 | 10/2001 | West | |
| 6,349,883 | B1 | 2/2002 | Simmons et al. | |
| 6,549,826 | B1 | 4/2003 | Pouchak | |
| 6,554,198 | B1 | 4/2003 | Hull | |
| 6,623,353 | B1 | 9/2003 | Akhtar | |
| 6,698,219 | B2 | 3/2004 | Sekhar | |
| 6,715,690 | B2 | 4/2004 | Hull | |
| 6,725,915 | B2 | 4/2004 | Wheat et al. | |
| 6,736,326 | B2 | 5/2004 | Hunka | |
| 6,857,577 | B2 | 2/2005 | Hunka | |
| 6,879,881 | B1 | 4/2005 | Attridge, Jr. | |
| 6,986,386 | B2 | 1/2006 | Sekhar et al. | |
| 7,059,400 | B2 | 6/2006 | Sekhar et al. | |
| 7,177,776 | B2 | 2/2007 | Whitehead | |
| 7,216,497 | B2 | 5/2007 | Hull et al. | |
| RE40,437 | E | 7/2008 | Rosen | |
| 7,802,438 | B2 | 9/2010 | Hull et al. | |
| 7,810,738 | B2 | 10/2010 | Stark | |
| 8,255,085 | B2 | 8/2012 | Salsbury | |
| 8,374,725 | B1 | 2/2013 | Ols | |
| 8,688,243 | B2 | 4/2014 | Federspiel | |
| 8,714,236 | B2 | 5/2014 | Karamanos | |
| 8,793,022 | B2 | 7/2014 | Uden | |
| RE45,574 | E | 6/2015 | Harter | |
| RE46,236 | E | 12/2016 | Harter | |
| 9,605,859 | B2 | 3/2017 | Uden | |
| 9,694,452 | B2 | 7/2017 | Karamanos | |
| RE46,708 | E | 2/2018 | Karamanos | |
| 9,939,171 | B2 | 4/2018 | Lollar et al. | |
| 9,971,363 | B2 | 5/2018 | Leeland et al. | |
| 9,976,763 | B2 | 5/2018 | Leeland et al. | |
| 10,047,968 | B2 | 8/2018 | Barrooah et al. | |
| 10,222,767 | B2 | 3/2019 | Holaso et al. | |
| 10,274,217 | B2 | 4/2019 | Gevelber | |
| 10,309,668 | B2 | 6/2019 | Song et al. | |
| 10,331,510 | B2 | 6/2019 | Zimmermann et al. | |
| 10,466,724 | B2 | 11/2019 | Caron et al. | |
| 2003/0042012 | A1 | 3/2003 | Pearson | |
| 2005/0189430 | A1 | 9/2005 | Tosi | |
| 2010/0082162 | A1 | 4/2010 | Mundy et al. | |
| 2014/0074306 | A1 | 3/2014 | Lu et al. | |
| 2014/0205271 | A1 * | 7/2014 | Lollar | F24H 9/2071 392/360 |
| 2016/0313748 | A1 | 10/2016 | Leeland et al. | |
| 2017/0074533 | A1 | 3/2017 | Ji | |
| 2017/0122613 | A1 | 5/2017 | Sinha | |
| 2017/0138623 | A1 * | 5/2017 | Song | F24F 11/30 |
| 2017/0314796 | A1 | 11/2017 | Kuckuk et al. | |
| 2018/0100882 | A1 | 4/2018 | Seiler et al. | |
| 2018/0163984 | A1 | 6/2018 | Alberth | |
| 2018/0231994 | A1 | 8/2018 | Leeland et al. | |
| 2018/0238576 | A1 | 8/2018 | Leeland et al. | |
| 2018/0274807 | A1 | 9/2018 | Cosby, II et al. | |
| 2018/0316517 | A1 | 11/2018 | Henzig et al. | |
| 2018/0329438 | A1 * | 11/2018 | Letterman | G05B 15/02 |
| 2018/0356111 | A1 | 12/2018 | Salsbury et al. | |
| 2018/0373278 | A1 | 12/2018 | Walser | |
| 2019/0158309 | A1 | 5/2019 | Park et al. | |
| 2019/0179268 | A1 | 6/2019 | Gervais | |
| 2019/0179269 | A1 | 6/2019 | Gervais | |
| 2019/0257537 | A1 | 8/2019 | Ko | |
| 2019/0257545 | A1 | 8/2019 | Ko | |
| 2019/0309962 | A1 | 10/2019 | Larsson | |
| 2019/0309980 | A1 | 10/2019 | Larsson | |
| 2019/0383512 | A1 | 12/2019 | McCune et al. | |

FOREIGN PATENT DOCUMENTS

| | | | |
|---|---|---|---|
| JP | 2004309042 | A | 11/2004 |
| KR | 10-1015962 | B1 | 2/2011 |
| KR | 10-1015962 | B2 | 2/2011 |

* cited by examiner

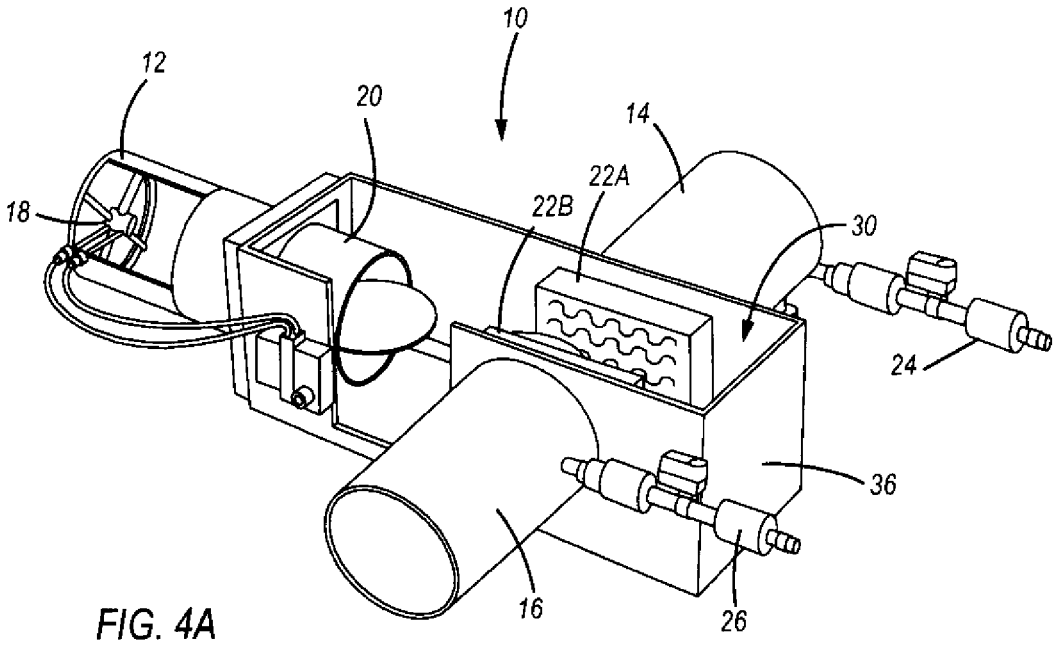
FIG. 4A
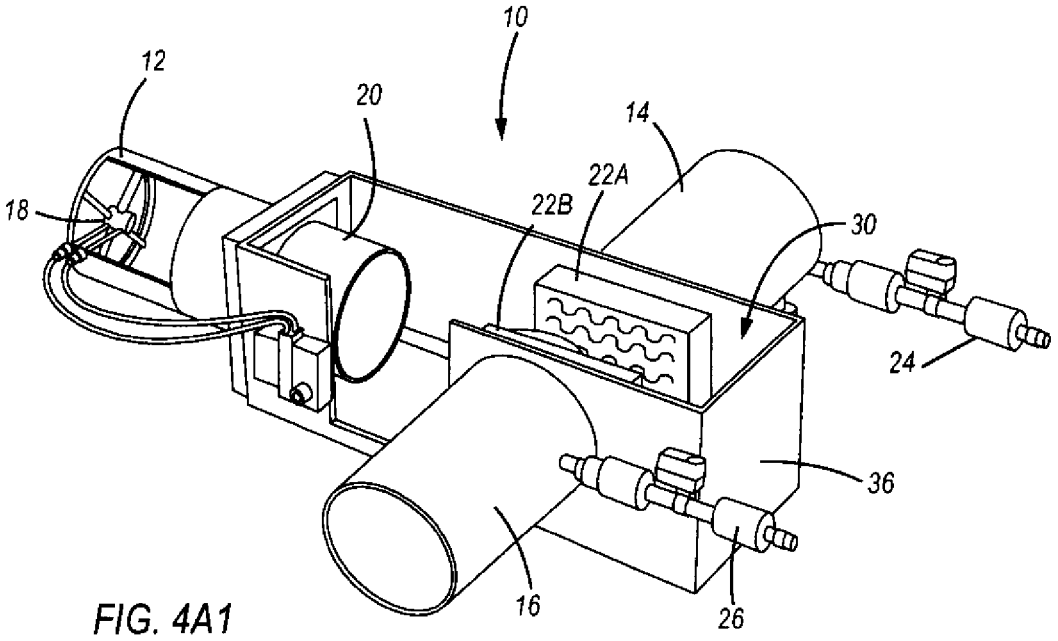
FIG. 4A1

PROJECT COST COMPARISON

| | | | |
|---|---|---|---|
| MECHANICAL | $80,000 | $45,000 | 56% |
| AIR BALANCE | $5,760 | $0 | 0% |
| CONTROLS | $38,400 | $56,463 | 147% |

#2 Flow Chart For Comfort Index

Advanced Automated Comfort Control App
Show Zone Alarms Report

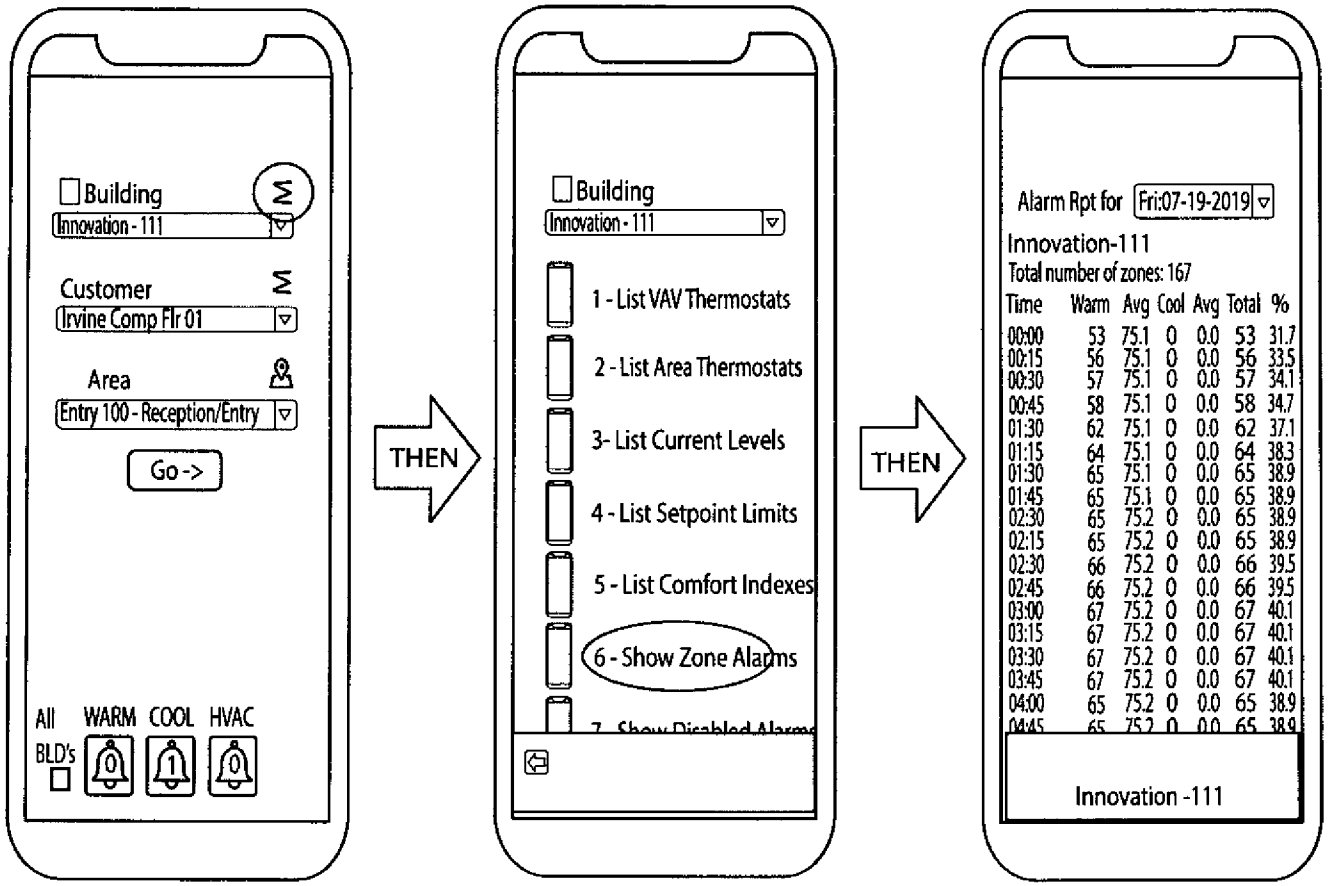

| Time | Warm | Avg | Cool | Avg | Total | % |
|---|---|---|---|---|---|---|
| 00:00 | 53 | 75.1 | 0 | 0.0 | 53 | 31.7 |
| 00:15 | 56 | 75.1 | 0 | 0.0 | 56 | 33.5 |
| 00:30 | 57 | 75.1 | 0 | 0.0 | 57 | 34.1 |
| 00:45 | 58 | 75.1 | 0 | 0.0 | 58 | 34.7 |
| 01:30 | 62 | 75.1 | 0 | 0.0 | 62 | 37.1 |
| 01:15 | 64 | 75.1 | 0 | 0.0 | 64 | 38.3 |
| 01:30 | 65 | 75.1 | 0 | 0.0 | 65 | 38.9 |
| 01:45 | 65 | 75.1 | 0 | 0.0 | 65 | 38.9 |
| 02:30 | 65 | 75.2 | 0 | 0.0 | 65 | 38.9 |
| 02:15 | 65 | 75.2 | 0 | 0.0 | 65 | 38.9 |
| 02:30 | 66 | 75.2 | 0 | 0.0 | 66 | 39.5 |
| 02:45 | 66 | 75.2 | 0 | 0.0 | 66 | 39.5 |
| 03:00 | 67 | 75.2 | 0 | 0.0 | 67 | 40.1 |
| 03:15 | 67 | 75.2 | 0 | 0.0 | 67 | 40.1 |
| 03:30 | 67 | 75.2 | 0 | 0.0 | 67 | 40.1 |
| 03:45 | 67 | 75.2 | 0 | 0.0 | 67 | 40.1 |
| 04:00 | 65 | 75.2 | 0 | 0.0 | 65 | 38.9 |
| 04:45 | 65 | 75.2 | 0 | 0.0 | 65 | 38.9 |

*FIG. 27*

The "Show Zone Alarms' will display a list of all the alarms starting from 12am in 15 minutes increments.

Time is displayed in military time

Warm displays the number of thermostats that had a difference between setpoint temp and current Temp greater than the set threshold (2.75° default).

Cool displays the number of Thermostats that were cooler than the setpoint temp by the set threshold (2.75° default).

Avg displays the average temperature of the faulted thermostats

Total is the total number of faults between warm and cool faults. The % Represents the percent of zones that have faults

* note: The number of faults displayed is high because the thermostats are turned off since the office is not in use (@ 12am-5:00am )

Advanced Automated Comfort Control App

Main landing Page for all users that have access to more then one area

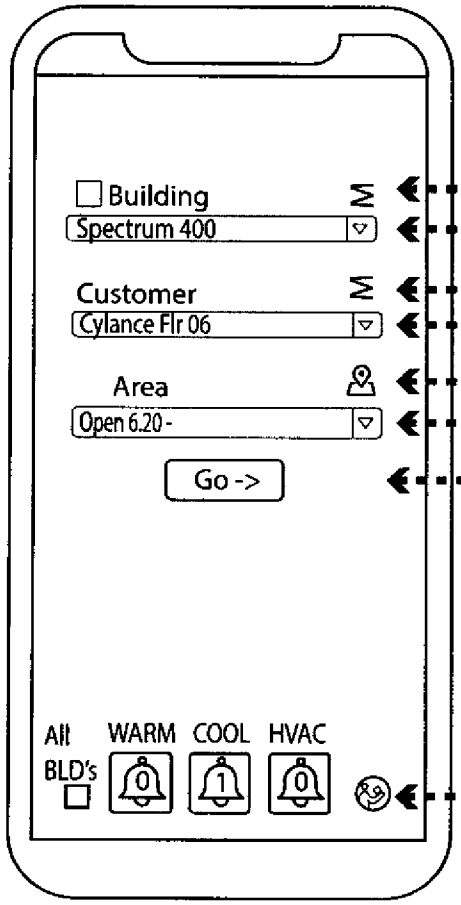

Any users with only 1 customer and 1 area will not see this landing page and instead will see the thermostat page

Main Landing Page Features:

- Building level reports & features (Building Managers/System Admins Only)
- Select building
- Customer level reports (Shows reports for specific selected Customer)
- Select customer
- Display 3D floor map of customer selected (If included)
- Select Area (virtual thermostat)
- "Go" button, proceed to virtual thermostat
- Displays user manual Hot and Cold Alarms Report 1. Displays report of currently selected building
2. "All BLD's" will display alarms for ALL buildings
3. Warm will show any VAVs that are above set temperature
4. Cool will show any VAVs that are below set temperature

FIG. 29

On Boarding - All Users & Roles (Apple Phones)
Step 1
When the "Go" Email button is pushed the system will automatically be directed to this page
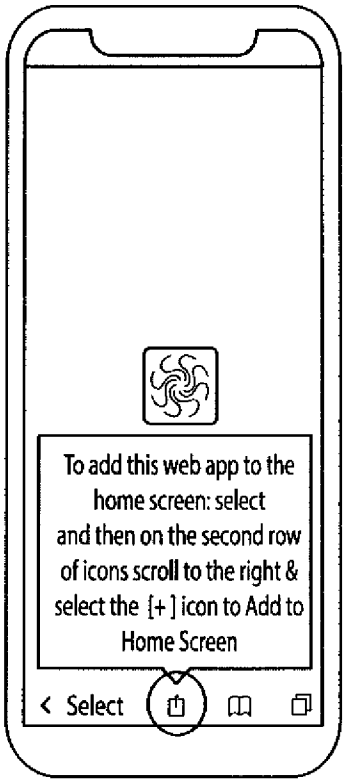
Apple Users Only
Step 2
Select add to home screen.
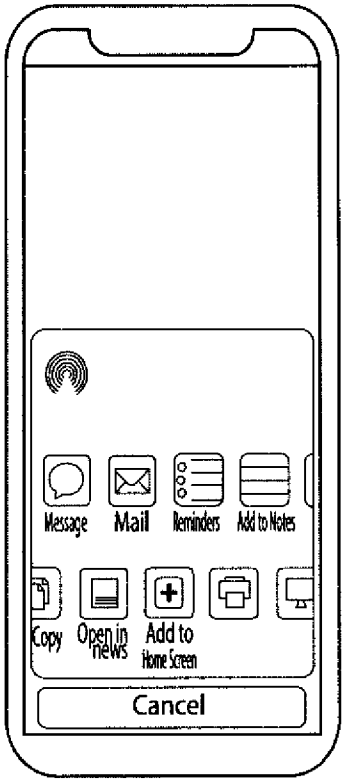
Apple Users Only
Step 3
Select Add.
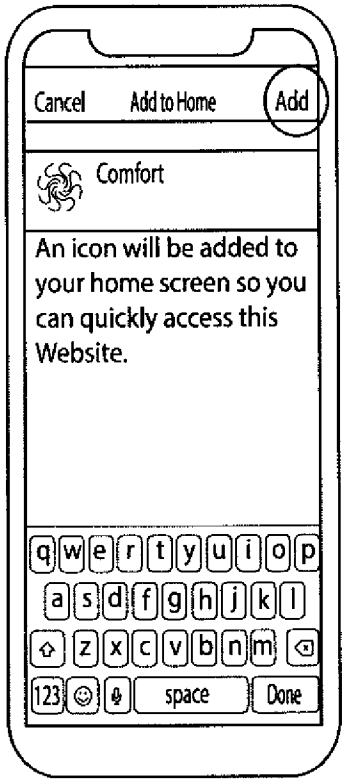
Apple Users Only
The Comfort icon is now on the phone home screen. The app is now ready for use.
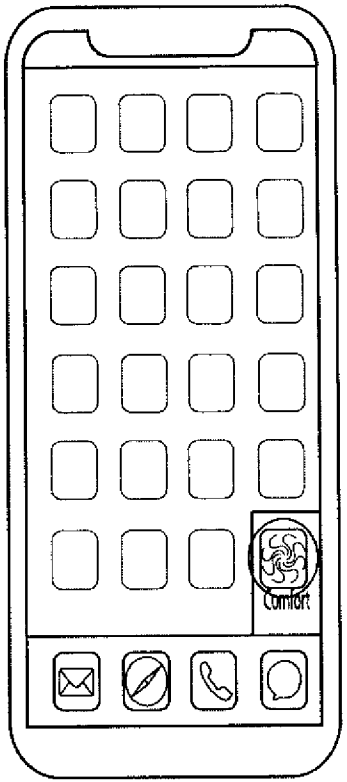
Apple Users Only
FIG. 30

SYSTEM, APPARATUS AND HYBRID VAV DEVICE WITH MULTIPLE HEATING COILS

CROSS REFERENCE TO RELATED APPLICATIONS

The application is related to and entitled to priority based on the subject matter disclosed in U.S. Provisional Patent Application Ser. No. 62/737,251 filed Sep. 27, 2018 and U.S. Provisional Application Ser. No. 62/741,690 filed Oct. 5, 2018 which are incorporated herein by reference in their entirety.

COPYRIGHT/TRADEMARK NOTICE

This document includes subject matter that is also subject to U.S. and International copyright and trademark protection. The copyright and trademark owner grants permission to copy this document and U.S. Provisional Patent Application Nos. 62/737,251 and 62/741,690 in the U.S. Patent And Trademark Office as well as in corresponding Patent Offices but reserves all rights to the trademarks and software, data and GUI interface described herein and in U.S. Provisional Patent Application No. 62/737,251 filed Sep. 27, 2018 and U.S. Provisional Application No. 62/741,690 filed Oct. 5, 2018 including the appended drawings. Copyright © 2018, 2019 Keith Voysey and Advanced Automated Systems, Inc. of Yorba Linda, California 92887 USA.

All Rights Reserved.

BACKGROUND OF THE INVENTION

1. Field of the Invention

The invention pertains to a system, method and device for saving energy while at the same time providing a granular control over heating and cooling of individual zones of buildings, including specifically commercial buildings. More particularly the embodiments relate to novel hybrid variable air volume (VAV) terminal units having at least one air inlet duct, a damper and at least two air outlets preferably with at least one dedicated heating coil for each outlet. The systems of the invention provide a granular zone temperature control through a master control as well as tenant control on site or remotely through a cellphone app or the internet of things (IoT). The novel method and system rely upon the novel hybrid VAV box to save energy, save installation costs by reducing VAV count and providing an automated air balancing of the entire system, as well as individual zone temperature control and provides maximum flexibility in future reconfiguration of office space.

2. Description of the Prior Art

Variable air volume terminal units (VAV boxes) are commonly used in buildings and in particular commercial buildings to provide heating, cooling and ventilation for occupants in different rooms. As illustrated in prior art FIG. 1 a typical prior art VAV box 11 includes an air inlet 13, an air flow measurement device or velocity sensor 15, a control damper 19 and a single outlet 21. Referring now to FIG. 1A prior art VAV box 11 has top 23 removed to illustrate the position of a fan or in this case a single heating or cooling coil 25 disposed adjacent to the outlet 21.

Each VAV box 11 controls a smaller area or group of offices within a floor as illustrated in FIG. 1A. As a result, it is not uncommon for a commercial building with approximately 30,000 square feet to require the installation of approximately 33 VAV boxes throughout the building floor. The purpose of each individual VAV box is to provide air conditioning, heating and ventilation and control to a small area of rooms (typically 1-6 rooms) or for example the four rooms 27, 29, 31 and 33 in FIG. 2A, each of which is supplied with air through a separate drop down damper 27*a*, 29*a*, 31*a* and 33*a* in FIG. 1. Temperature for each of the rooms is first controlled by a thermostat T which is located in master room 29 which primarily controls the temperature in slave rooms 27, 31 and 33. This prior art also requires an initial air balancing so that the temperature in master room 29 more or less corresponds to the temperature in slave rooms 27, 31 and 33 by adjusting the air flow from a separate duct 3-7 with each damper 39, 41, 43 and 45. After the air balancer or technician has completed the air balancing work the temperature of slave rooms 27, 31 and 33 are controlled by thermostat T in master room 29. Thermostat T primarily controls the position of damper 19 in VAV box 11 to control temperature FIG. 1.

The prior art also includes VAV boxes with a single air handler (AH) inlet and multiple outlets to control temperature in different zones of a building. Examples of such prior art include Federspiel, et al. U.S. Pat. No. 8,688,243, Ring U.S. Pat. No. 4,917,174 and Ginn, et al. U.S. Pat. No. 3,934,795 each of which have multiple outlets with dampers, separate reheat coils and separate cooling coils for each outlet. The reheat coils in one of the separate ducts in the VAV are connected by a separate heating duct to a drop down register while the separate cooling coils in one of the separate ducts in the VAV are connected by a separate cooling duct to the drop down register where the warm air and cool air are mixed to meet the selected temperature requirements for the room.

Such prior art addresses the specific requirements of each zone but at the expense of a separate set of ducts and the requirement for both heating coils and cooling coils in the VAV with separate ducts. Such prior art is expensive to install and operate as it is not energy efficient and does not provide a virtual thermostat or provide the advantages of the novel hybrid VAV which utilizes a single ductwork system which is predominately found in commercial buildings which can be upgraded by adding the novel hybrid VAV. The novel hybrid VAV utilizes a single air handler inlet and at least two outlets or more outlets each of which has its own heating coil to provide a granular temperature control over each heating zone as will be described hereinafter in greater detail.

The hybrid VAV and methods and systems provided herein are the result of an extensive research effort by the inventor as illustrated by the Sep. 27, 2018 Provisional Application Ser. No. 62/737,251 and the Oct. 5, 2018 Provisional Application Ser. No. 62/741,690. The Jul. 9, 2018 attachment in Ser. No. 62/741,690 identifies options for creating a new system to provide individual zone temperature control. The Aug. 28, 2018 attachment in Ser. No. 62/737,251 represents further refinements in the new system which was not sold or offered for sale until long after the filing of the provisional applications. A novel system was subsequently installed on Dec. 6, 2018.

The prior art also includes numerous complete systems having remote controlled systems with computers and databases for saving energy such as Kuckuk, et al. U.S. Pub. 2017/0314796; Salsbury U.S. Pat. No. 8,255,085; West et al. U.S. Pat. No. 6,296,193 and Barooah et al. U.S. Pat. No. 10,047,968. Some of the prior art controls a VAV and use multiple VAVs and control the temperatures based on setpoints, load and ventilation requirements. None of the prior art employs the novel hybrid VAV. Indeed West et al. U.S. Pat. No. 6,296,193 refers to the conventional VAV boxes of Ben-Aissa et al. U.S. Pat. No. 5,558,274.

Controlling temperature from a master room 29 is particularly a problem when a slave office 47 is a corner office as illustrated in FIG. 2A and especially where the corner office is exposed to the sun in the diurnal heating cycle. Office 47 may be too hot during one 24-hour period and too cold during another part of the 24-hour period. The typical solution to such situations is to add an additional VAV box or a separate space heater or space cooler which is not energy efficient and detracts value from the office space.

As heretofore discussed in the prior art the air flow once it leaves the VAV Box is distributed to multiple spaces (rooms) by adjusting manual balancing dampers to control temperature based on the HVAC output. Cooling temperature control is typically based on a single room temperature and air volume either increases or decreases to control all the spaces served by a VAV box. For exterior offices heating ability is added. In the event heat is required, the VAV box air volume is reduced and heat is injected into the air stream through either a hot water coil 25 or an electric heat element. For interior offices, typically the ability to heat is not provided, heat is only achieved by not cooling (closing the air volume to its minimum setting and allowing the internal space temperature load and residual heating from exterior spaces to slowly heat the space. This traditional VAV system design while relatively inexpensive, has many drawbacks which are as follows:

1. VAV boxes do not provide individual room control unless an individual VAV box is provided for each room served. This invention solves the prior art inefficiency by replacing the manual balancing damper with an automated space control damper. By using the invention a single hybrid VAV box with at least two air outlets can now provide individual room control without the expense of adding more VAV boxes. By adding more than one reheat coil to the hybrid VAV box and optionally a reheat coil for each outlet, each area served from the hybrid VAV box can have autonomous control from another served from the same VAV box.
2. When a VAV box serves multiple offices and there is only one area occupied, the typical VAV has no ability to isolate (shut off) the unoccupied areas.
3. Installation of each VAV box is expensive. This new design typically reduces the overall VAV count by ⅔. Using fewer, but larger VAV boxes with multiple outlets and re-heat coils served by a single set of balancing and isolation valves significantly reduces the cost of a building's mechanical infrastructure.
4. Prior art VAVs use a central physical thermostat to control temperature by controlling a central damper position. The invention allows for each room to have either a physical or virtual thermostat (via a smartphone) to control the automated space control damper (ASCD) individually in each room which can be connected to the internet of things with many unique features that physical thermostats cannot provide.
5. The new hybrid VAV allows for interior and exterior area's to be served by the same multi-coil VAV having a plurality of outlets. This makes for a more flexible overall system design, allowing easier and simpler floor alterations in the future.
6. This new hybrid VAV also includes the unique ability to automatically calibrate minimum and maximum air flow settings for each area served. By closing all and only opening one control damper at a time, the air flow is read through the hybrid VAV box's velocity sensor. By modulating the control damper and reading the air flow sensor the system records when the proper minimum and maximum damper positions are achieved.

The new hybrid VAV in addition solves a number of problems in the prior art including poor temperature distribution and control by a prior art VAV serving a plurality of rooms controlled by a single thermostat in a single duct system. The novel hybrid design reduces the number of VAV's required to provide a more precise control of temperature in various zones for a given amount of space. The new hybrid VAV increases the efficiency of the use of energy and when coupled to a computer and a smart phone app and/or the internet of things allows energy to be conserved by using only the minimal amount of energy where needed and when needed.

As such, there is a need in the industry for a hybrid variable air volume terminal system with multiple heating coils that is compatible with a single duct system and enhances the temperature control and area coverage of the volume terminal boxes. The novel hybrid VAV increases the area coverage that a prior art VAV box can serve and reduces the number of VAV boxes installed in a building to reduce installation, operational and energy use. The novel method and system and its control applications and smart phone apps and connection to the internet of things provides versatility in office remodeling and changes in office layout as well as energy saving in application and operation.

SUMMARY

One implementation of the disclosed embodiments relates to the novel building management system which provides a virtual or a physical thermostat associated with each zone or room of a building served by a single duct that serves a plurality of zones or rooms. A communications interface is provided to communicate with a drop-down damper or preferably with an automated space control damper or ASCD. The communications interface operates an electrically operated damper to increase or decrease air flow from a novel hybrid VAV. The building management system includes a controller and a database that implements commands from the tenant of the space, the building manager or a controller based either on sensed use and/or a history of past usage from the database to save energy.

The air handler (AH) that serves the building includes heaters, chillers, pumps and fans to provide heating, cooling, ventilation and other services to the building. In accordance with saving energy it has been recognized and appreciated that maintaining an unoccupied building or room of a building at about 68 to 70° F. or 20 to 25° C. is the most efficient use of energy for heating and cooling. It has also been recognized and appreciated that it is more energy efficient to heat air than to cool air.

In recognizing these energy saving parameters the energy saving implementation advantages involves running the cooling cycle of an AC of an AH at around 55° F. and transporting the cooled air to a novel hybrid VAV. The novel hybrid VAV provides heating elements in each outlet of the VAV minus one heating element or coil where the outlets of the VAV are three or more to provide warmed air to each zone of a plurality of zones serviced by a single duct. The granular temperature control of each zone in the plurality of zones serviced by the single duct is preferably controlled by an electrically operated ASCD to increase or decrease the air flow and/or the temperature of the air flow from the novel hybrid VAV to increase the amount of heat added to the cooled air to match a particular thermostat setting for each individual space or collectively and individually for each room or zone.

In the winter or cold weather the AH supplies warm air at about 70° F. or 21° C. The novel hybrid VAV can also then heat this air to about 95° F. or 35° C. before distributing this heated air to the single duct distribution system. Thereafter the temperature of each single zone is modified by the tenant or occupant of the zone by changing the actual thermostat or virtual thermostat provided for that zone by increasing or decreasing flow by changing the position of the damper in the ASCD which may be either a floor or wall register but is usually a drop down damper in commercial buildings. The ASCD in alternative applications can include an optional heater or heater housing to provide additional heating, cooling and ventilation control in a particular room or zone connected to the novel hybrid VAV.

The automated space control damper ASCD together with the novel hybrid VAV box with at least two outlets one of which has a heating element results in temperature control being controlled by the ASCD and not by the traditional VAV box damper as in prior art VAV boxes. Temperature is instead controlled by the ASCD using a wired or wireless thermostat in a particular room or zone of the building. This change in the novel hybrid VAV box makes the novel hybrid VAV box operate somewhat like a constant air volume box and somewhat like a variable air volume box hence it is referred to as a hybrid VAV. Control of temperature from the ASCD provides energy saving advantages in the operation of the entire system since heating and cooling can be diverted from zones not in use to zones that are in use.

One implementation of the energy savings advantages can be achieved by providing both a sensor link and/or a communications interface to the ASCD to heat or cool an area based on actual load sensed by an electronic occupancy sensor (EOS) or a room light switch so that when the light is on signifying the room is occupied the ASCD maintains the desired room temperature. When the room is unoccupied the space is either controlled to an OFF setting or to a more energy efficient setting. The ASCD, hybrid VAV and AH can also communicate with a database to heat and cool based on anticipated future load requirements. Actual load requirements can be provided by employing a building management system BMS that employs sensors and computer control with databases to track actual building use and occupancy. Anticipated future load requirements may be provided by smart device apps connected to a communications device to prepare for an unexpected meeting outside normal business hours.

Control of temperature by the ASCD for the group of rooms also provides for a programmed or automatic recalibration of the entire group of rooms that previously required the work of an air balancer technician. After the installation or in operation of the prior art VAV the work of an air balancer technician was needed to equalize air flow to each room or zone serviced by the VAV duct so that the slave areas more or less correspond to the master area with the thermostat. This balancing might be good for one time of day (depending on diurnal heating and cooling) or one time of the year such as winter or summer but would then result in an unbalance at other times. The novel hybrid VAV in combination with the ASCD together with computer programming and a database eliminates the need for an air balancer technician. In addition, the computer and database can be programmed to provide for periodic rebalancing based on weather and thermostat settings in each zone. The prior art air balancer technician set minimum and maximum air flow settings for each office. The automated air balance system in accordance with a preferred embodiment does this automatically.

These and other advantages are achieved with a hybrid variable air volume terminal system with multiple heating coils to enhance temperature control of a plurality of rooms in a building. The hybrid variable air volume terminal system comprises a hybrid variable air volume box for a building, and a plurality of ducts coupled to the hybrid variable air volume box, each duct of the plurality of ducts comprising a heating coil operably connected thereto, and with each duct operably connected to any number of the plurality of rooms.

The novel hybrid variable air volume system can have boxes that are not rectangular in shape. Indeed any VAV box shape can be employed that is compatible with the joists or support structure beams between the ceiling and utility area between the ceiling and the next floor of the building. As a result round, polygonal, or other shaped hybrid VAV boxes may be employed depending on space. The number of outlets to the hybrid VAV box may be changed to suit requirements and at least one outlet of a hybrid VAV box can be without a heating element to provide air to either an internal area or provide an inlet to another terminal VAV box having an unheated inlet with a plurality of heated outlets. The size of the hybrid VAV box can be varied. However larger size hybrid VAV boxes are preferred with a size of about 16 inches or 40 centimeters being preferred.

In certain embodiments a wired or wireless thermostat can be used for each room or a virtual thermostat can be operably connected to the novel hybrid variable air volume terminal system to control the operation of the system remotely. In certain embodiments, the variable air volume terminal system comprises an automated air balance system and demand response control system to control and/or vary the amount of air flow into the plurality of rooms in the building.

Additional embodiments and applications will be appreciated by those skilled in the art with additional aspects and advantages deemed to be illustrative and not limiting. Such additional embodiments are illustrative only and not intended as limiting the claims to any one embodiment or application as illustrated in the accompanying drawings and Detailed Description of Certain Embodiments.

BRIEF DESCRIPTION OF THE DRAWINGS

The detailed description of some embodiments of the invention will be made below with reference to the accompanying figures, wherein the figures disclose one or more embodiments of the present invention; in which:

FIG. 4A is a perspective partially cut away view of a novel hybrid VAV with one inlet and two outlets with heater coils;

FIG. 4A1 is a perspective partially cut away view identical to FIG. 4A except for the absence of the optional damper;

FIG. 27 are smart phone GUI app displays providing alarm messages in accordance with a BMS application;

FIG. 29 is a smart phone GUI app display in accordance with a BMS application;

FIG. 30 is a smart phone GUI app display; and

DETAILED DESCRIPTION OF CERTAIN EMBODIMENTS

The following detailed description includes the best mode and accompanying drawings in which like references indicate similar elements and which show specific embodiments and portions of a GUI interface for practicing the invention. The embodiments include optional and preferred embodiments to practice the invention which may be modified without departing from the scope of the invention as claimed. For example logical, mechanical, electrical, functional and system changes can be made in implementing the invention without departing from the invention. The following detailed description including best mode is not to be taken in a limiting sense, since the scope of the invention is defined in the appended claims.

In certain embodiments of the invention, the novel hybrid variable air volume terminal system comprises one or more of the following components alone or in combination: (1) a hybrid VAV Box with or without a sub plenum; (2) Dual heating coils; (3) First air distribution duct or a plurality of distribution ducts; (4) Second air distribution duct; (5) Room control dampers for first duct; and (6) Room control dampers and preferably automated space control dampers (ASCD) for second duct.

Figure 1:
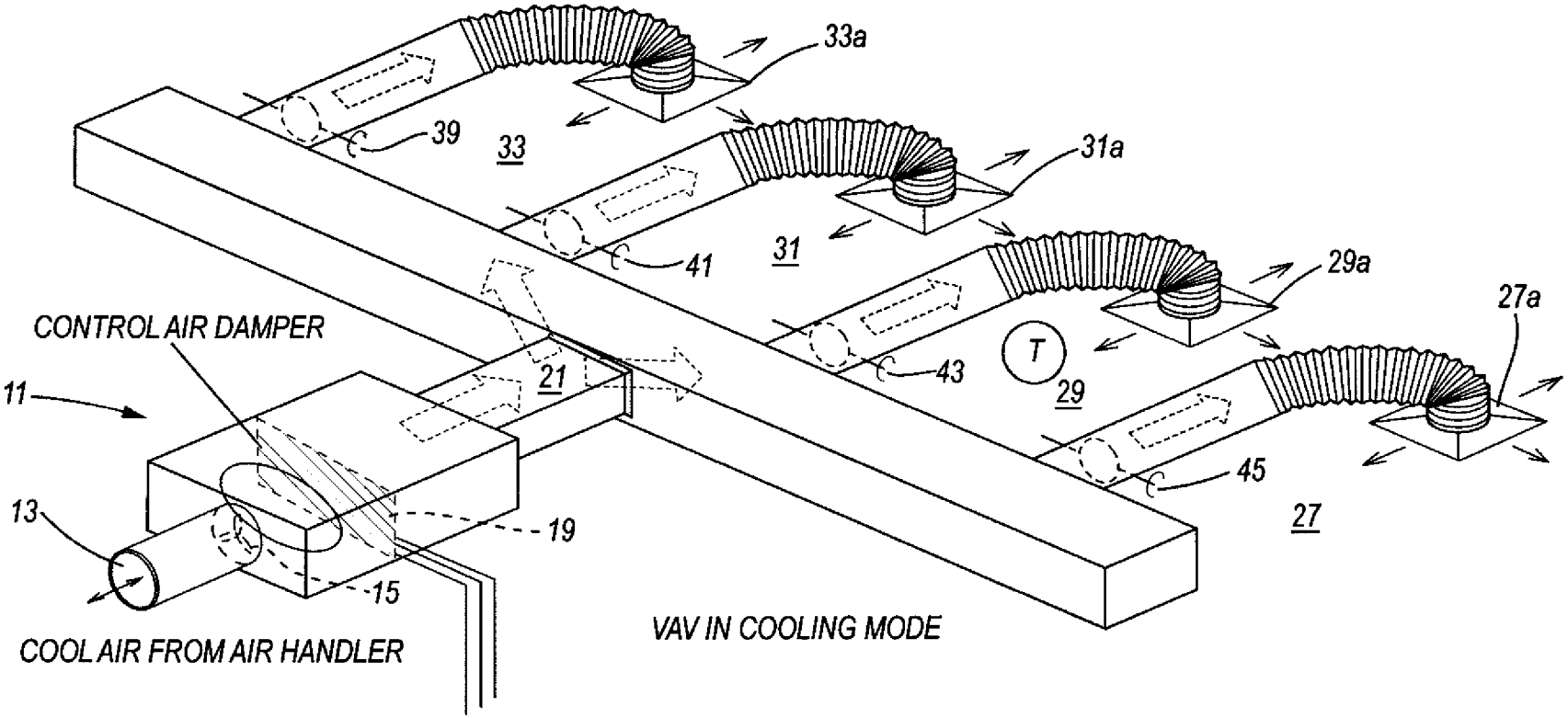
FIG. 1 PRIOR ART
FIG. 1 is a perspective view of a prior art VAV with single ducting to drop down dampers.

Referring now to FIG. 4A a novel hybrid VAV 10 is illustrated having an inlet duct 12 and two outlet ducts 14 and 16. An air velocity flow sensor 18 is provided at the inlet duct 12 along with an optional damper 20. The novel hybrid VAV 10 differs from prior art VAV box 11 (FIG. 1A) in having an optional damper 20 that is not adjusted to control temperature of air leaving hybrid VAV box 10. FIG. 4A1 illustrates the hybrid VAV 10 without the optional damper 20. The temperature of the conditioned air leaving hybrid VAV box is determined not by damper 20 but instead by an automated space control damper ASCD 40A-40G FIG. 6A and heating coils 22A and 22B in FIG. 4A. Heating coils 22A and 22B can be either water heating coils or electric heating coils with water the preferred implementation. A heating coil actuator 24, 26 is provided for each of the outlets, 14 and 16, respectively of the novel VAV 10.

Hybrid VAV 10 includes a sub plenum 30 disposed between the plurality of outlets and a terminal wall 36 opposite inlet 12 to equalize air flow and reduce noise. The size of the sub plenum is approximately 10% to 20% of the interior space of the novel hybrid VAV. Hybrid VAV 10 has at least two or more outlets 14 and 16 but may have one less heating element 22A or 22B than the total number of outlets. Where the novel hybrid VAV includes an outlet each with a heating element 22A and 22B a single duct 32 and 34 connect the hybrid VAV 10 to a separate group of offices with each office having its own ASCD or automated space control damper 40A, 40B, 40C and each of which control temperature in duct 32 which ASCD dampers 40E, 40F, 40G and 40H control temperature in duct 34 as illustrated in FIG. 5.

Figure 5:
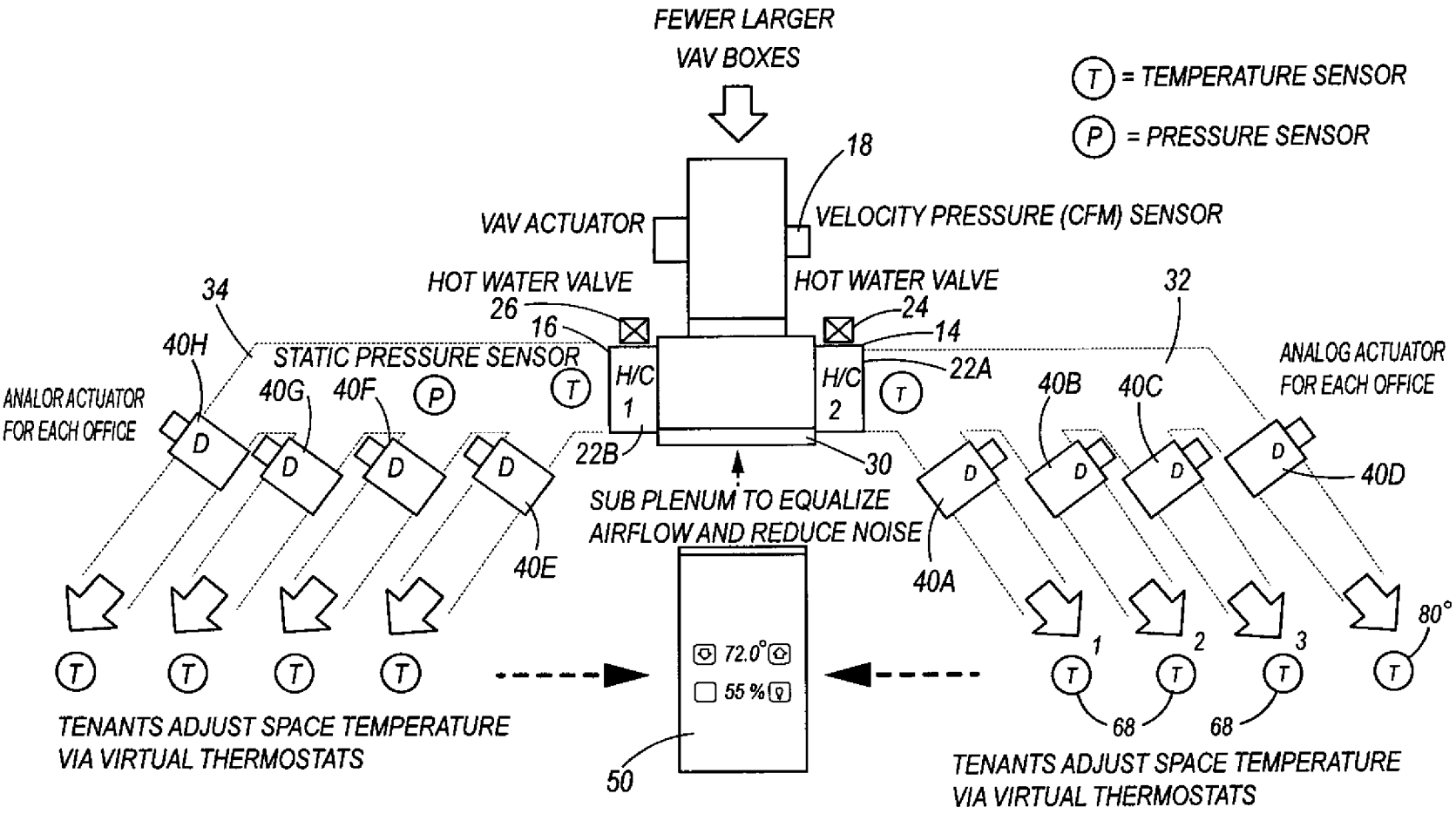
FIG. 5 is a schematic view of an application of a novel hybrid VAV to provide individual temperature control to a plurality of rooms each having a separate thermostat T.
Figure 6:
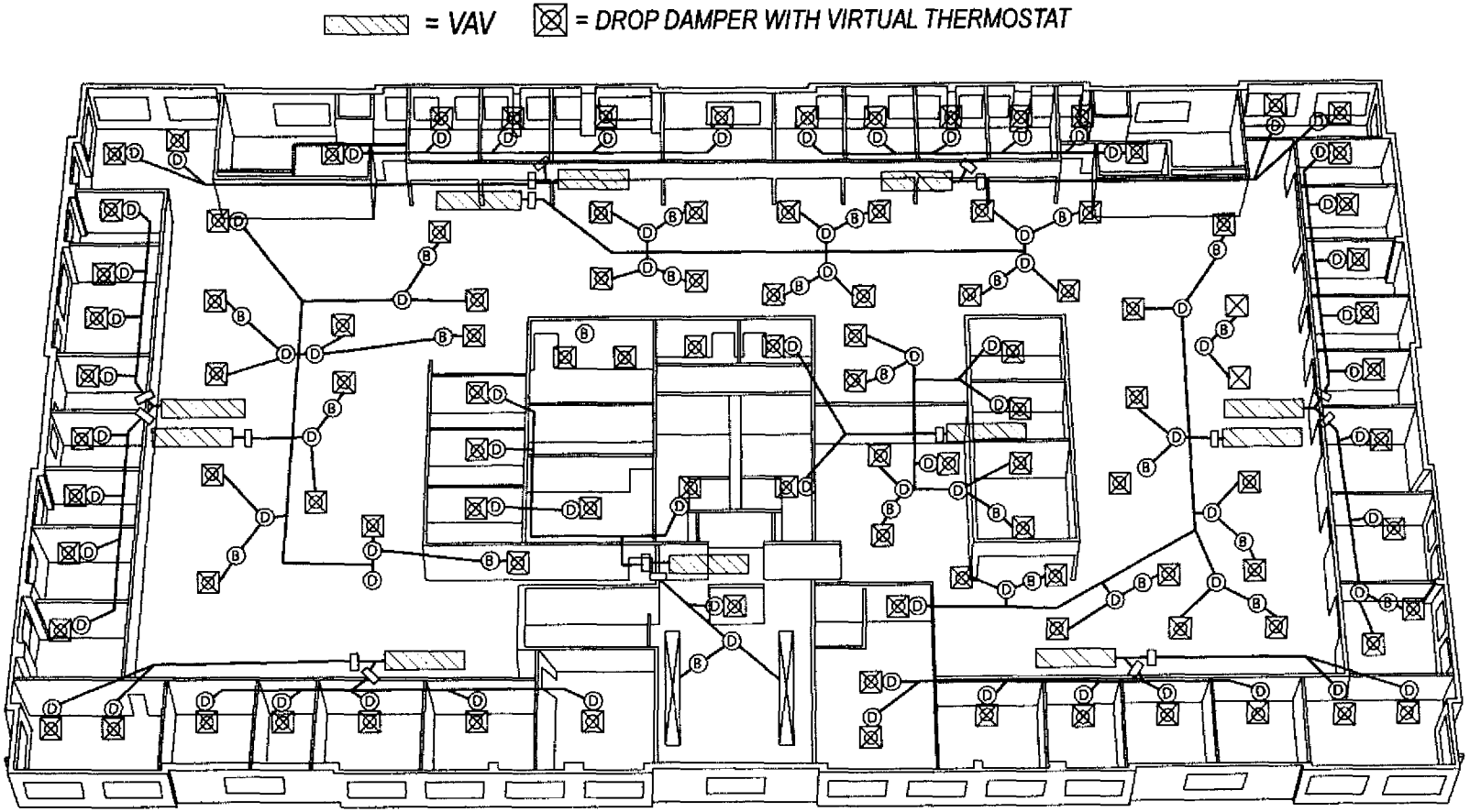
FIG. 6 is a perspective heating plan for comparison with prior art FIG. 3 illustrating a reduced number of VAV boxes using the novel hybrid VAV.
Figure 6A:
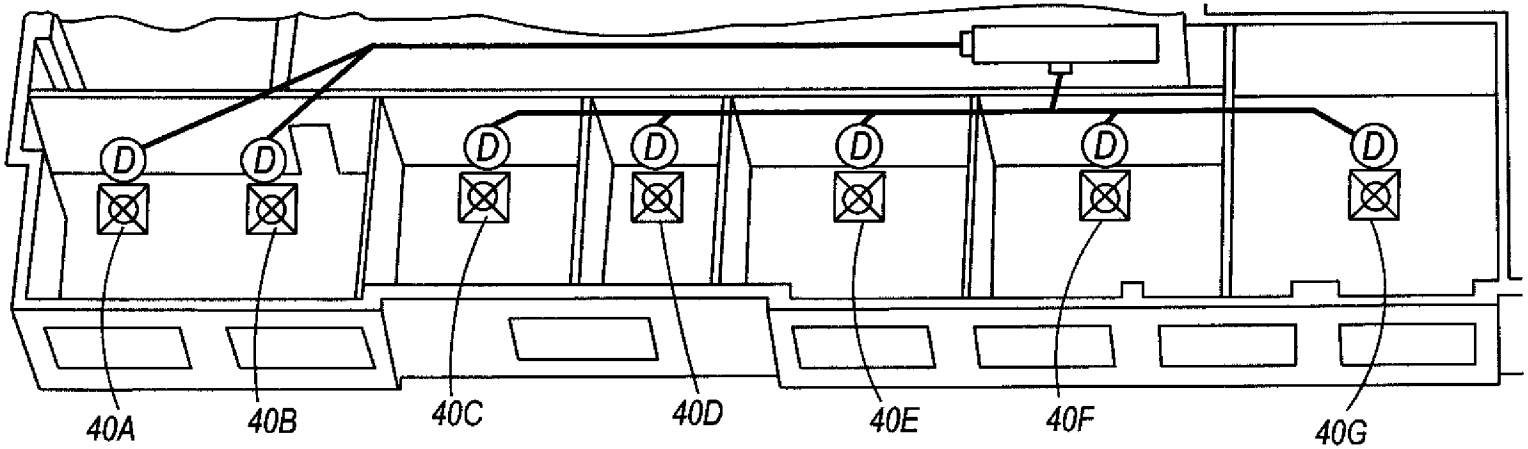
FIG. 6A is a perspective fragmentary view of a portion of a heating plan using the novel hybrid VAV.

Referring now to FIGS. 5 and 6A each office served by ASCD 40A, 40B, 40C, 40E, 40F, 40G and 40H each can have their separate thermostat to individually set the temperature in their office by opening and closing the damper in the ASCD in their individual office using a wired thermostat or a wireless thermostat that can be accessed through a smart device such as cellphone 50.

Figure 1A:
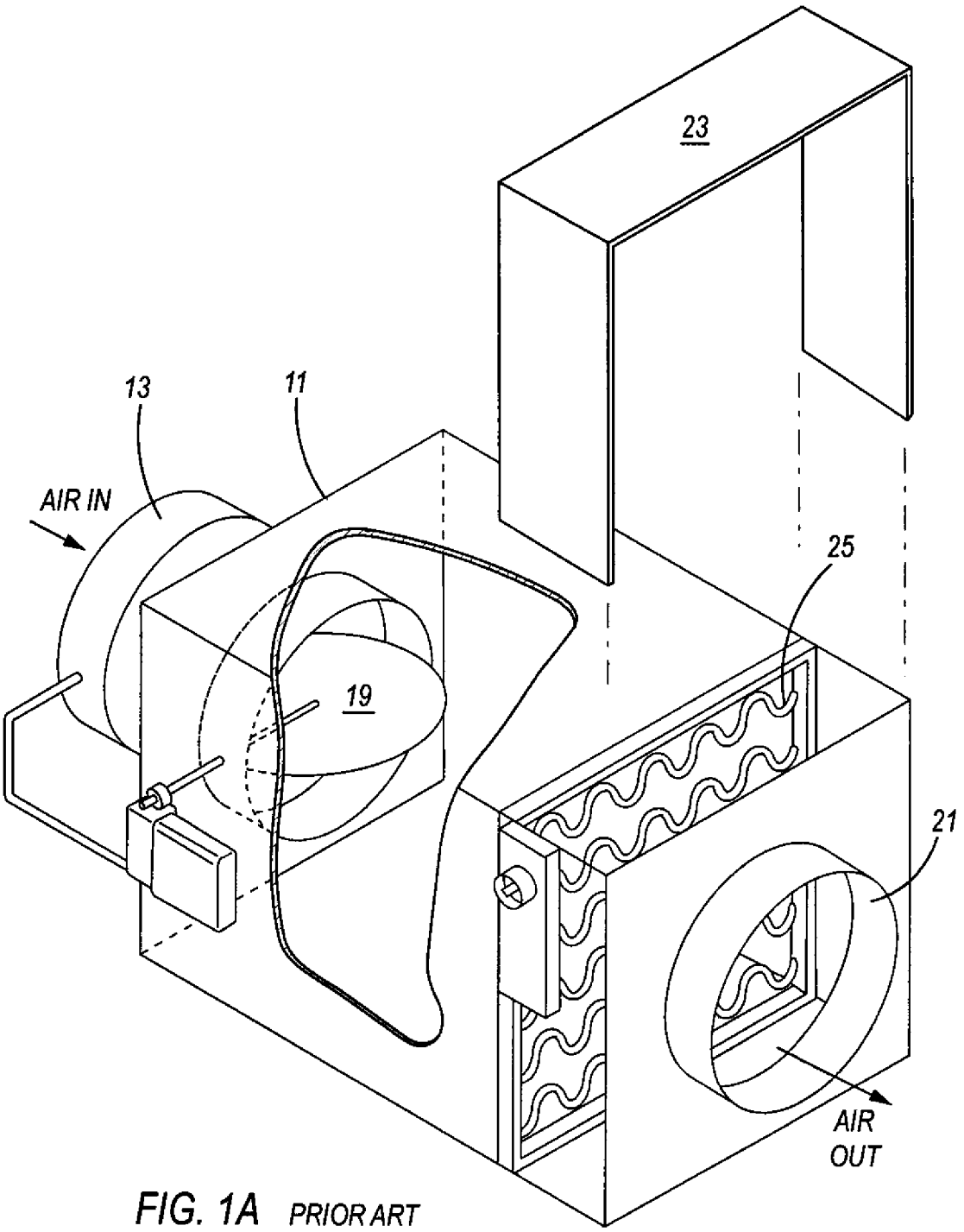
FIG. 1A PRIOR ART
FIG. 1A is a perspective view of a partially cut away and exploded prior art VAV box.
Figure 2:
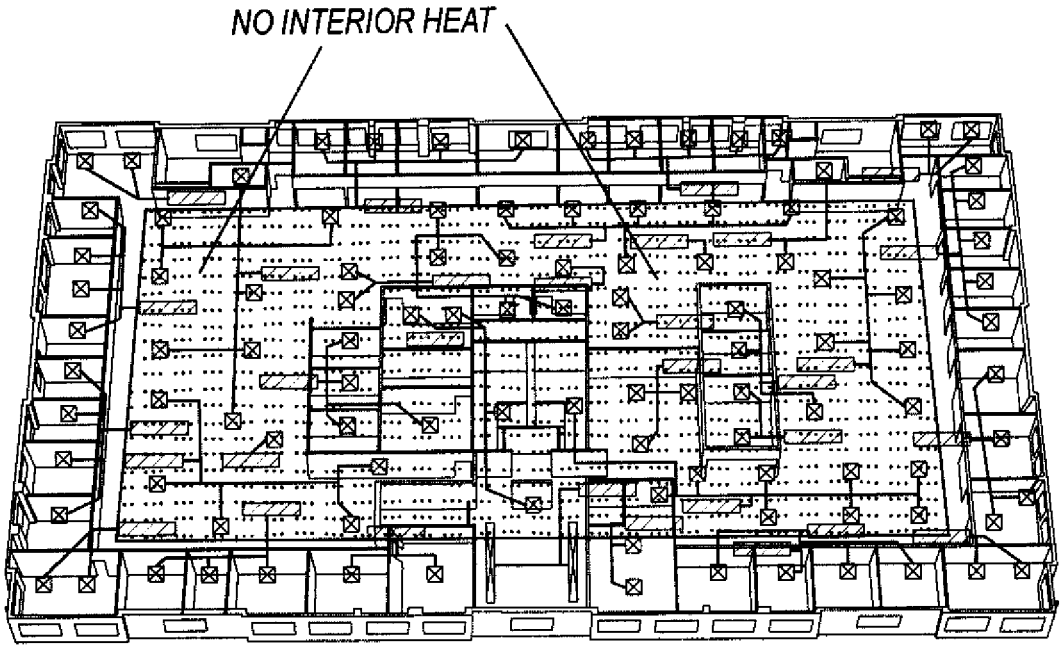
FIG. 2 PRIOR ART
FIG. 2 is a perspective prior art view of a typical heating plan using prior art VAV boxes.
Figure 2A:
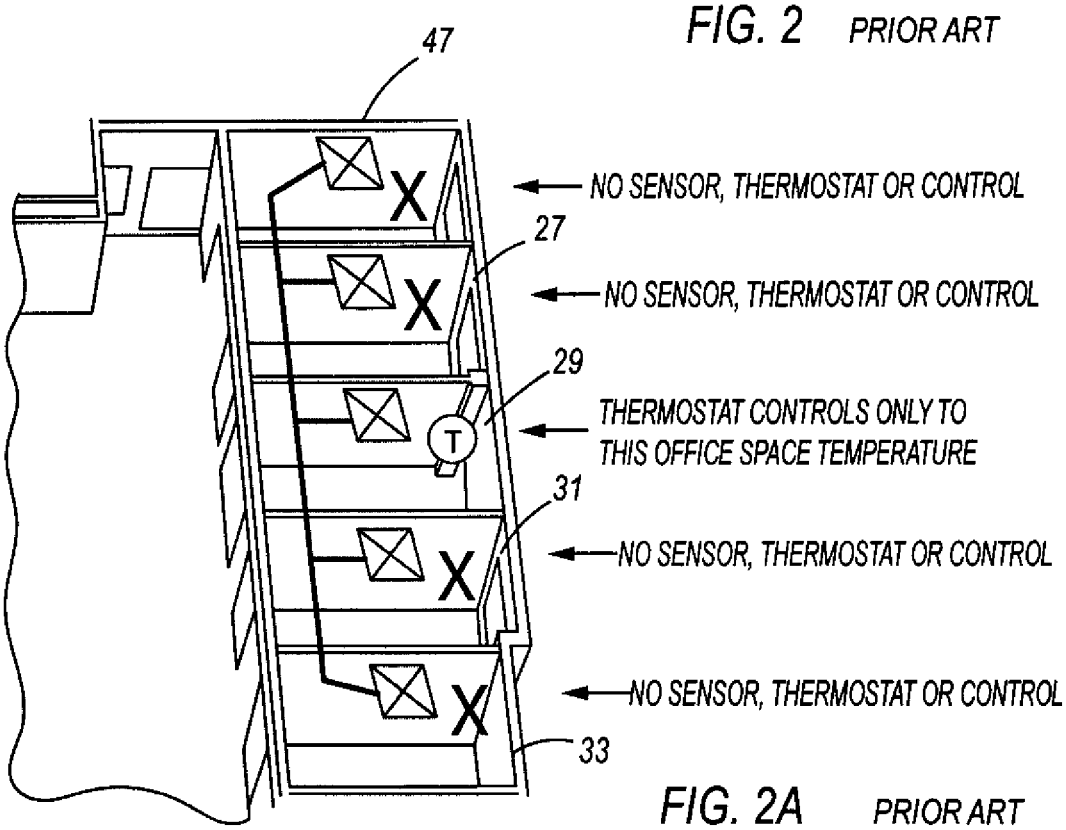
FIG. 2A PRIOR ART
FIG. 2A is a perspective view of a portion of a prior art heating plan.

Comparing now prior art FIG. 1A and FIG. 2A with FIGS. 5 and 6A it will become apparent that unlike the prior art, temperature of each individual office is not controlled by damper 19 but instead dampers in each ASCD 40A, 40B, 40C, 40D, 40E, and 40G in each individual office 52, 54, 56, 58, 60 and 62. This change in control converts a VAV variable air volume device into the novel hybrid VAV which operates somewhat like a constant air volume device and somewhat like a variable volume device. A further observation is that room 52 can be later remodeled or subdivided into two rooms each of which have their own thermostat and temperature control. A further observation is the master slave arrangement between offices has been eliminated.

Figure 4B:
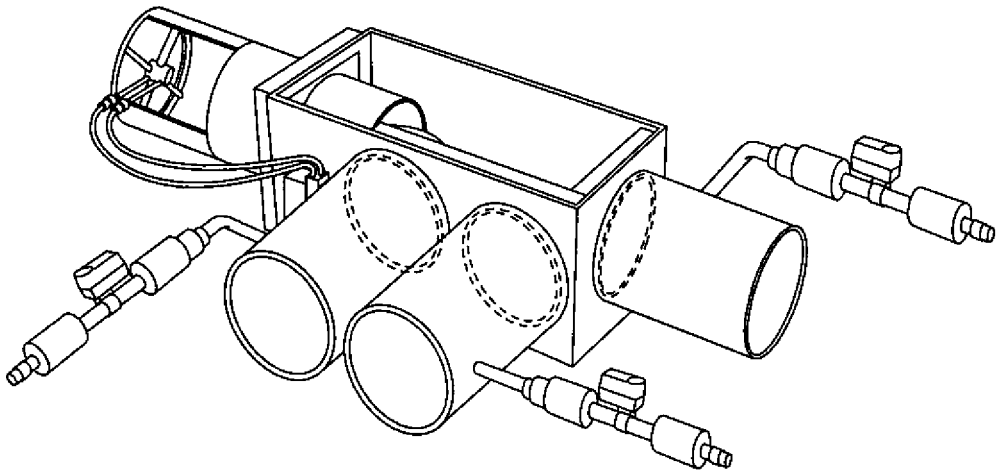
FIG. 4B is a perspective top removed view of a novel hybrid VAV with one inlet and three outlets.
Figure 4C:
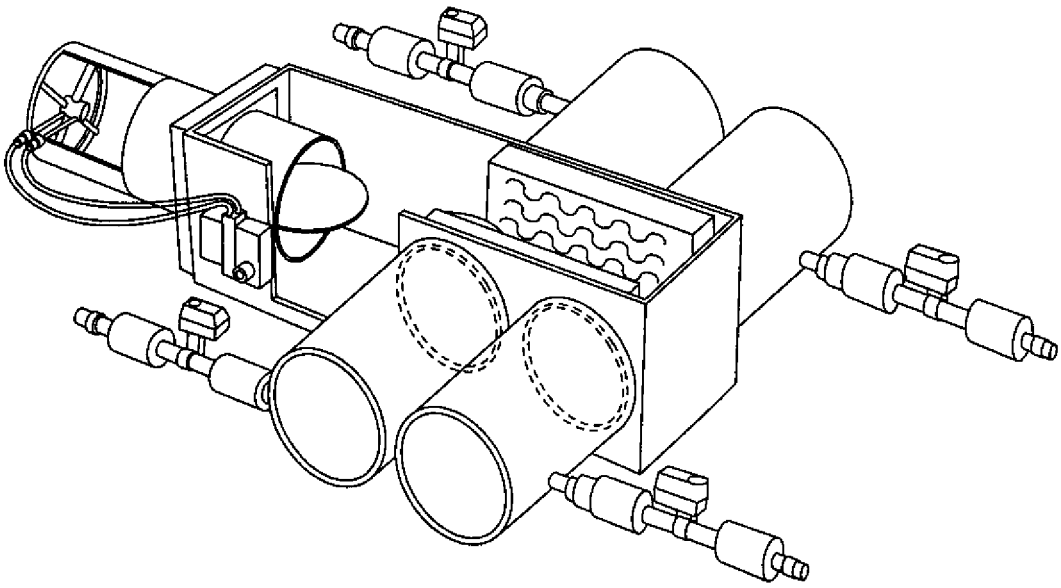
FIG. 4C is a perspective top removed view of a novel hybrid VAV with one inlet and four outlets.
Figure 4D:
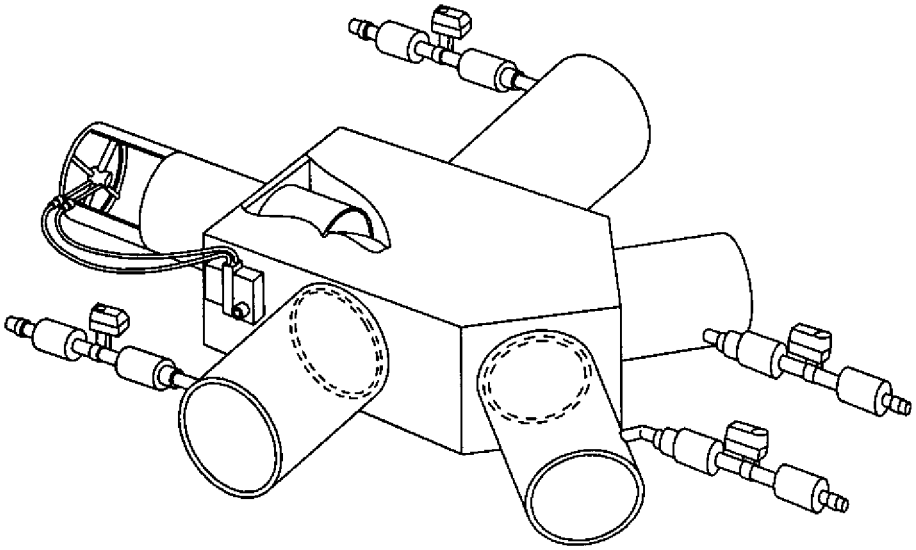
FIG. 4D is a perspective top removed view of a novel polygonal hybrid VAV with one inlet and five outlets.
Figure 4E:
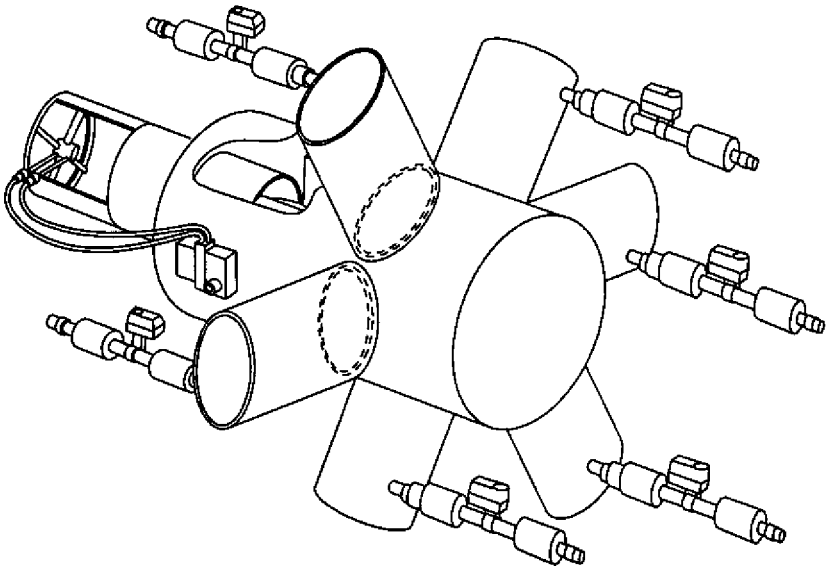
FIG. 4E is a perspective top removed view of a novel circular hybrid VAV with one inlet and six outlets.

The novel hybrid VAV box can be configured in a number of different ways as illustrated in FIGS. 4B, 4C, 4D and 4E. The hybrid VAV 10 can be rectangular as illustrated in FIGS. 4B and 4C or be polygonal as illustrated in FIG. 4D or even round as illustrated in FIG. 4E. The hybrid VAV preferably has a single inlet with 2 to 6 or more outlets with each outlet having a heating coil 22 or one or more outlets not having a heating coil to transfer unheated air to other portions of the building or to another hybrid VAV box.

In one embodiment, a single hybrid VAV box (10) feeds two or more ducts (14, 16). Each duct can have a heating coil (22) operably connected thereto. Conditioned air is then delivered to individual temperature controlled rooms by ASCD control dampers (40). This assembly can be installed as many times as needed throughout the building. The hybrid VAV box air flow is controlled to maintain a static duct pressure setpoint FIG. 5 using feedback from a duct static pressure sensor P (FIG. 5). If the total airflow exceeds the maximum CFM setpoint, then the control is switched to maintain the maximum CFM flow setting using the velocity pressure sensor 18 within the hybrid VAV box. For each duct (32, 34), the heating coil opens if more than half of the served rooms 52, 54, 56, 58, 60 and 62 (FIG. 6A) require heat. If more than half the rooms need heat, then the ASCD room damper control action is reversed (open heat), otherwise the room control action is (open cool). Each room control damper ASCD opens and closes to maintain individual space temperature based on each temperature sensor.

Referring now to prior art FIG. 2 a typical floor office layout for heating and cooling is illustrated. VAV boxes are expensive and as a result each VAV box 11 serves a plurality of offices 27, 29, 31, 33 and 47 resulting in a lot of interior areas such as areas 51 and 53 having no interior heat and limited ventilation. These interior spaces 51 and 53 generally become wasted office space or storage areas.

Figure 3:
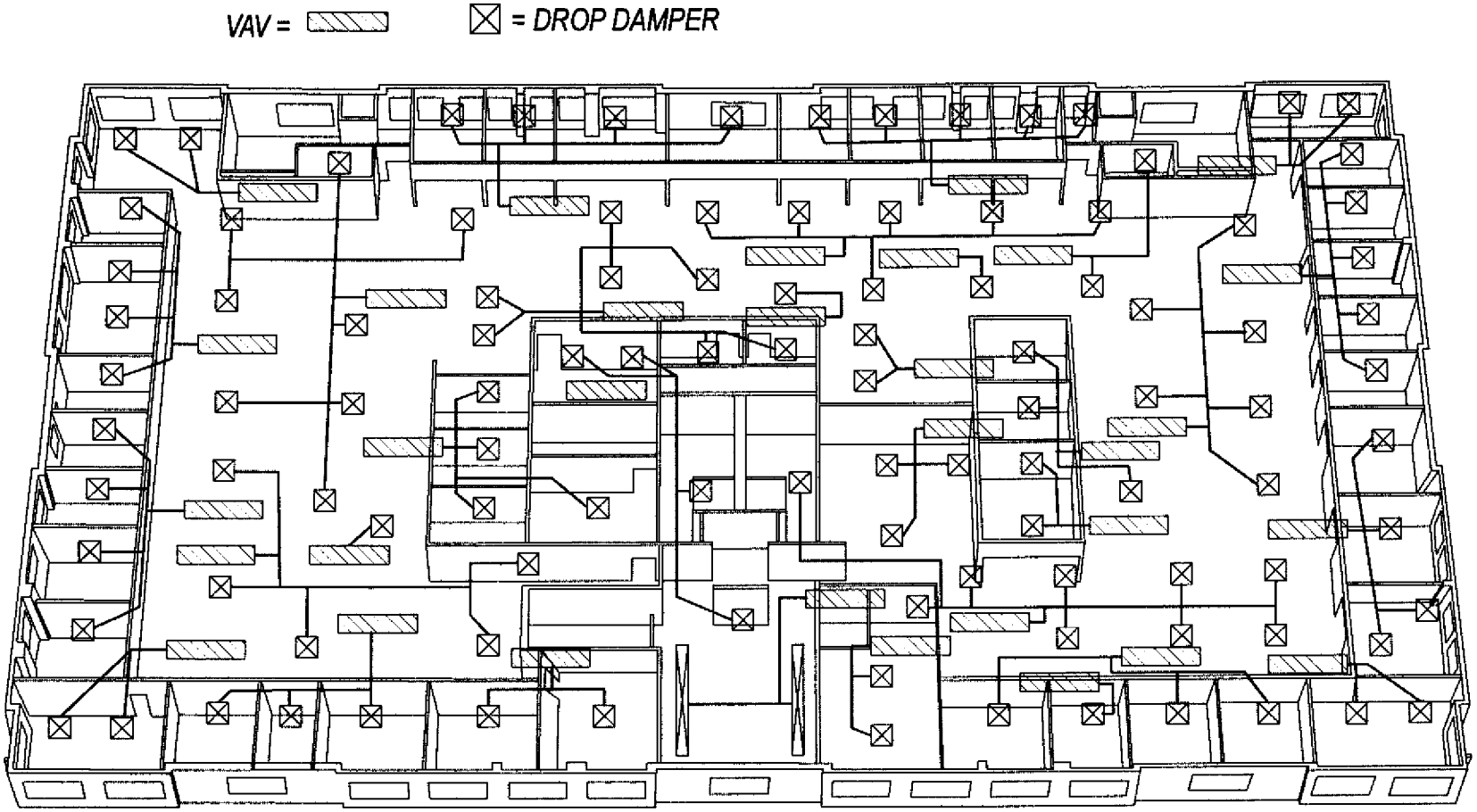
FIG. 3 PRIOR ART
FIG. 3 is a perspective prior art comparative heating plan illustrating the number and layout of prior art VAV boxes required to provide the advantages of the novel hybrid VAV and system of FIG. 6.
Figure 9:
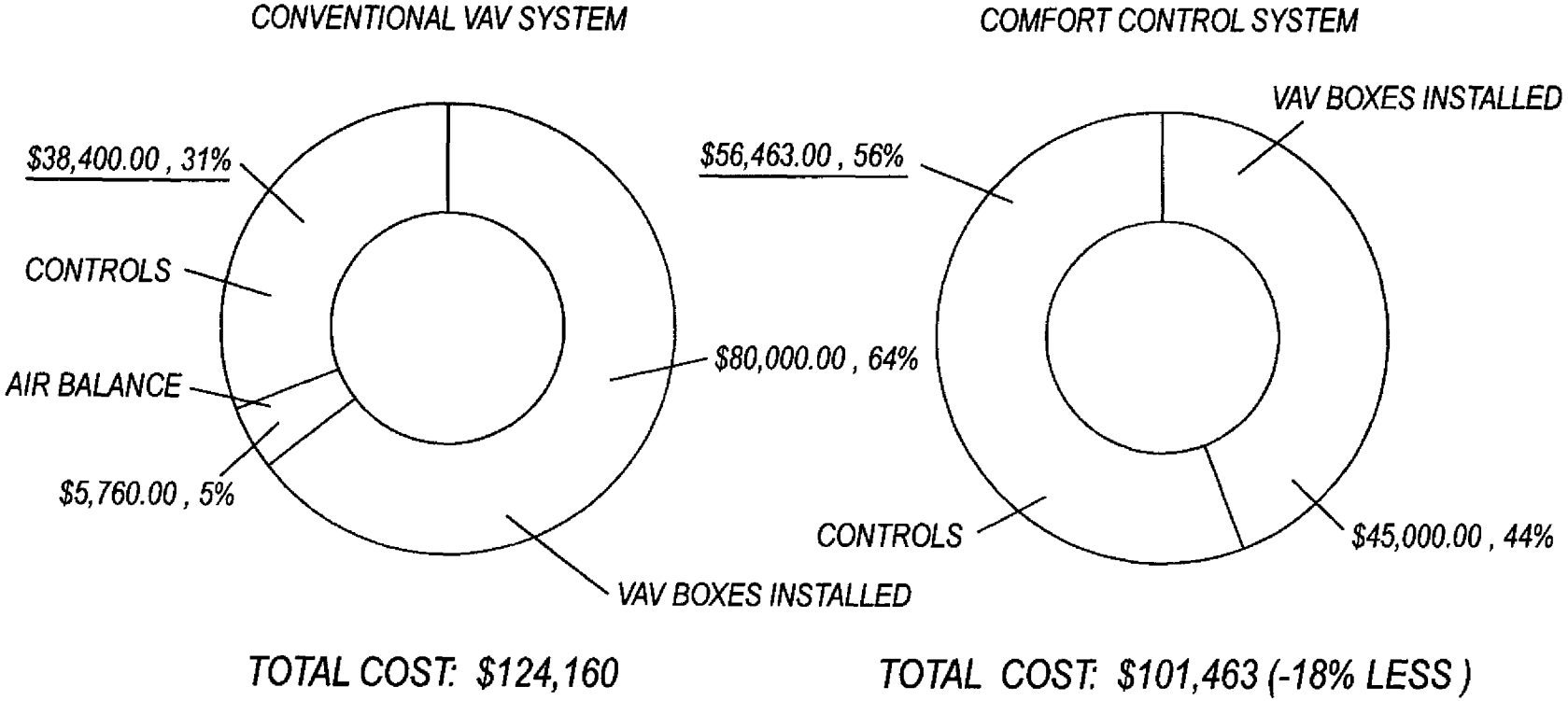
FIG. 9 is comparative graphs comparing a cost comparison between a typical VAV and the novel hybrid VAV.

Referring now to FIG. 6 and prior art FIG. 3 the problem of ventilation, comfort control and cost was solved by the novel hybrid VAV box 10 and ASCD 40. In FIG. 6 only 11 hybrid VAV boxes 10 coupled with 85 ASCD's 40 provide 85 controlled areas. Only 6 novel hybrid VAV's are required to heat all the exterior offices and only 5 novel hybrid VAV's are required to provide heat and ventilation to all the interior spaces. Comparison prior art FIG. 3 shows that to provide the same heating and ventilation 32 prior art VAV boxes are required with 17 prior art VAV boxes required to heat the exterior offices and 15 VAV boxes are required for the interior offices. The comparison between prior art FIG. 3 and FIG. 6 the novel hybrid VAV boxes reduce the number of boxes by $2/3^{rd}$ and results in more granular heating control with the elimination of the master slave system and an 18% lower cost than a conventional system. The advantages are further broken down in FIG. 9 and presented graphically in a project cost comparison. One of the items in the cost comparison in FIG. 9 is the cost of a manual labor cost for air balance by utilizing an air balance provided by the combination of the novel hybrid VAV 10 and the automated space control damper ASCD.

In certain embodiments and a preferred application, the hybrid variable air volume terminal system comprises an automated air balance system and demand response control system to control and/or vary the amount of air flow into the plurality of rooms in the building by the ASCD. In the prior art once the system is installed the air balance remains the same until a technician comes out and rebalances the system. As a result seasonal and even diurnal changes can make a static air balanced system feel uncomfortable particularly prior art master slave air balanced systems. The dynamic air balance system provided by the novel VAV 10 and ASCD 40.

Figure 8:
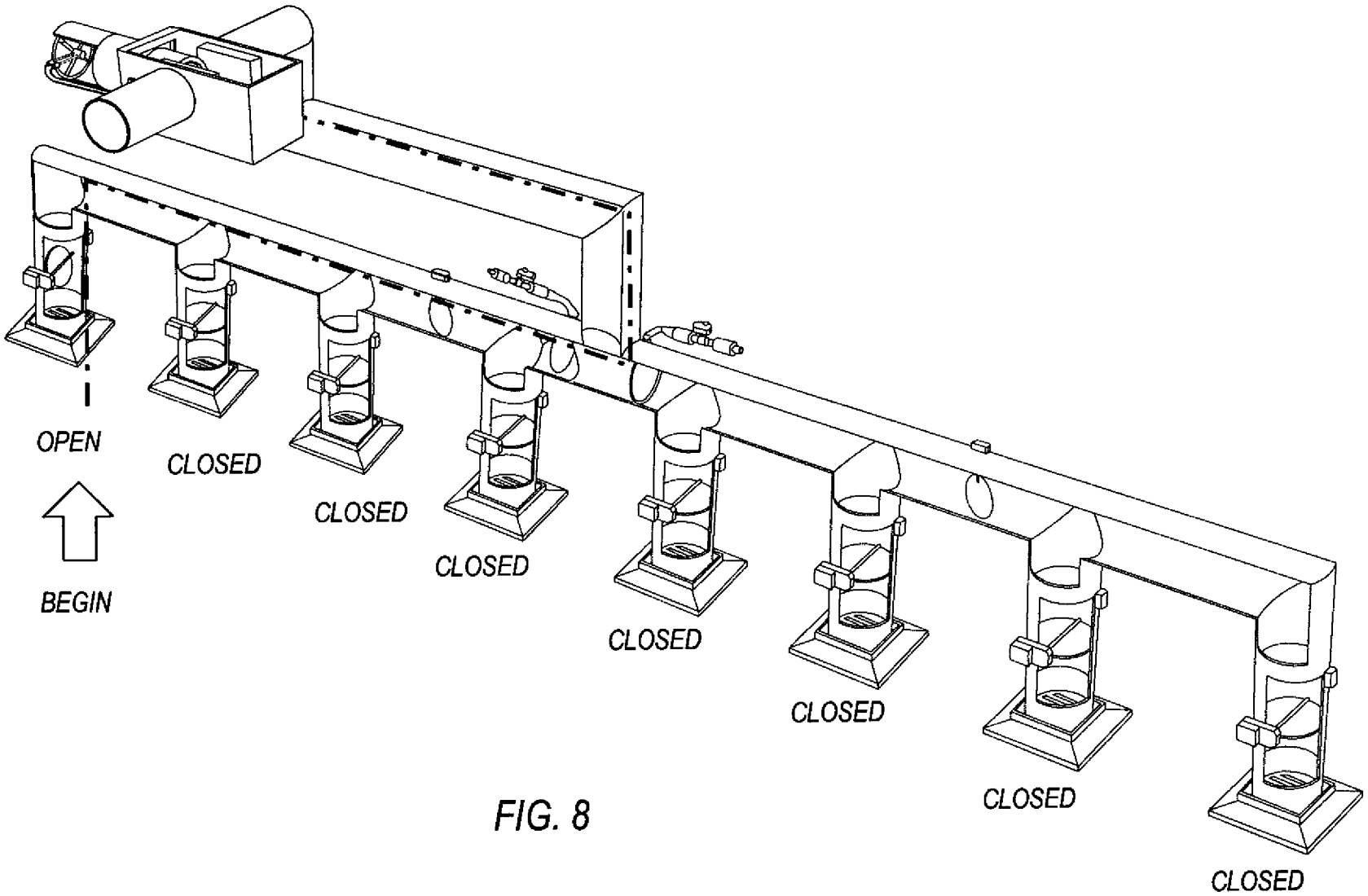
FIG. 8 is a schematic view of the hybrid VAV like FIG. 7 illustrating a further embodiment.
Figure 19:
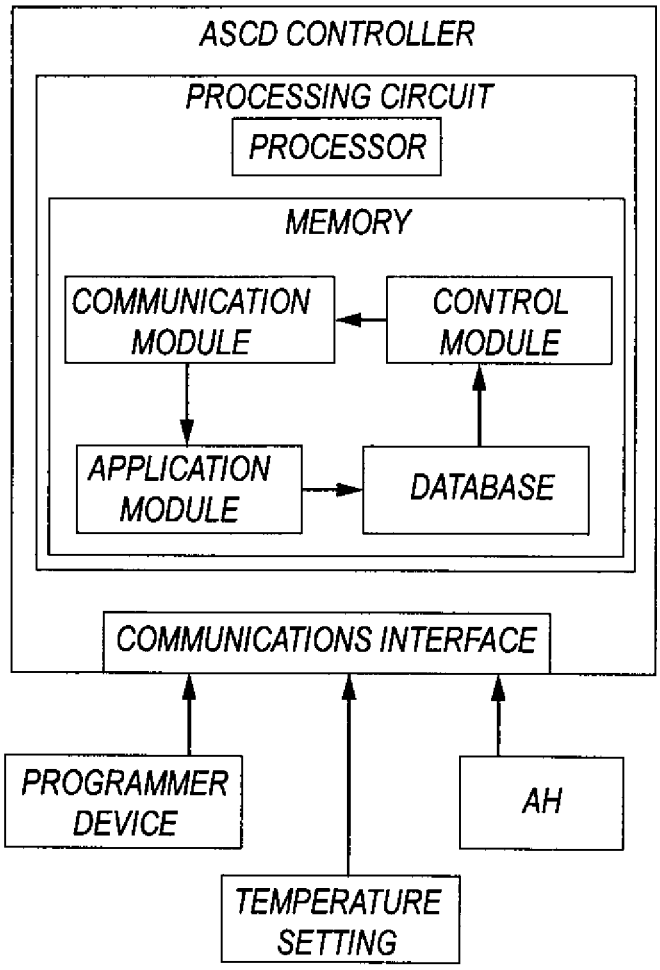
FIG. 19 is a block diagram for an ASCD controller.

Referring now to FIG. 8 the dynamic air balance provided by the novel hybrid VAV and ASCD is achieved by sequentially opening one of the ASCD dampers 40A and closing the others 40B to 40H and then using the novel hybrid VAV as a flow hood and preparing a sequence log of damper settings for minimum and maximum and also log flow versus damper position. The sensor 24 or 26 FIG. 4A is used to log flow for each ASCD 40A to 4011. Once damper 40A is complete damper 40A is closed and damper 40B is opened until all the ASCD 40 dampers are completed and logged the dampers are set in a balanced position or default position with respect to each other. The advantages of this embodiment is not only provided for periodic rebalancing when an ASCD controller 100 includes a database 102 (FIG. 19).

In the dynamic air balancing embodiment, the hybrid variable air volume terminal system comprises an automated air balance system due to its ability to isolate individual rooms. In certain embodiments, the automated air balance system comprises one or more of the following: (1) Minimum CFM drop damper position (based on measured airflow); (2) Maximum CFM drop damper position (based on measured airflow); (3) Maximum noise CFM drop damper position (based on setting or diffuser design); (4) Drop damper position/CFM calculation (created during balance); (5) hybrid VAV box static pressure setpoint calibration (created during balance); (6) Automated hybrid VAV two point CFM calibration to precision flow hood; and (7) Automated balance report.

Figure 10:
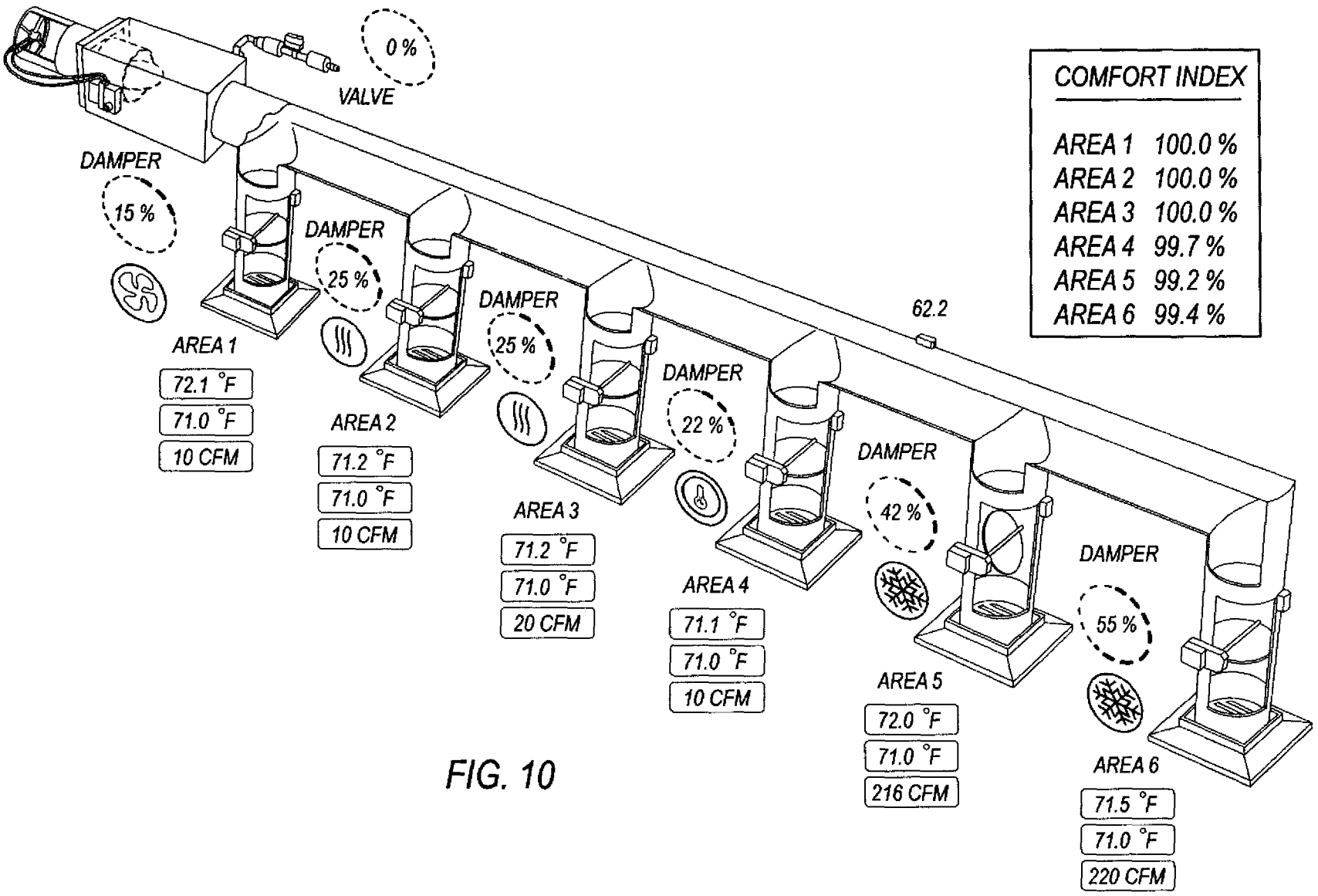
FIG. 10 is a perspective view illustrating a comfort index with temperature, ventilation and damper position in the ASCD with the novel hybrid VAV.

The novel hybrid and ASCD combination not only provides for a dynamic balancing but also provides a database as illustrated in FIG. 19-23 for periodic rebalancing as well as for comfort index for each area zone or room served by an ASCD damper 40A-40F as illustrated in FIG. 10. Each area 1-6 is provided with a desired temperature setting by changing airflow through each ASCD damper which are set from between 15% to 55% to provide a comfort index of 100% in areas 1-3 and around 99.7% in area 4 and 99.2% in/area 5 and 99.4% in area 6 with all areas being occupied.

Figure 6B:
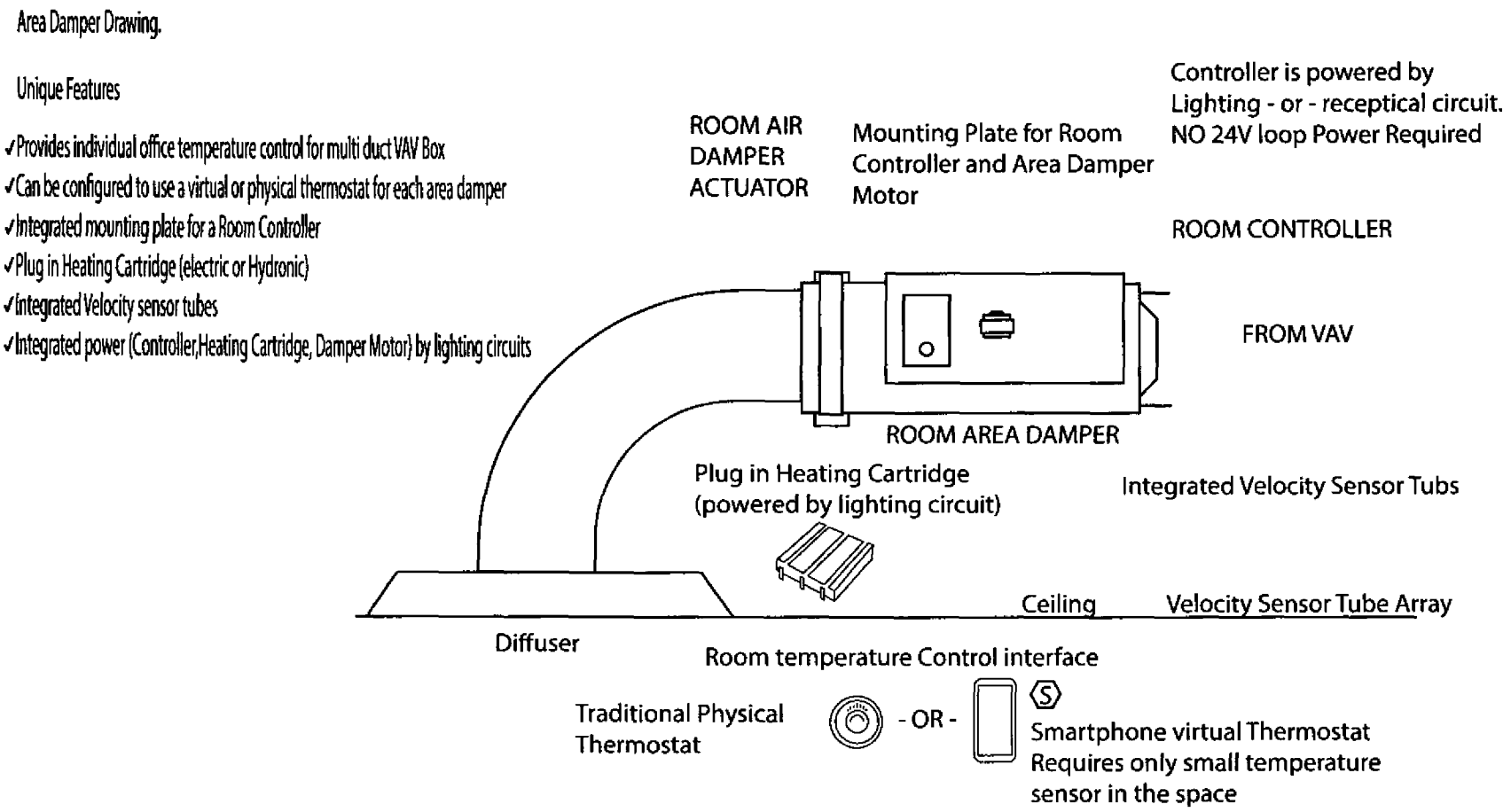
FIG. 6B is a diagrammatic view of a further embodiment illustrating an automated space control damper (ASCD) with an optional plug in heating cartridge.
Figure 7:
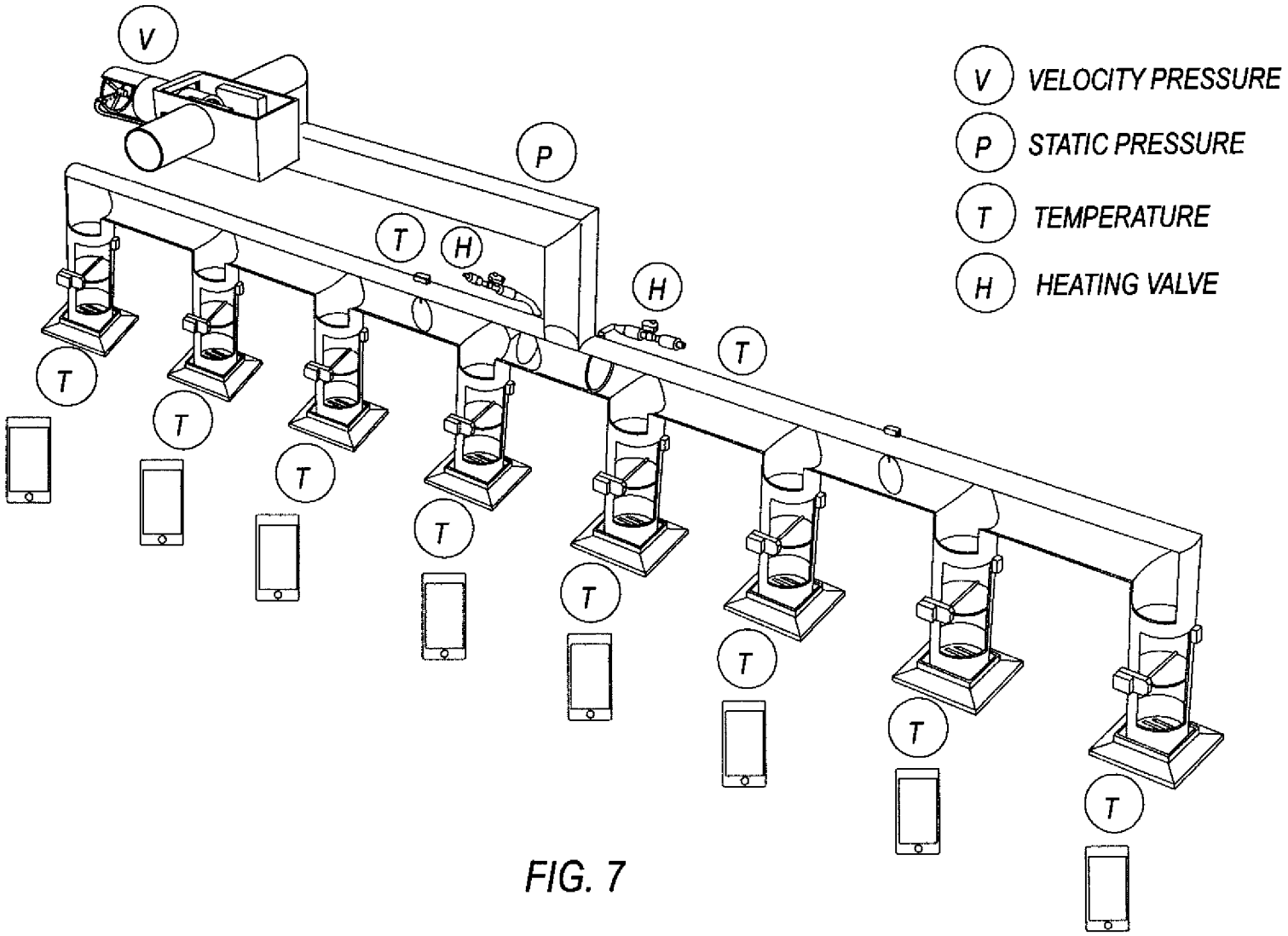
FIG. 7 is a schematic view of the novel hybrid VAV connected to a plurality of automated space control dampers ASCD in an illustrative embodiment.

Referring now to FIG. 7 each ASCD damper 40A to 40G can be set remotely by either a physical thermostat T in the area room or zone as well as by a communication device such as a smart tablet or cellphone connected to the IoT. In certain embodiments the comfort provided by the ASCD may be augmented by the addition of a separate portable plug in heater cartridge as illustrated in FIG. 6B.

Figure 11:
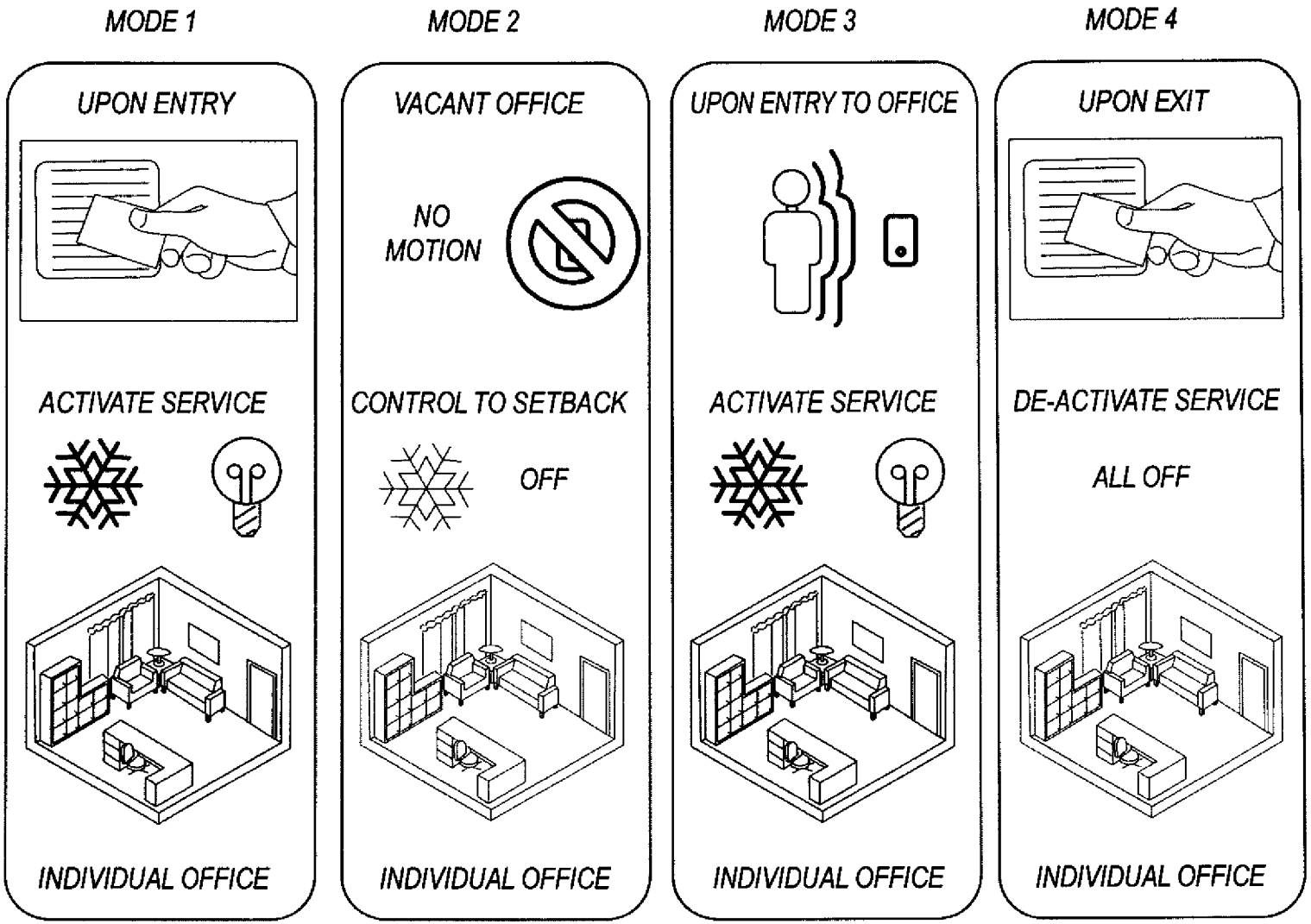
FIG. 11 is a diagrammatic view of various modes in a building management system employing embodiments.
Figure 12:
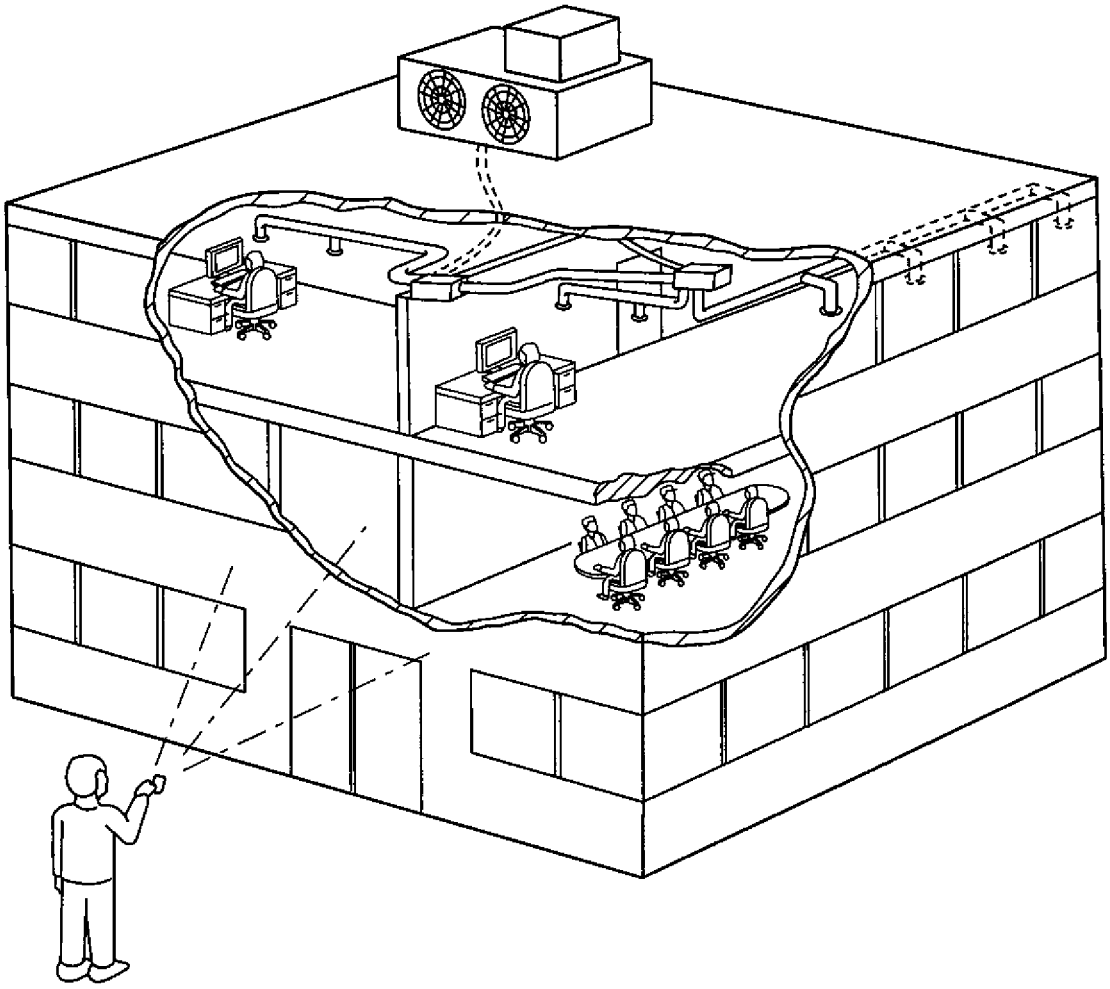
FIG. 12 is a perspective view of an office with the novel BMS embodiment.

The advantages of the embodiments are further enhanced with an energy saving building management system BMS as illustrated in FIGS. 11 and 12 and as described in FIGS. 31-40. In the energy saving embodiment occupancy sensors may be provided or connected to a light switch or an entry exit card system. As illustrated in FIG. 11 the energy saving embodiment may be achieved by maintaining offices at the most efficient temperature for a particular area for example 68 to 70° F. or 20 to 25° C. and then activating service for an individual office upon registering entry of a tenant as illustrated in FIG. 11. In addition motion sensors may be employed to cut back service if there is no motion or activate service when motion is detected. Similarly upon exiting the office everything can be turned OFF as illustrated in FIG. 11. The system can be activated remotely by a smart device remotely to prepare for meetings or work on weekends as illustrated in FIG. 12.

In a further energy saving embodiment, a demand response control system may be added to permit the following stages of the system: (1) First stage: Turn off all air in rooms that are not occupied and are being controlled using temperature setback; (2) Second stage: Raise room temperature setpoints in non-critical common areas (i.e. kitchens, break rooms, storage areas, etc.); and (3) Third stage: Raise room temperature setpoints in occupied offices.

In certain embodiments, the variable air volume terminal system comprises a virtual office thermostat configured to operate with or without the VAV box described in certain embodiments. The virtual office thermostat provides a web service that allows the office occupant of a building or building personnel using a smartphone, tablet, or desktop computer to view and control their own individual office space. Virtual thermostats are connected/interfaced into the building BMS system via a web or thick client application.

In certain embodiments, the office occupant, building personnel or other user can access and/or control any one of the following using the virtual office thermostat: (1) Room temperature setpoint (includes single and dual set points); (2) Lighting level setpoint; (3) Arrival and departure times; (4) Request after-hour services (includes HVAC and/or lighting); (5) Adjust temperature setpoint limits (Building Staff Only); (6) Adjust setup (Building Staff Only) includes minimum airflow setting, maximum airflow setting, K factor setting, box/damper size settings); (7) Invoke air balance mode (Building Staff Only), which temporarily disables thermostat limits; (8) Displays and notifies the tenant through this web service when a utility company invokes demand response. The system raises its personal setpoint to reduce energy consumption; and (9) 100% onboard, which requires only the user's first and last name, plus email address and/or cell phone number.

In certain embodiments, energy savings are realized through the use of the hybrid variable air volume terminal system with the following characteristics: (1) Individual office solar temperature reset; (2) Individual office de-occupy temperature setback; (3) Individual office afterhours control; (4) Multiple demand response levels when for example a utility company announces a power reduction; (5) Prevents overcooling and overheating of all areas; (6) By backing down each area, it dramatically reduces fan and heating/cooling energy; and (7) Due to all interior zones' ability to heat, faster warmup times are achievable.

In certain embodiments, the hybrid variable air volume terminal system provides an enhanced occupant experience with the following characteristics: (1) Each room and common area has individual temperature control through a virtual thermostat; (2) Easy intuitive software application for preference adjustments (virtual thermostat & lighting control); and (3) Remote individual controllability (can be set before arriving). In certain embodiments, the variable air volume terminal system provides an enhanced building personnel experience with the following characteristics: (1) Granular control provides for superior remote trouble shooting capability; (2) 3D control graphics are intuitive and easy to use; and (3) Comfort Control software application provides complete control and setup functionality.

In certain embodiments, the variable air volume terminal system provides enhanced system functionality with the following characteristics: (1) Intelligent Controlled Cool Down/Warmup is based on past room occupancy as illustrated in FIGS. 11 and 12; (2) Priority Based Floor Recovery Mode (Cool important areas first); (3) Enhanced Demand Response Control (shut off setback areas); and (4) Integrateable to Access Expert (control office enabled based upon entry and exit).

It shall be appreciated that the variable air volume terminal system allows one novel hybrid VAV zoning box to perform the work of multiple prior art VAV boxes. This combined with automated air balance, downstream controlled room dampers, virtual thermostats and enhanced sequences reduces the overall cost and increases the overall effectiveness of the temperature control.

The variable air volume terminal system comprises the following advantages: (1) Reduces the cost of air distribution systems while providing better control for commercial buildings; (2) System provides tenants with an intuitive interface (looks like a thermostat) to interact with the building's mechanical system; (3) System provides building personnel with a convenient tool to setup and control the building; and (4) Superior energy savings can be achieved due to the system's design.

It shall be appreciated that the variable air volume terminal system's use of a dual or multiple duct heating coil design with downstream room control dampers allows for twice the area coverage and superior control. In a 30,000 square foot commercial building that requires the installation of approximately 33 VAV boxes, the volume terminal system can be installed in the same building using approximately 11 VAV boxes. As such, cost advantages can be realized through the use of the variable air volume terminal system.

Figure 13:
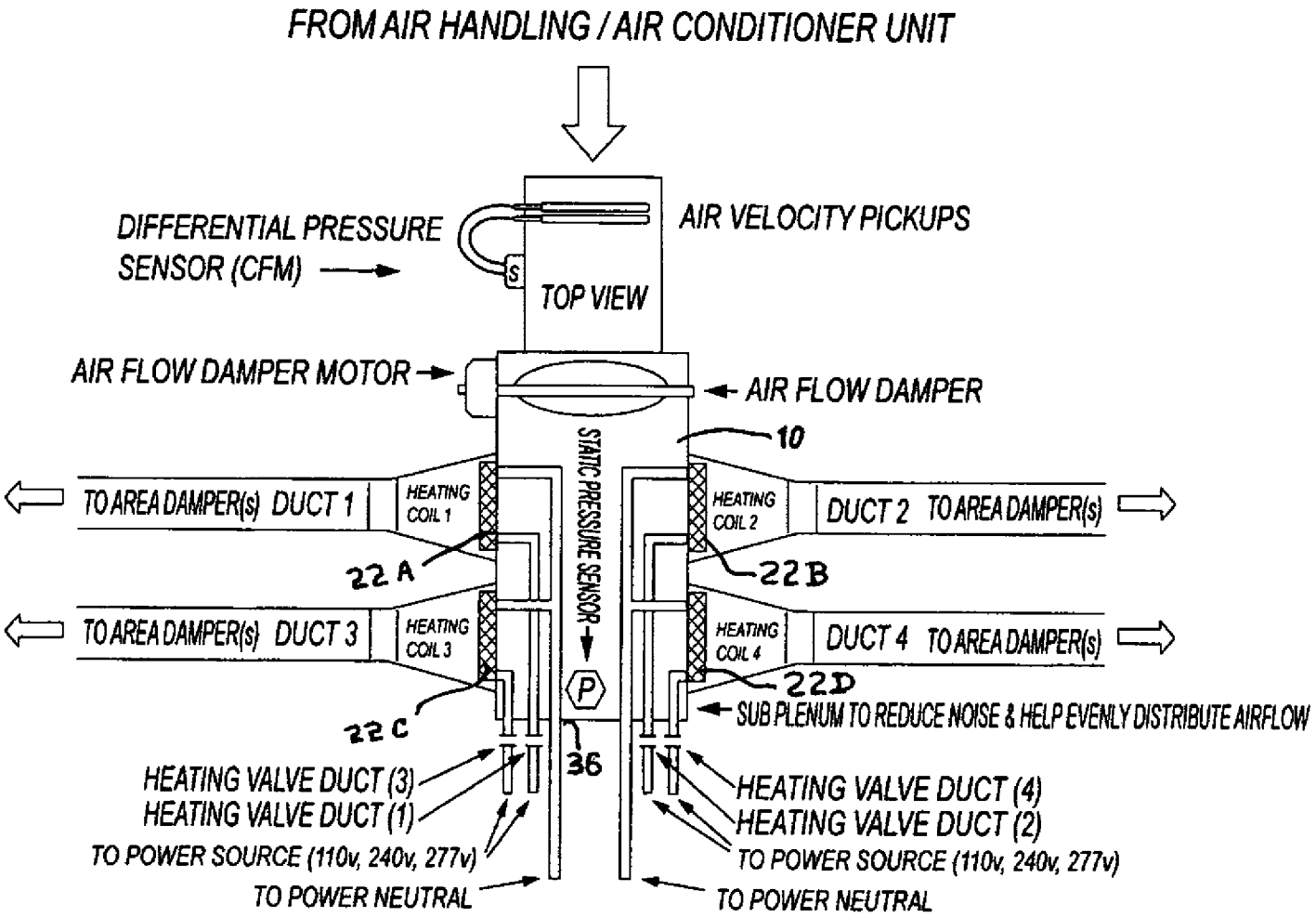
FIG. 13 is a diagrammatic view of an embodiment of the novel hybrid VAV.
Figure 14:
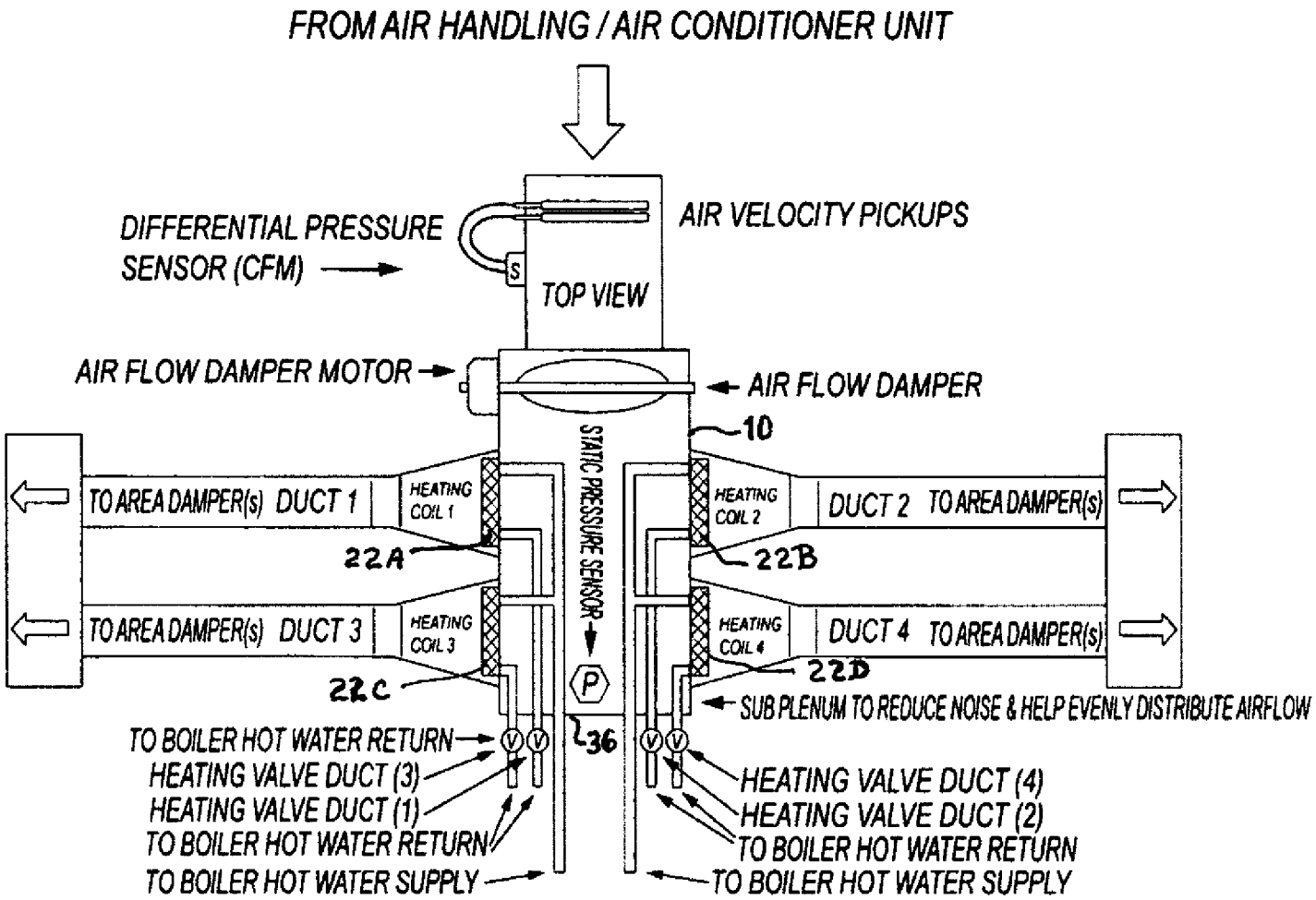
FIG. 14 is a diagrammatic view of a further embodiment of the novel hybrid VAV.

Referring now to FIGS. 13 and 14 the novel hybrid VAV 10 system is illustrated schematically with four ducts as illustrated in FIG. 4C. Each duct has a heating coil 22A, 22B, 22C and 22D. In this embodiment the heating coil is mounted in the outlet of the VAV box as a component of the VAV box to provide the heated outlet for the hybrid VAV box. The primary difference between FIGS. 13 and 14 is the embodiment illustrated in FIG. 13 has electrically heated heating coils 22A-22D while the embodiment in FIG. 14 has hot water heated heating coils 22A-22D.

Figure 15:
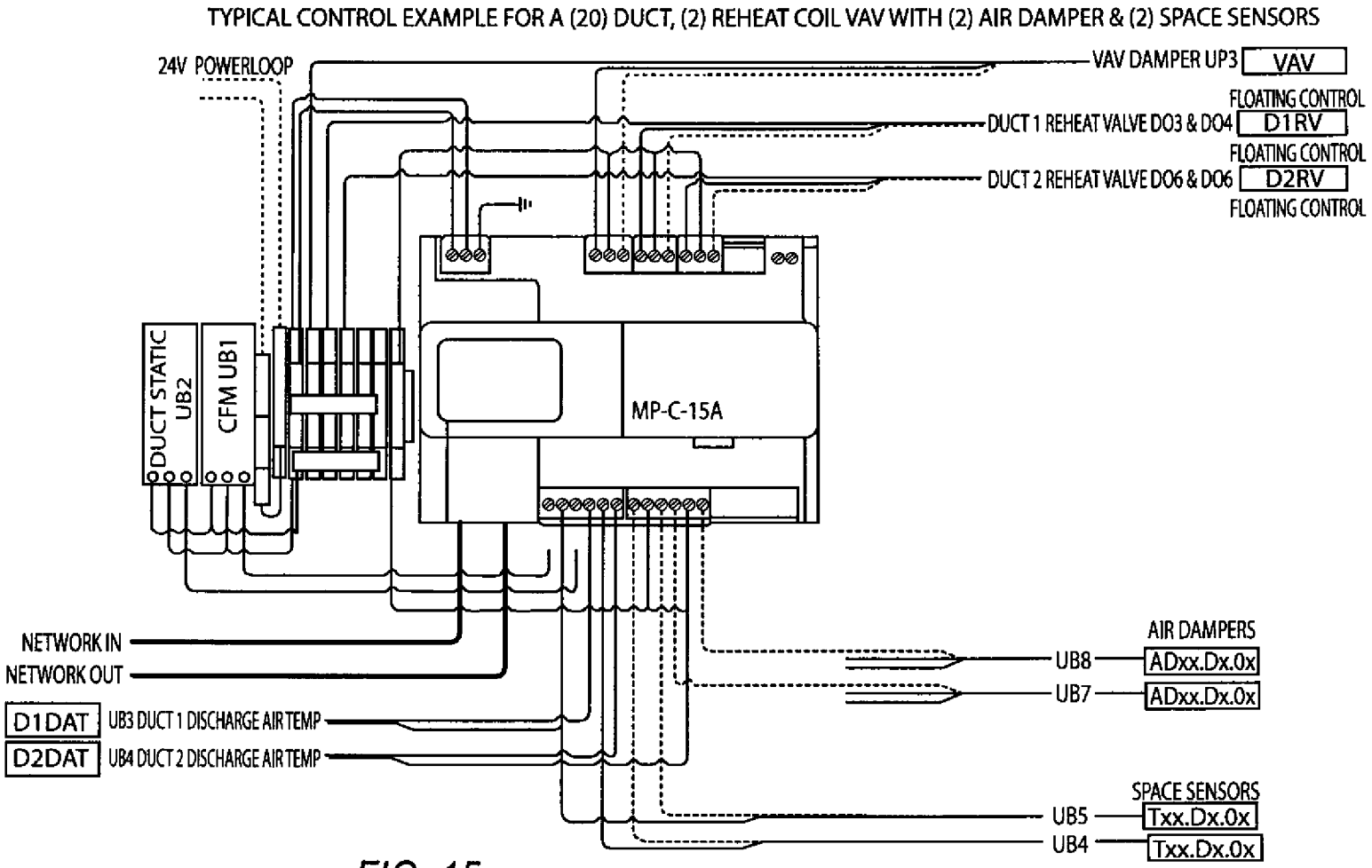
FIG. 15 is a schematic control layout for a 20 duct 2 hybrid VAV reheat coil.
Figure 16:
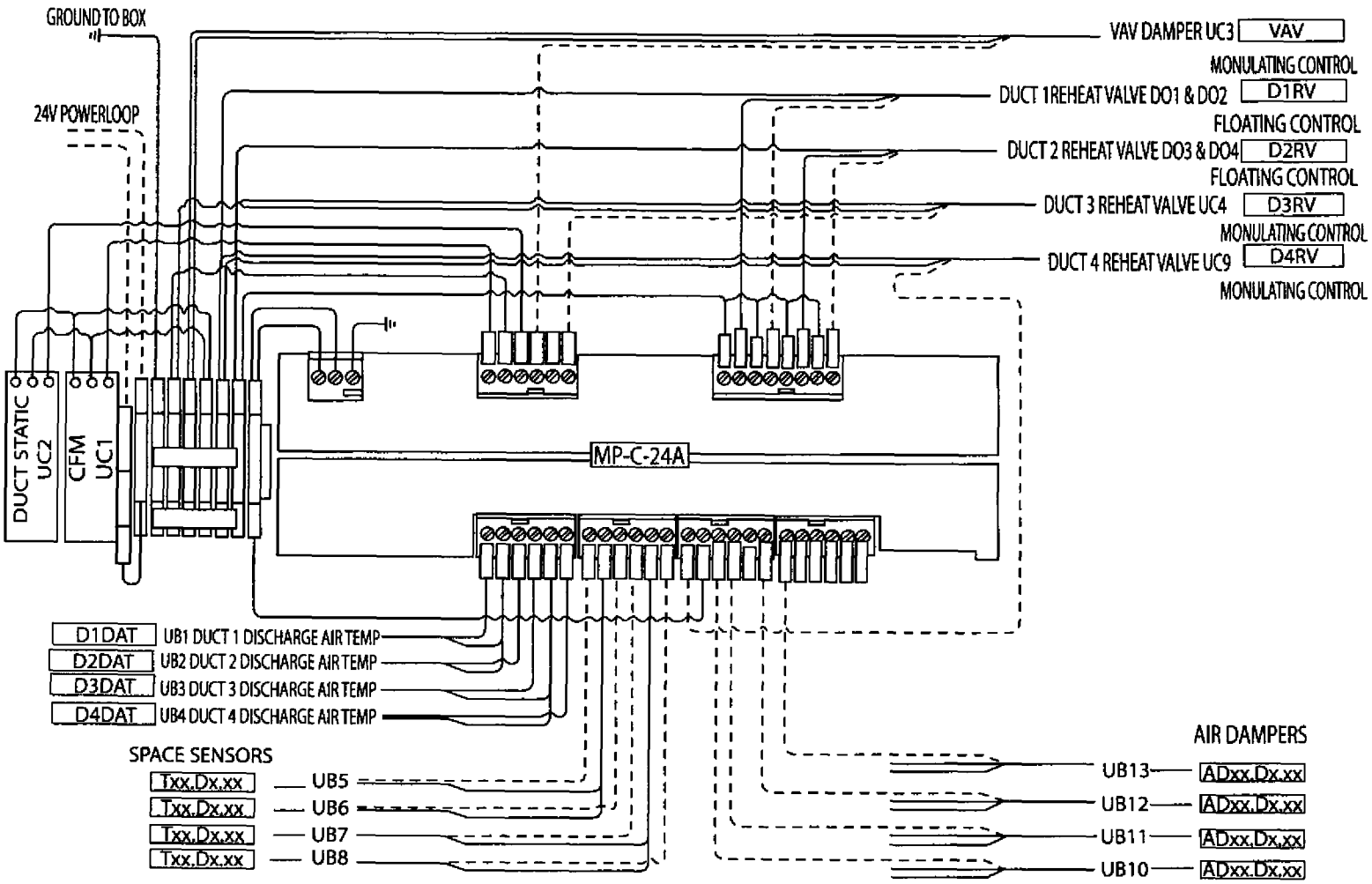
FIG. 16 is a schematic wiring diagram for FIG. 15.
Figure 17:
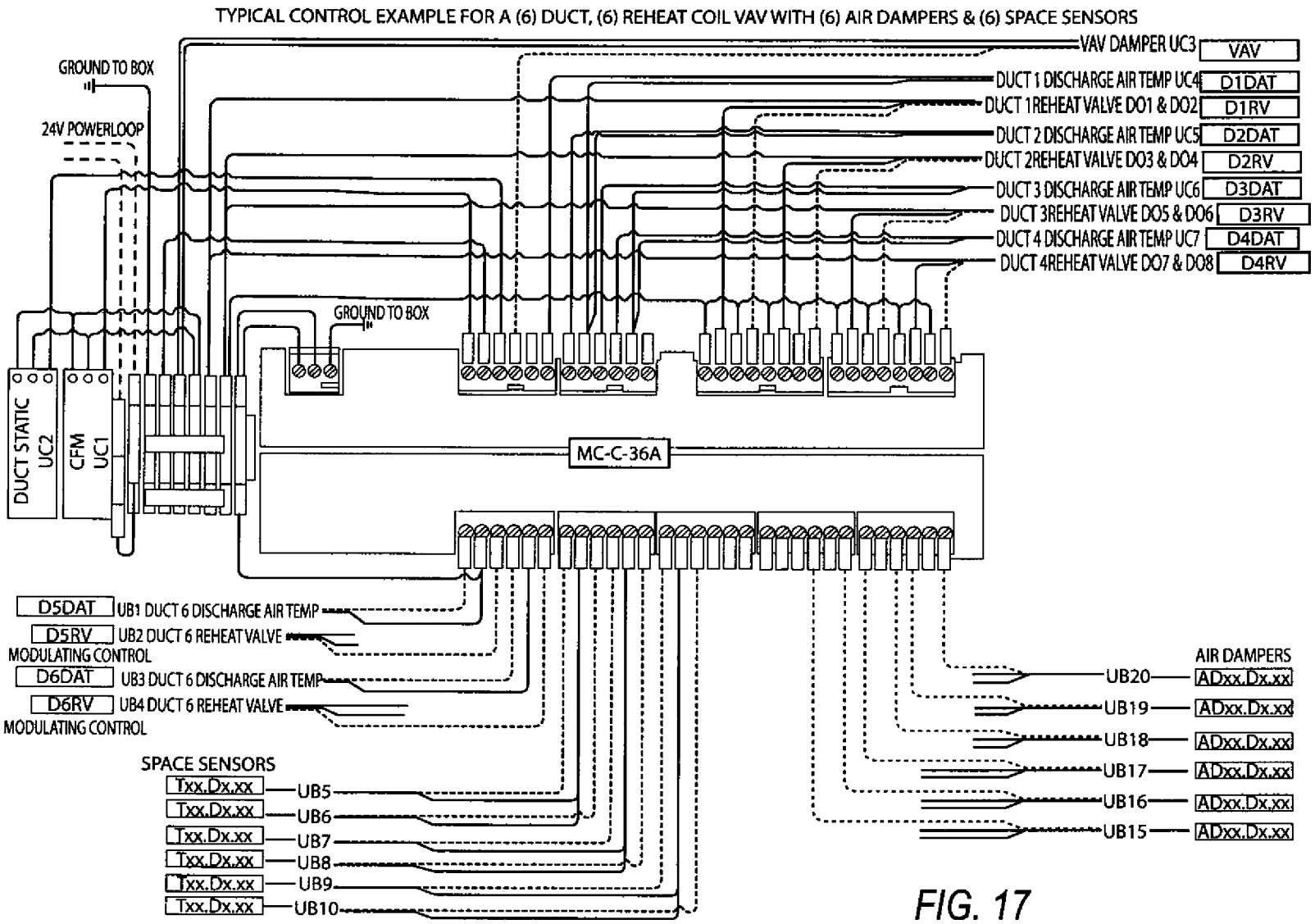
FIG. 17 is a circuit diagram for the control of a six outlet duct six reheat coil novel hybrid VAV.

A control circuit is illustrated in FIG. 15 to control a hybrid VAV with two reheating coils with two air dampers and two space sensors. FIG. 16 like FIG. 15 illustrates a hybrid VAV having a 4 duct four reheat valve water heated coil. FIG. 17 illustrates a wire diagram for a hybrid VAV with 6 ducts and six heating coils.

Figure 18:
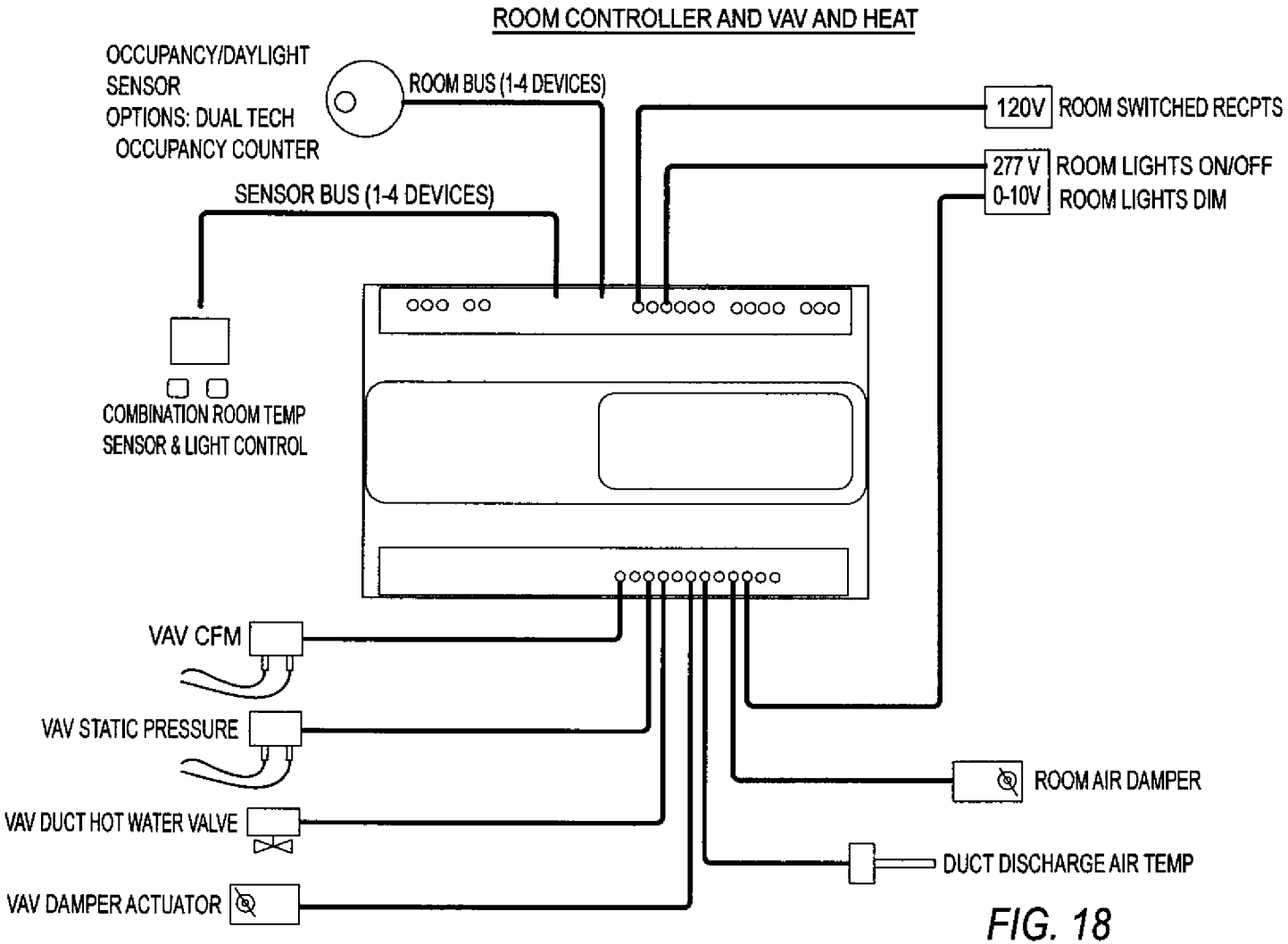
FIG. 18 is a control diagram for a ASCD controller and novel hybrid VAV.

Referring now to FIG. 18 a schematic room controller for the hybrid VAV is illustrated having an occupancy or daylight sensor which connect to a combination room temperature sensor and light control.

Figure 20:
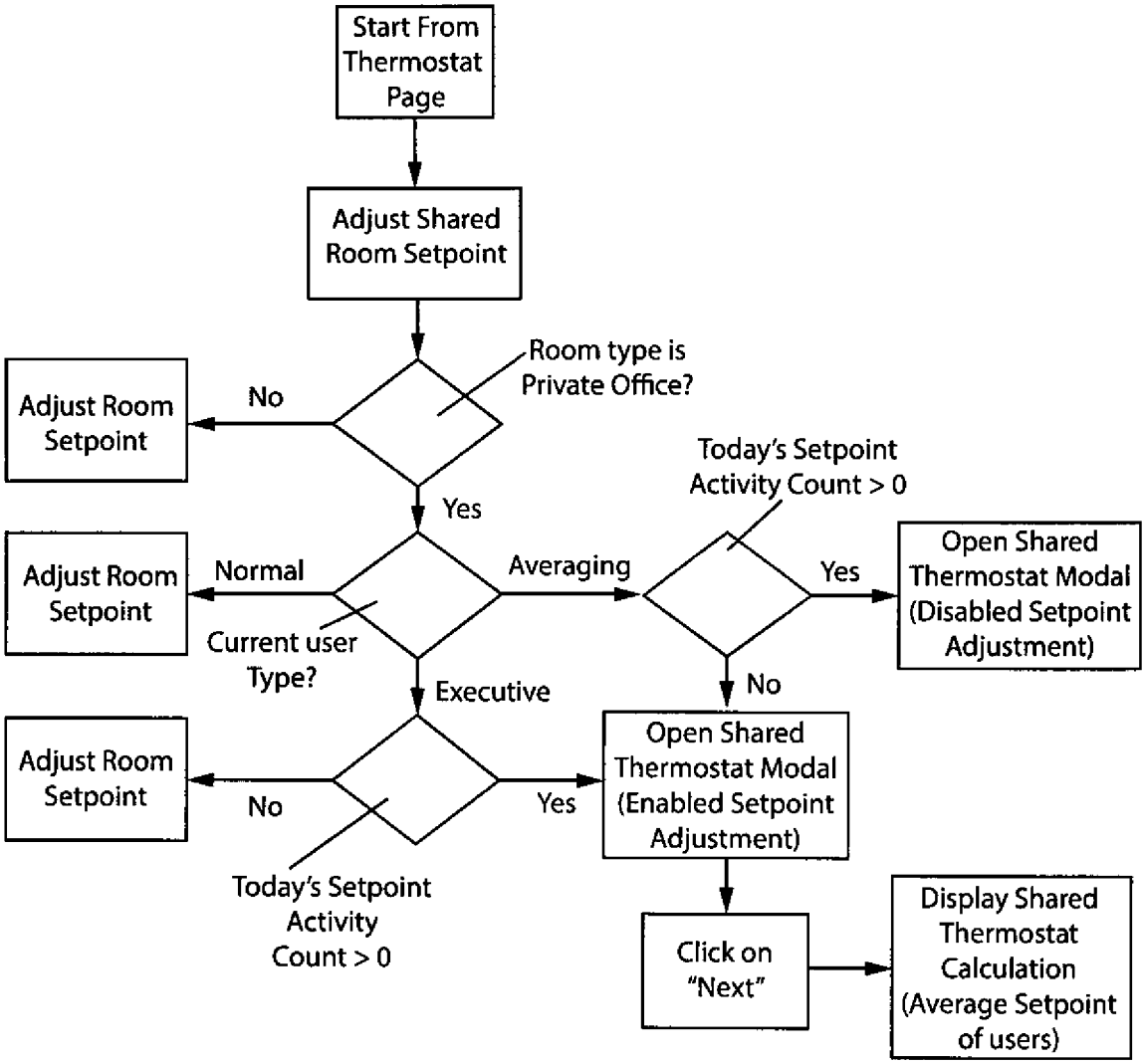
FIG. 20 is a logic flow chart for an embodiment for the ASCD and novel hybrid VAV.
Figure 21:
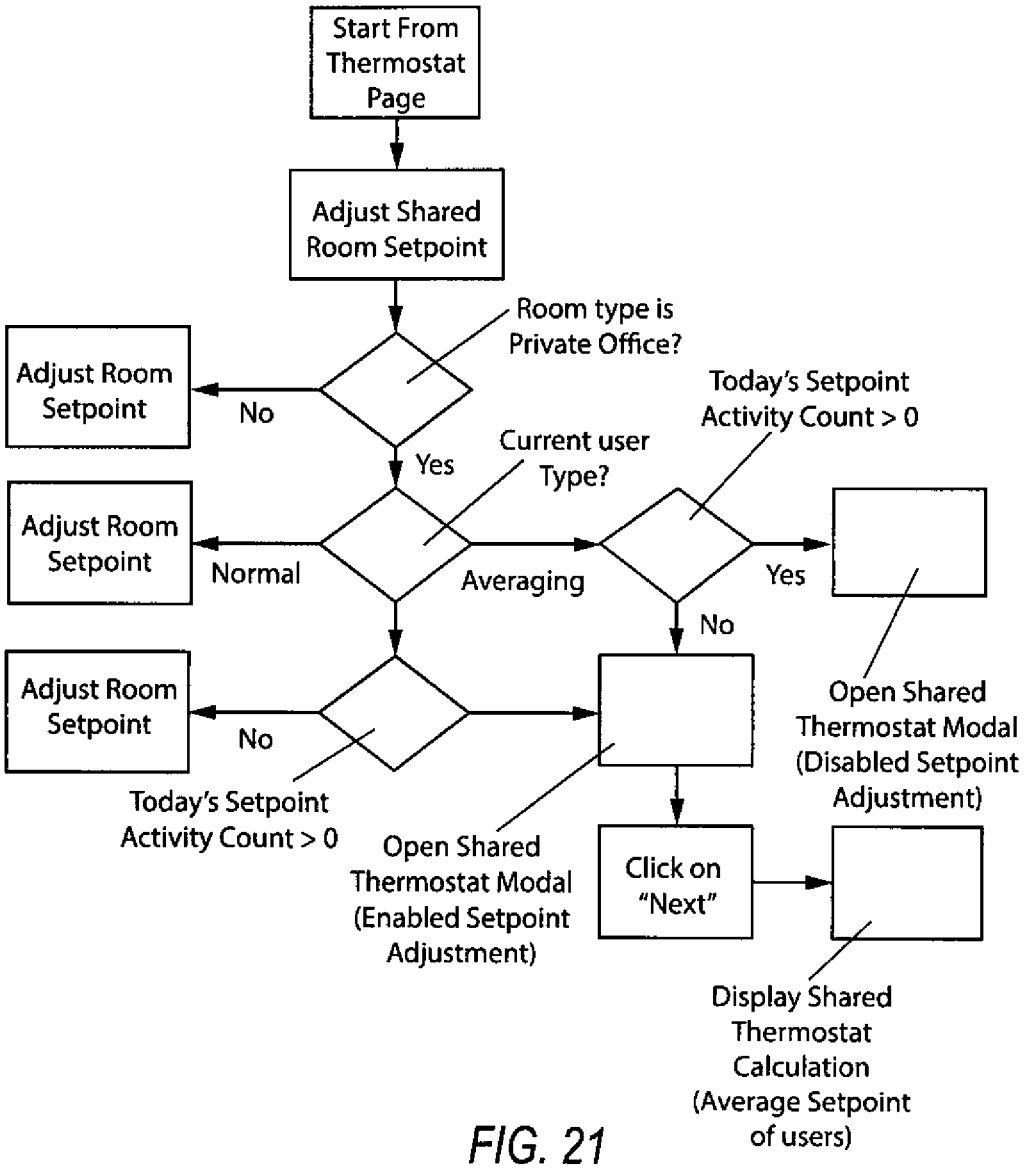
FIG. 21 is a logic flow chart for shared thermostats.
Figure 22:
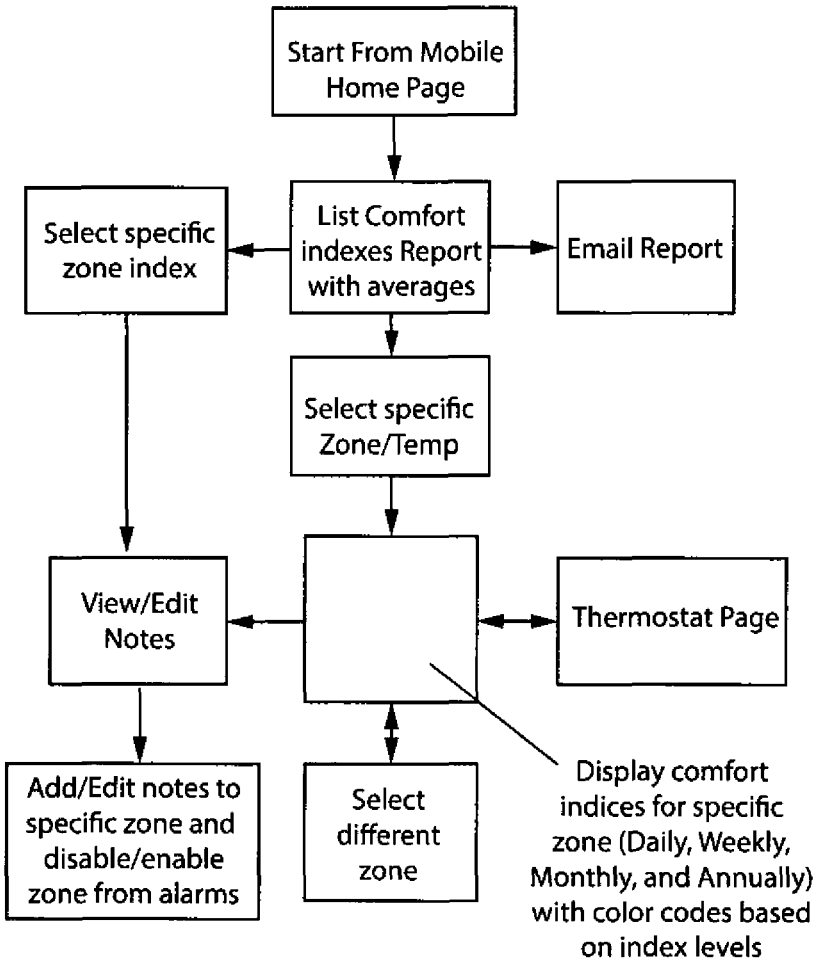
FIG. 22 is a logic flow chart for a comfort index.

FIG. 20 is a flow chart of a process for controlling the individual thermostat in each of the rooms or zones of a building employing the novel hybrid VAV. FIG. 21 is a flow chart of a process for utilizing a shared thermostat which can be accessed through the internet or through an app. FIG. 22 is a flow chart of a process for providing for comfort control which can be displayed on a smart phone.

Figure 23:
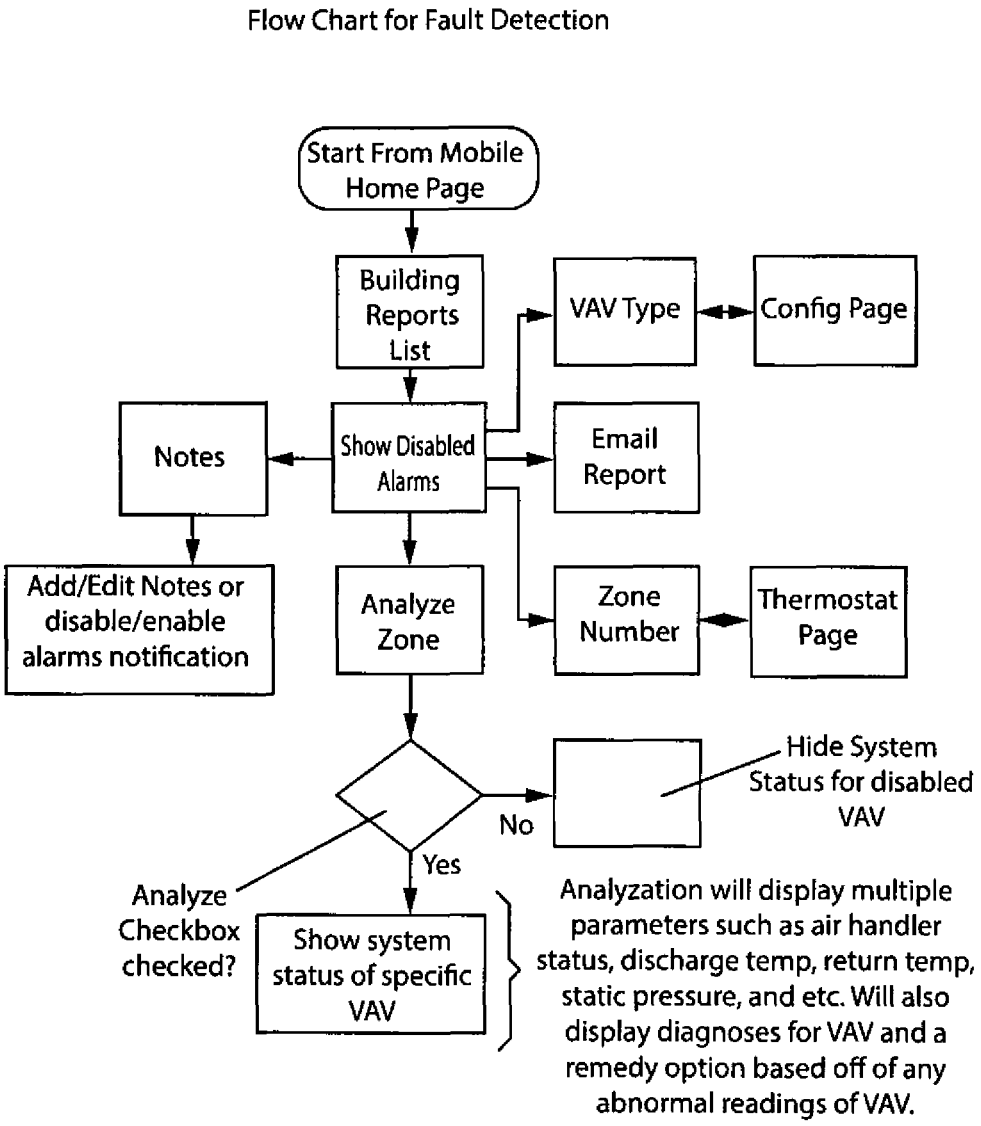
FIG. 23 is a logic flow chart for fault detection.
Figure 24:
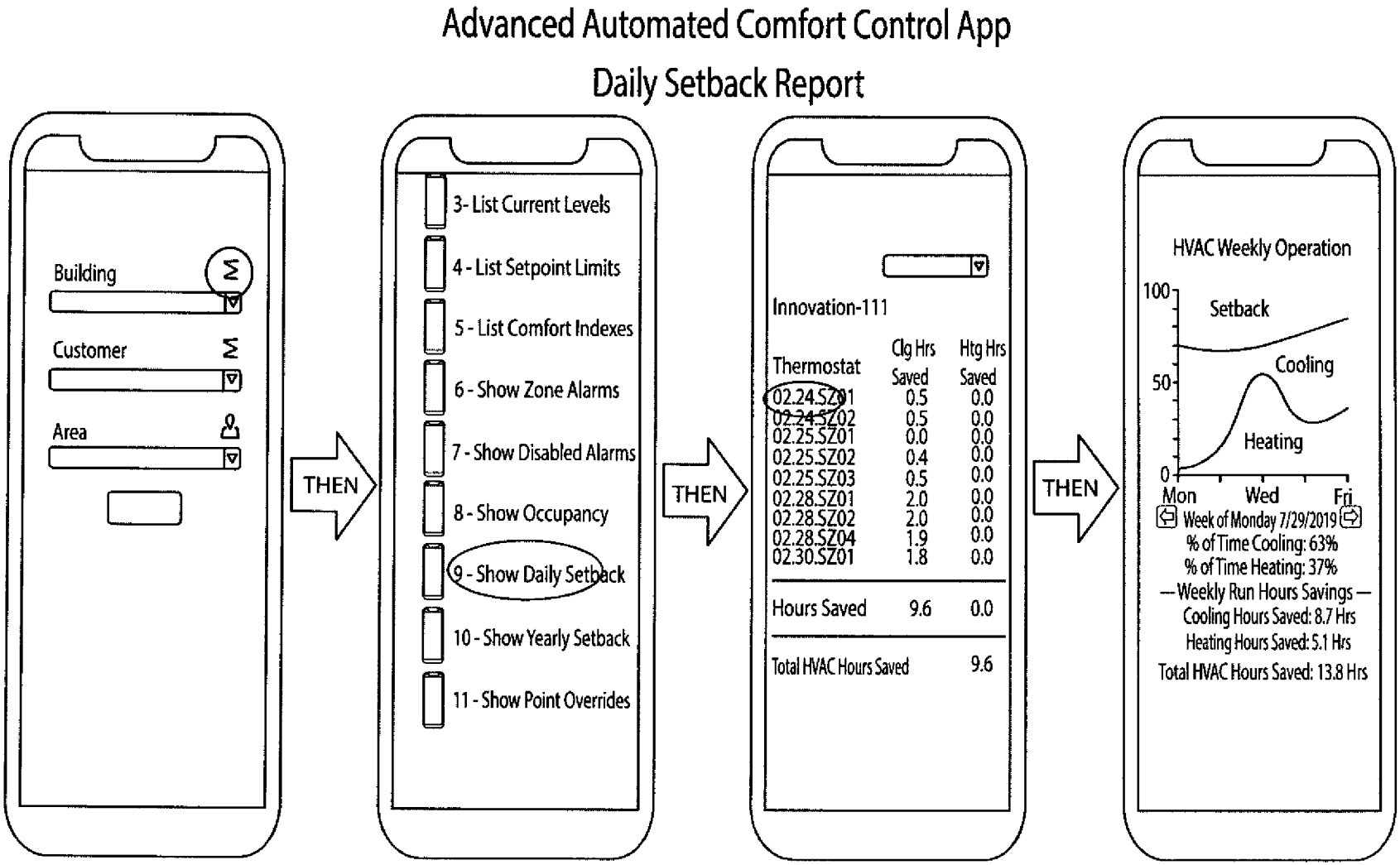
FIG. 24 are smart phone graphic user interface (GUI) app displays of set back reports in accordance with a BMS application.
Figure 25:
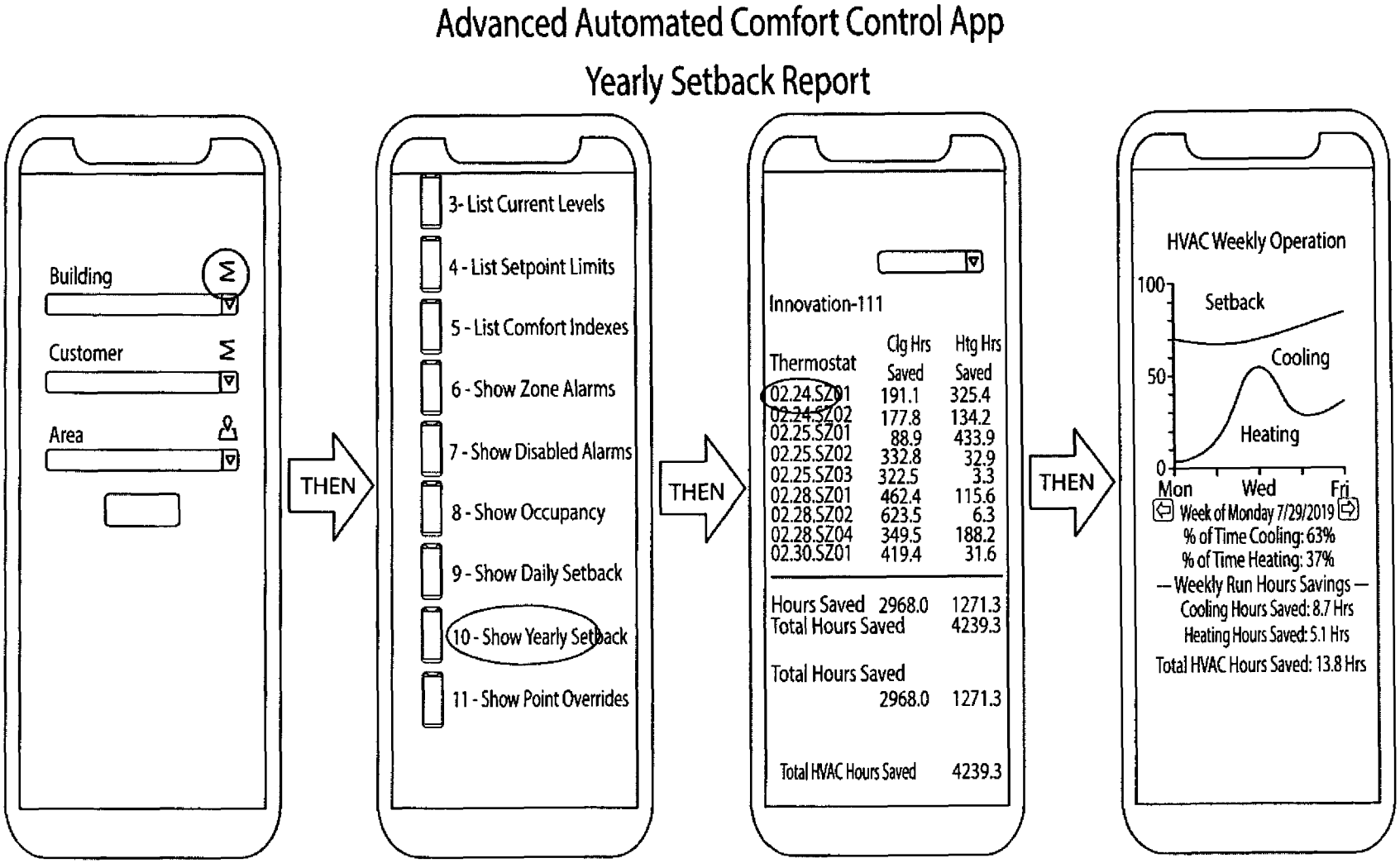
FIG. 25 is a smart phone GUI app display of a yearly setback report.
Figure 26:
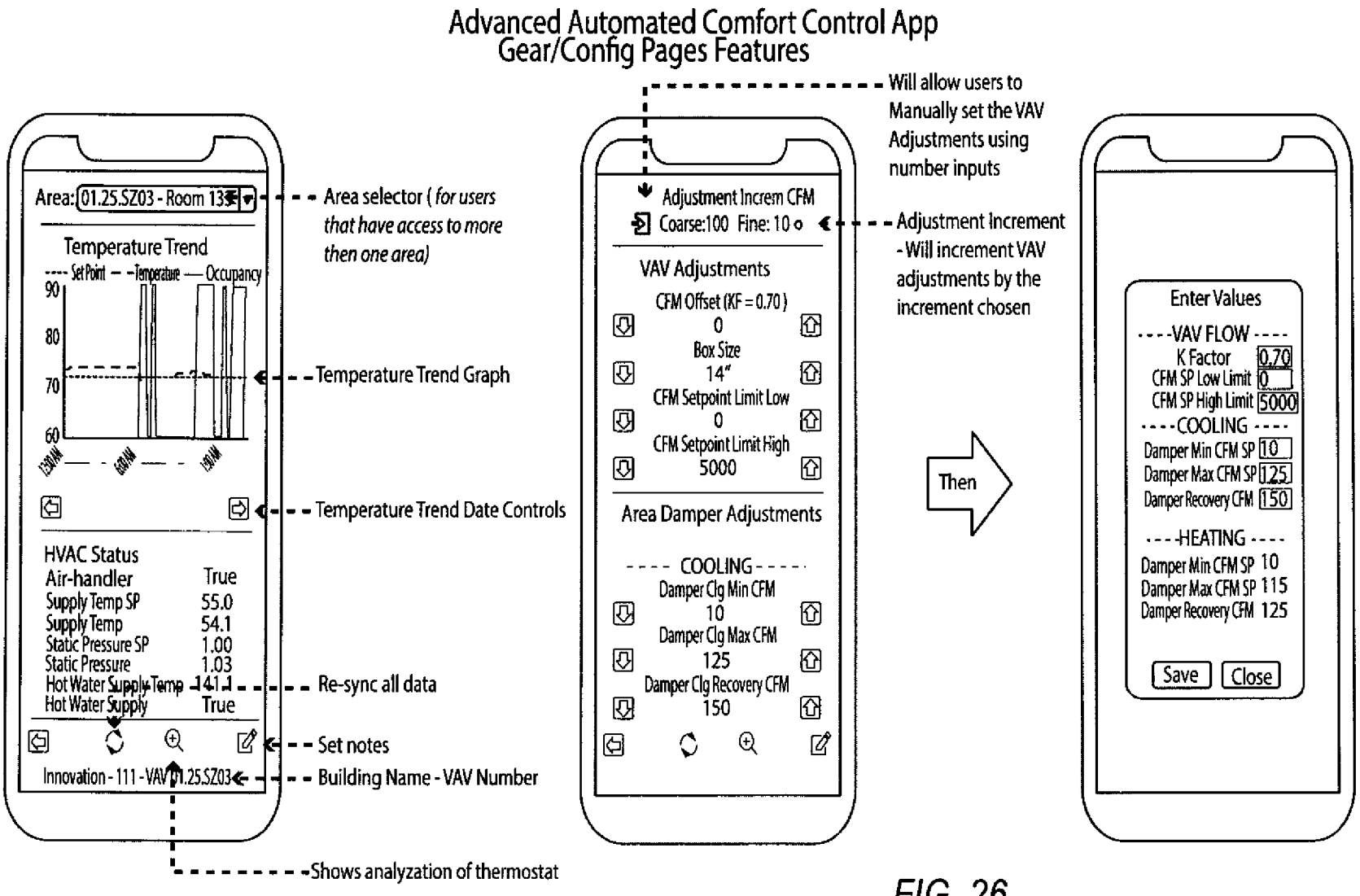
FIG. 26 are smart phone GUI app displays of a comfort control app in accordance with a BMS application.
Figure 28:
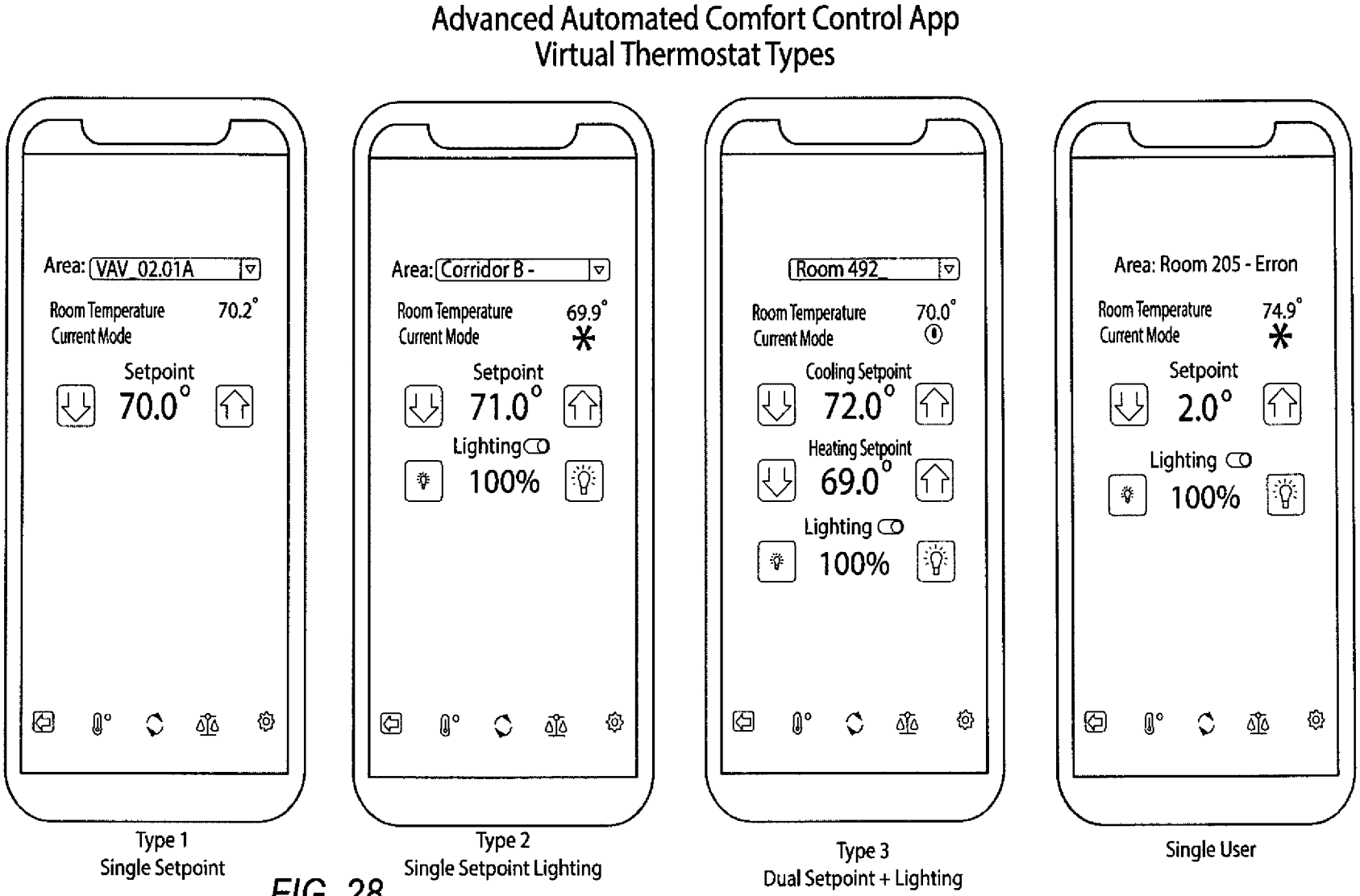
FIG. 28 are smart phone GUI app displays providing types of virtual thermostats.
Figure 31:
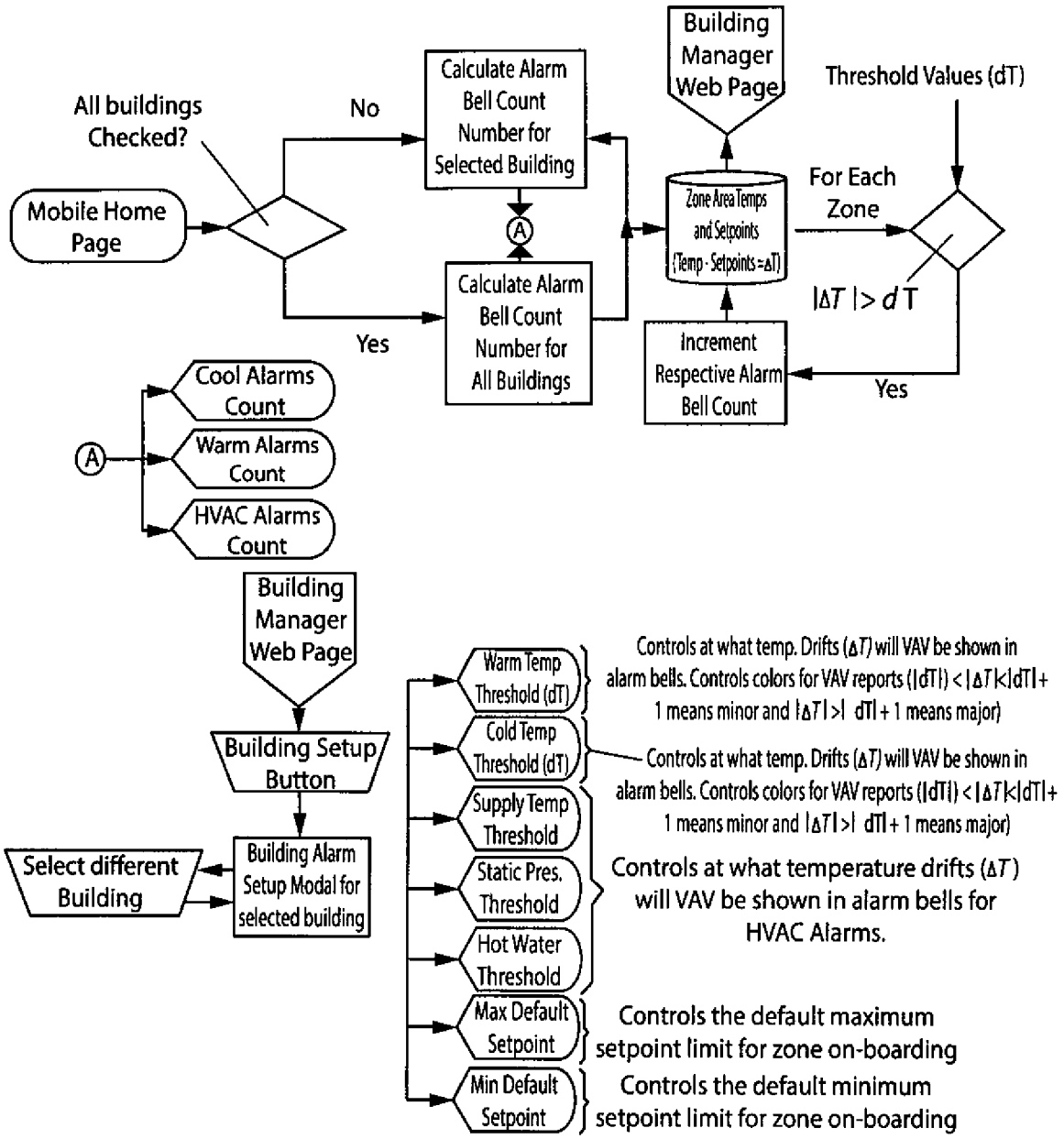
FIGS. 31-40 are building management systems logic diagrams and flow charts.
Figure 32:
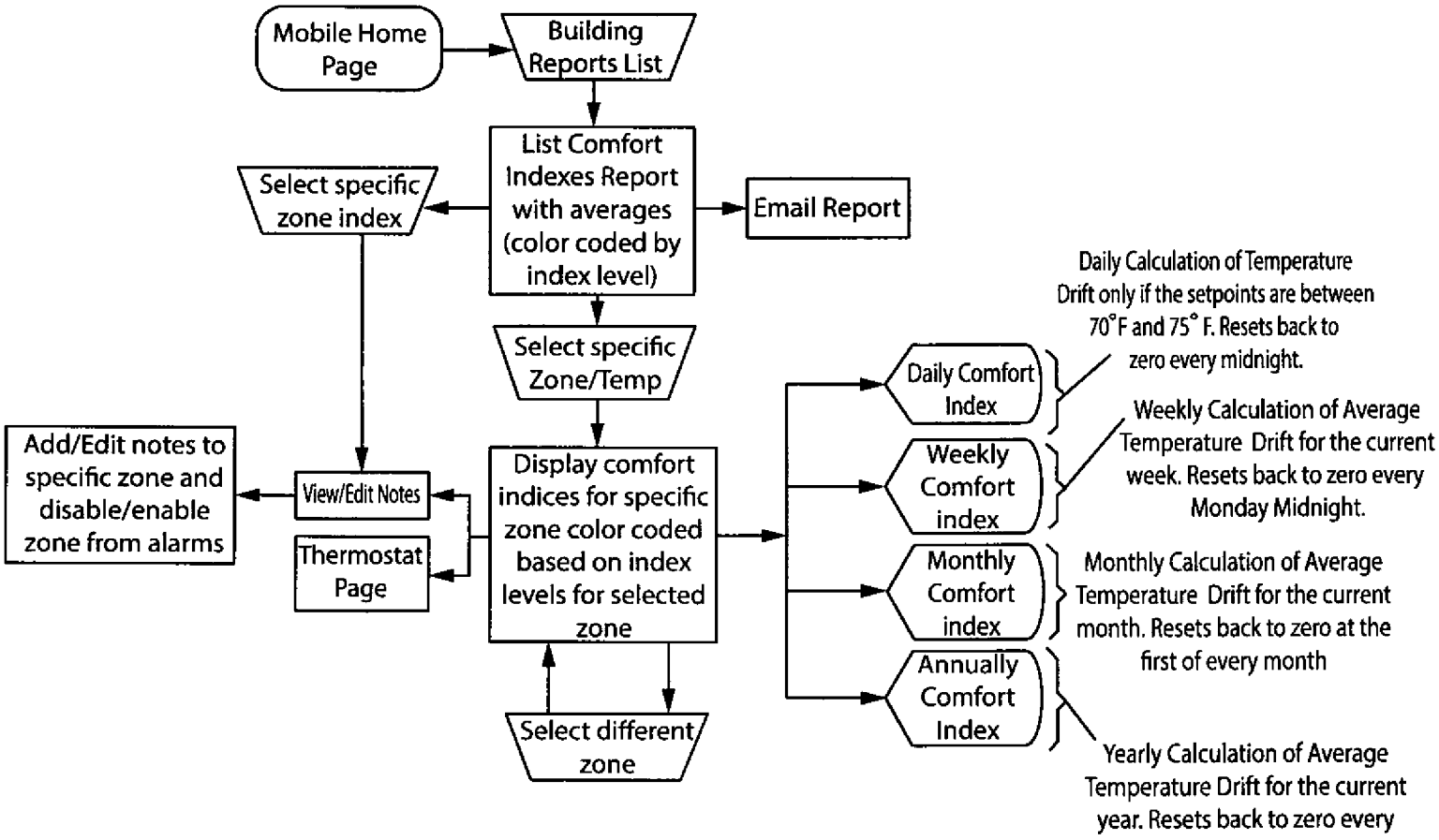
Figure 33:
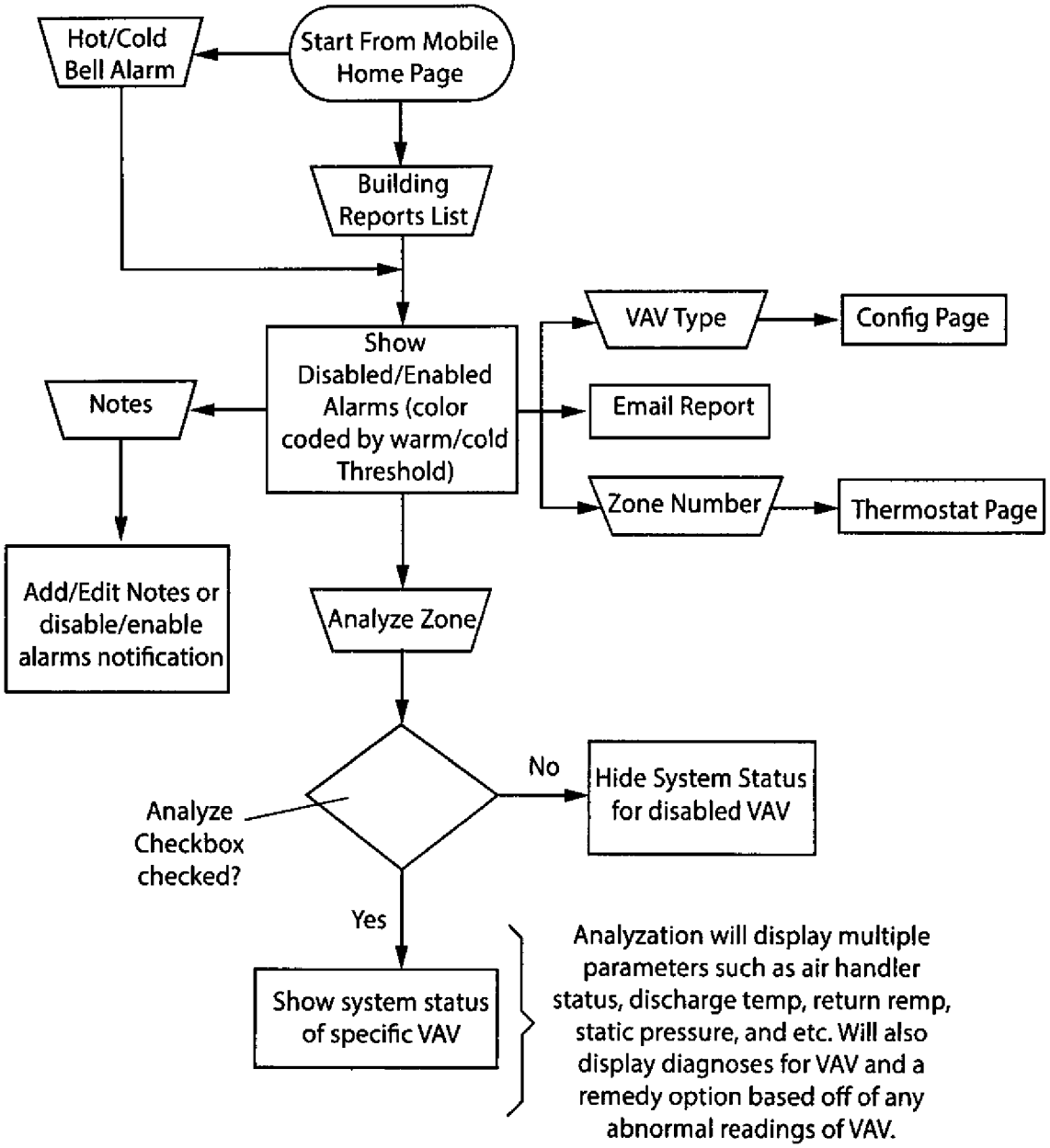
Figure 34:
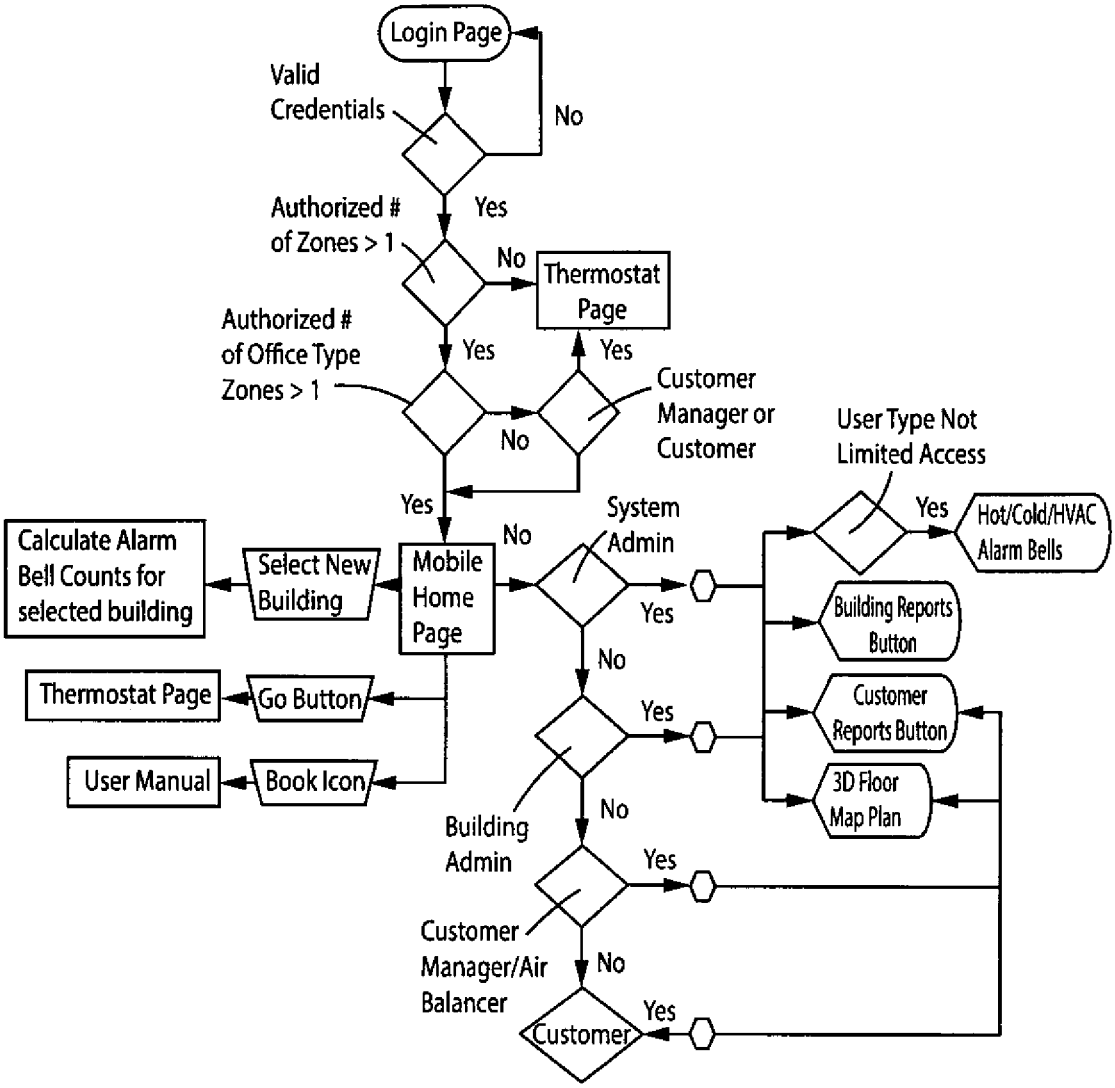
Figure 35:
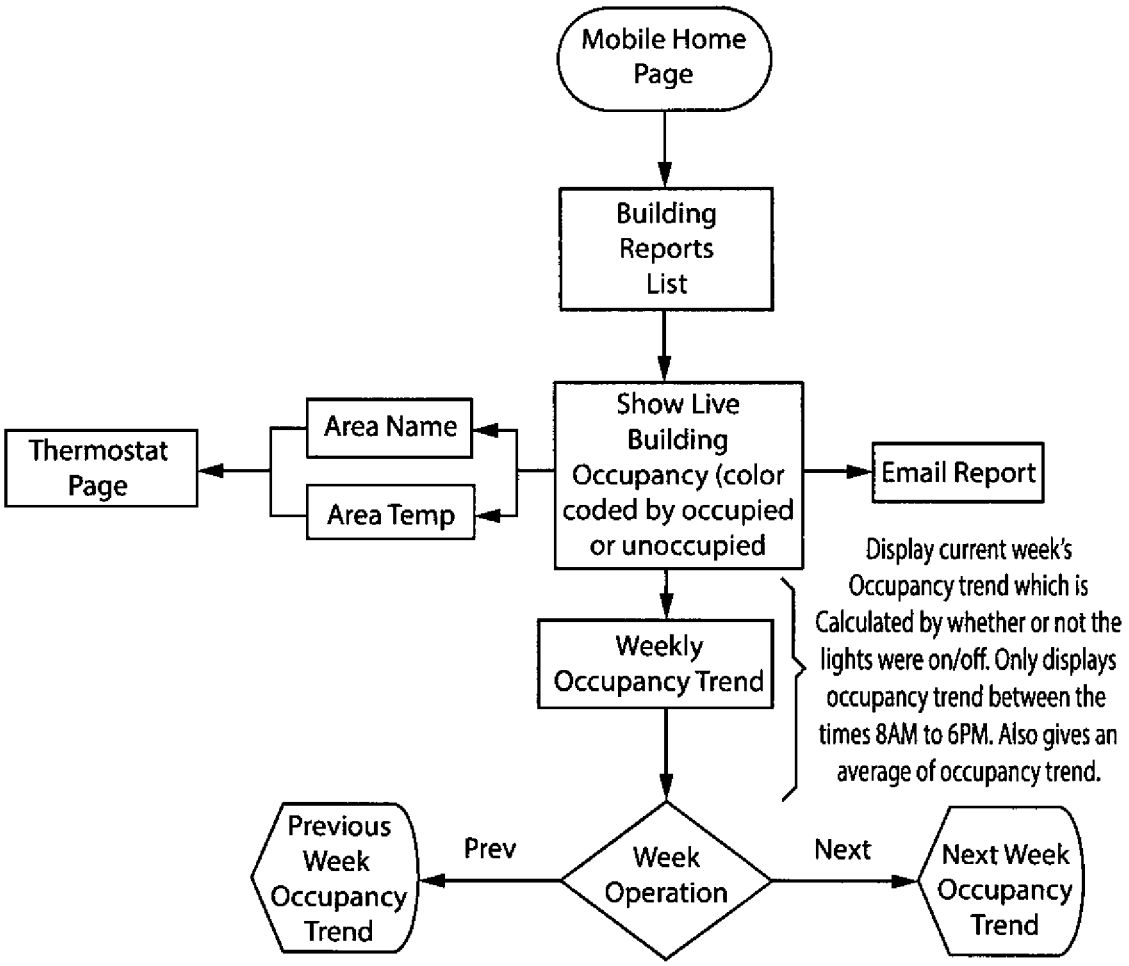
Figure 36:
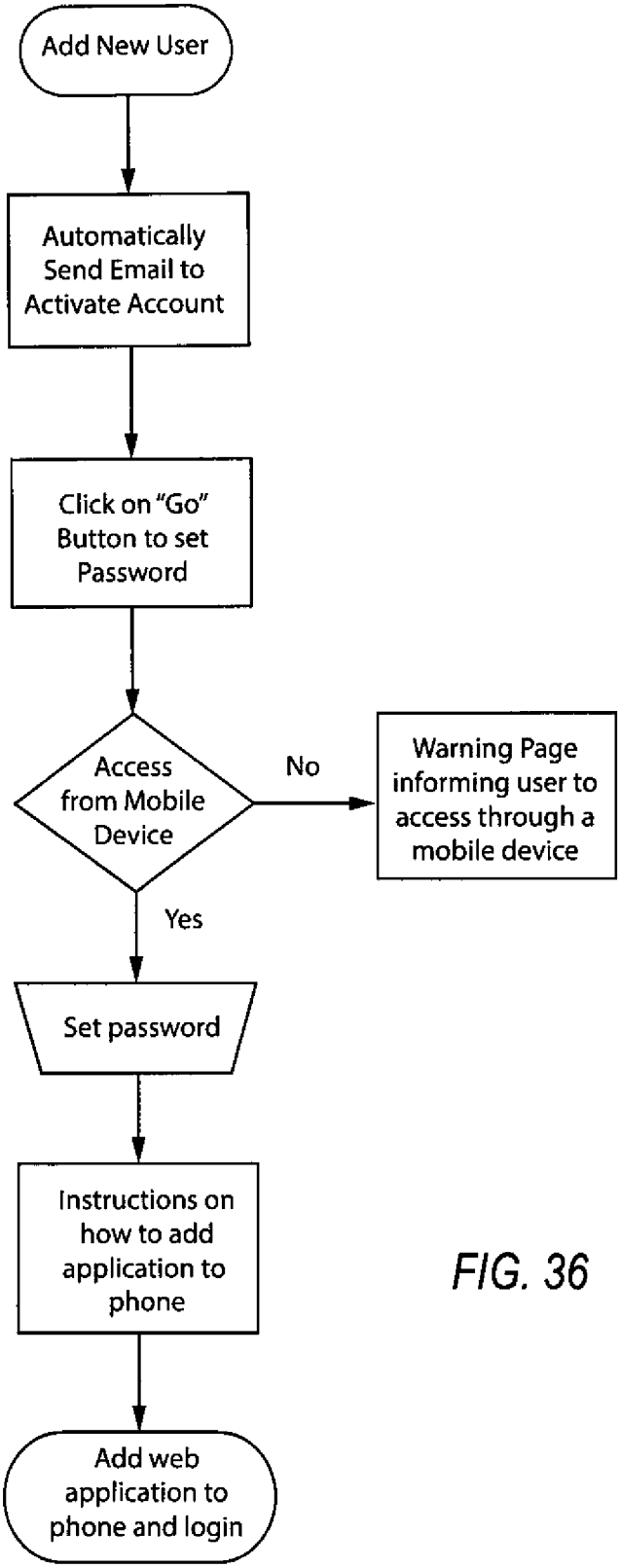
Figure 37:
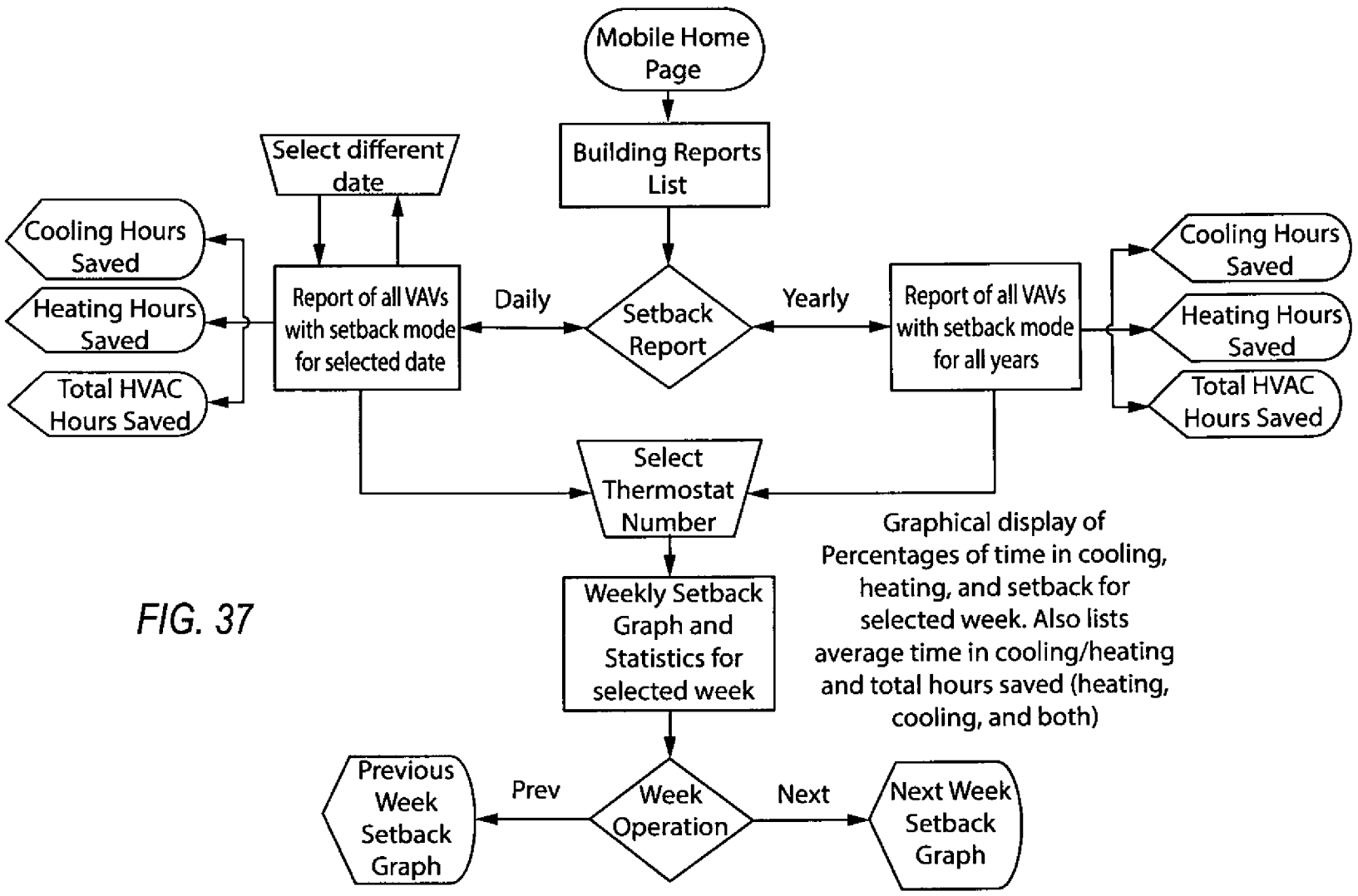
Figure 38:
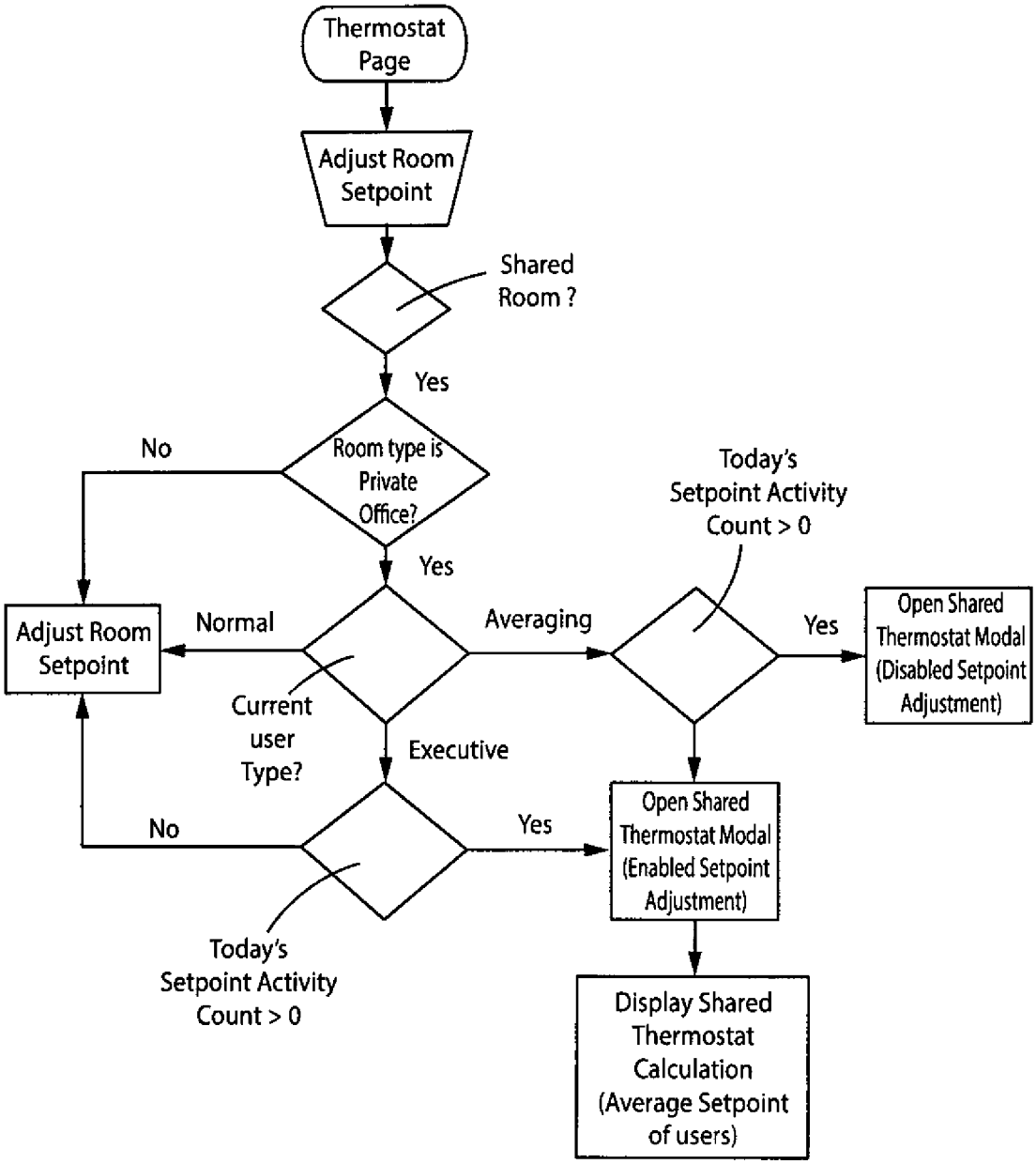
Figure 39:
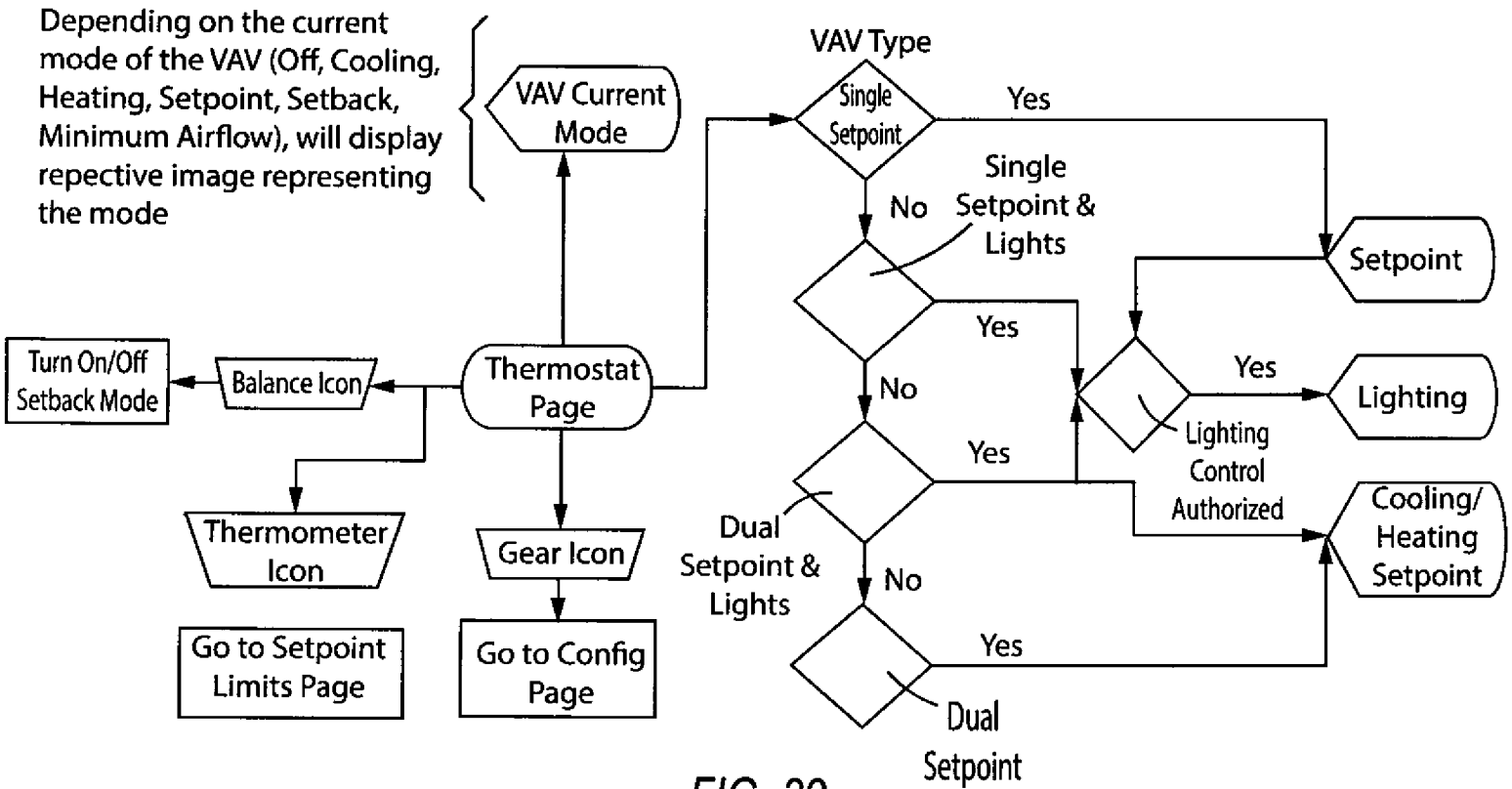
Figure 40:
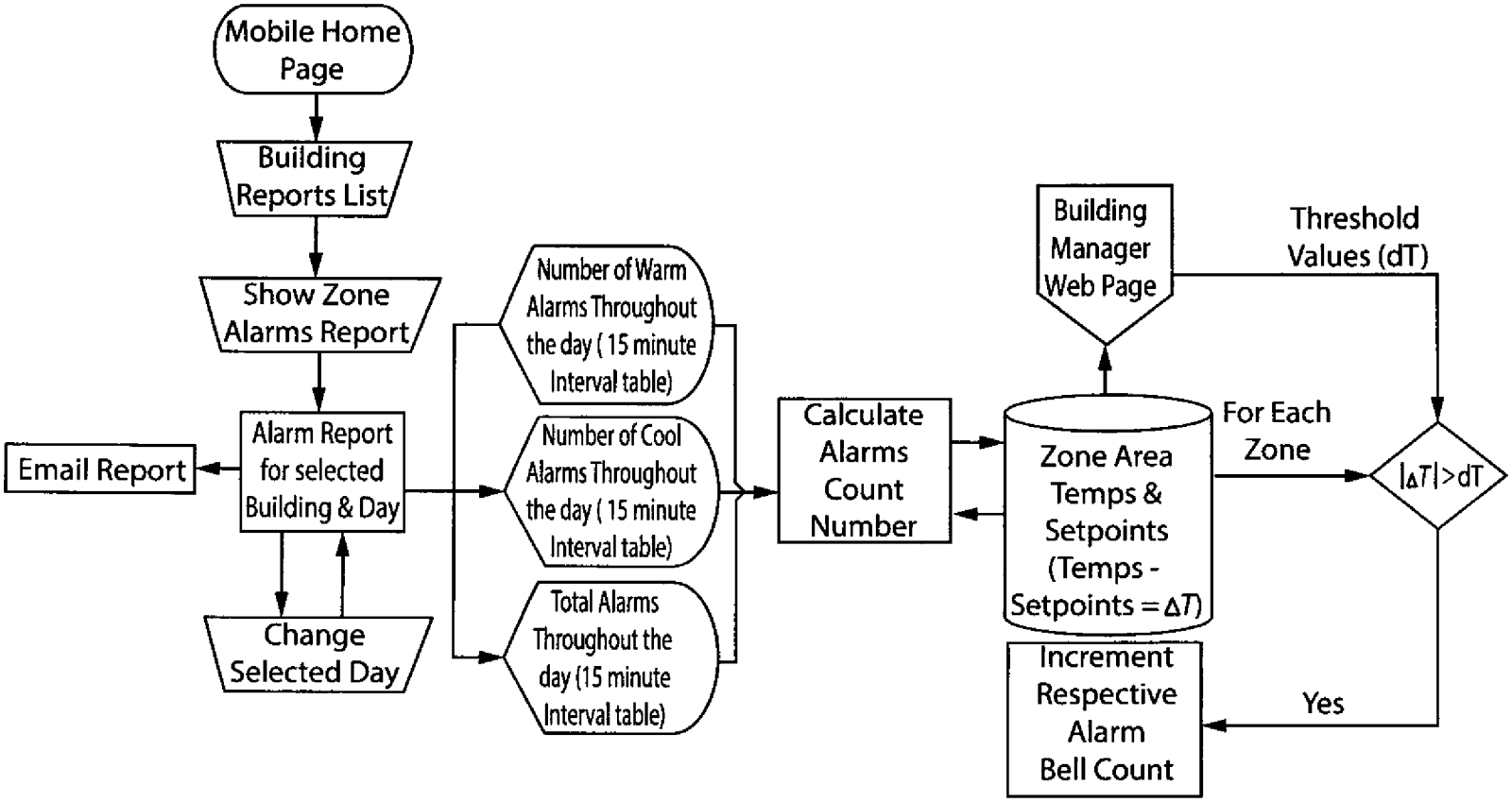

FIG. 23 provides a process for locating defaults in various zones and providing an email report. FIGS. 24-30 illustrate various GUI interfaces for displaying setbacks, setback reports, zone alarms and reports and virtual thermostat types and reports and displays available.

It shall be appreciated that the components of the variable air volume terminal system described in several embodiments herein may comprise any alternative known materials in the field and be of any color, size and/or dimensions. It shall be appreciated that the components of the variable air volume terminal system described herein may be manufactured and assembled using any known techniques in the field.

Persons of ordinary skill in the art may appreciate that numerous design configurations may be possible to enjoy the functional benefits of the inventive systems. Thus, given the wide variety of configurations and arrangements of embodiments of the present invention, the scope of the invention is reflected by the breadth of the claims below rather than narrowed by the embodiments described above.

What is claimed is:

1. A variable volume terminal device with multiple heating coils to enhance temperature control for a plurality of rooms in a building, the variable volume terminal device comprising:

(a) a hybrid variable air volume box having an inlet with an air velocity flow sensor and an optional or floating damper that does not control temperature and wherein any damper control or orifice control is in a remotely located automated space control damper;

(b) a plurality of outlets coupled to the hybrid variable air volume box with at least one outlet of the plurality of outlets having a heating coil operably connected thereto to provide a heated outlet available for a connection to a duct to provide conditioned air to a plurality of rooms wherein each heating coil is a component within or on the at least one outlet of the hybrid variable air volume box;

(c) a heat coil actuator to separately control the heating coil for each heated outlet of the plurality of outlets wherein said heat coil actuator is a component of the hybrid variable air volume box; and (d) a sub plenum disposed inside the hybrid variable air volume box between the plurality of outlets and a terminal wall of the hybrid variable air volume box.

2. The variable volume terminal device of claim 1 wherein the floating damper that does not control temperature is disposed in the hybrid variable air volume box between the inlet and the plurality of heated outlets, a plurality of automated space control dampers disposed outside the hybrid variable air volume box in at least one area to control temperature in the at least one area and a common supply duct connecting the at least one of the plurality of heated outlets to the plurality of automated space control dampers.

3. The variable volume terminal device of claim 2 wherein the sub plenum is disposed between the plurality of heated outlets and the terminal wall of the hybrid variable air volume box.

4. The variable volume terminal device of claim 3 further comprising a static pressure sensor.

5. The variable volume terminal device of claim 2 further comprising an air measurement device disposed between the air inlet and the floating damper.

6. The variable volume terminal device of claim 1 wherein the heating coils are hot water heating coils or electric heating coils.

7. The variable volume terminal device of claim 1 wherein the heating coils are electric heating coils disposed inside of the hybrid variable air volume box.

8. The variable volume terminal device of claim 1 further comprising a plurality of automated space control dampers disposed outside the hybrid variable air volume box and operably connected to at least one heated outlet of the plurality of heated outlets with at least one of the plurality of automated space control dampers disposed in one of the plurality of rooms disposed at a location remote from the hybrid variable air volume box.

9. The variable volume terminal device of claim 8 wherein the plurality of automated space control dampers are connected to the hybrid variable air volume box by a single duct.

10. The variable volume terminal device of claim 9 further comprising a plurality of thermostats to individually control the plurality of automated space control dampers.

11. The variable volume terminal device of claim 10 further comprising a wired or wireless connection between the plurality of thermostats and the plurality of automated space control dampers.

12. The variable volume terminal device of claim 8 further comprising a plug in heat cartridge for at least one of the plurality of automated space control dampers.

13. The variable volume terminal device of claim 12 wherein the plug in heat cartridge is powered by a lighting circuit.

14. The variable volume terminal device of claim 1 wherein said plurality of heated outlets from the hybrid variable air volume box is from between two to seven outlets.

15. The variable volume terminal device of claim 14 wherein each heating coil is operatively connected to one less outlet than the two to seven outlets.

16. A variable air volume terminal device with multiple heating coils to provide separate temperature control over a plurality of rooms in a building comprising:

(a) a hybrid variable air volume box without a damper or with a free floating damper wherein any damper control is remotely disposed in a plurality of independently controlled automated space control dampers, said hybrid variable air volume box having an inlet and a plurality of heaters and wherein the plurality of heaters are disposed within the hybrid variable air volume box or a plurality of outlets of the hybrid variable air volume box;

(b) the plurality of outlets coupled to the plurality of heaters in the hybrid variable air volume box, each of the plurality of outlets having a separate heat control actuator to provide a plurality of independently controlled heated outlets;

(c) and wherein the plurality of independently controlled automated space controlled dampers are disposed in the plurality of rooms in the building wherein said plurality of rooms are disposed in a location remote from the hybrid variable air volume box; and (d) a common supply duct disposed outside the hybrid variable air volume box to connect one of the plurality of independently controlled heated outlets to the plurality of independently controlled automated space control dampers.

17. The variable volume terminal device of claim 16 further comprising a computer link to a controller to allow an occupant of each room of the plurality of rooms to control the temperature of that room.

18. The variable volume terminal device of claim 17 wherein the computer link to the controller implements commands from a database based either on sensed use and/or a history of past usage to save energy.

19. The variable volume terminal device of claim 17 wherein the controller provides for programming or recalibration of the plurality of rooms.

20. A method of providing a variable air volume system to provide an air temperature control for each air-conditioned zone in a plurality of air conditioned zones comprising:

(a) utilizing a multiple outlet variable air volume box having at least one heater as a component within or in at least one outlet of the variable air volume box associated with at least one terminal outlet of the multiple outlet variable air volume box;

(b) having the at least one terminal outlet in the variable air volume box connected to the at least one heater in the variable air volume box or on the at least one terminal outlet of the variable air volume box to supply conditioned air to a plurality of separate air-conditioned zones;

(c) attaching a plurality of automated space control dampers having an electrically controlled orifice or a damper at a remote location from the variable air volume box for admitting conditioned air into each of the plurality of separate air-conditioned zones to a common supply duct and the at least one terminal outlet in the variable volume air box and wherein any damper control has been removed from the variable air volume box; and (d) providing a virtual or an actual thermostat to each zone of said plurality of separate air-conditioned zones to open or close the electrically controlled orifice for admitting conditioned air into a specific zone.

21. The method of claim 20 further comprising having a plug in heat cartridge heater for at least one of the plurality of automated space control dampers.

22. The method of claim 20 further comprising controlling by way of a computer the at least one heater associated with the at least one terminal outlet of the multiple outlet variable air volume box or the plurality of automated space control dampers having an electrically controlled orifice.

23. The method of claim 22 further comprising providing data on occupant load with a sensor.

24. The method of claim 23 further comprising operating the multiple outlet variable air volume box using a database based on the occupant load data.

25. The method of claim 22 further comprising providing remote instructions to the computer by a smart device to send a signal to operate the at least one heater associated with at least one terminal outlet of the multiple outlet variable air volume box.

26. The method of claim 25 wherein the signal is connected to an internet.

27. The method of claim 26 wherein the signal is sent by a building manager or a tenant.

28. The method of claim 20 further comprising calculating an optimum temperature zone by averaging a number of temperature inputs from a number of users of each zone in the plurality of separate air conditioned zones.

29. A hybrid variable air volume (VAV) box comprising:

(a) a housing having at least one air inlet and at least two air outlets;

(b) a damperless air inlet or a free floating flow control damper without a damper control disposed in the air inlet of the housing that does not control temperature wherein the damperless air inlet or the free floating flow control damper is a component of the hybrid variable air volume box and wherein any damper control is remotely disposed in a separate automated space control damper;

(c) at least one heating coil connected to each one of the at least two air outlets wherein the at least one heating coil is a component inside the housing or on the at least two air outlets of the housing of the hybrid variable air volume box and said heating coil controls temperature; and (d) at least one heat coil actuator to separately control the at least one heating coil connected to each one of the at least two outlets wherein the at least one heat coil actuator is a component of the hybrid variable air volume box.

30. The hybrid VAV box of claim 29 further comprising an air flow sensor.

31. The hybrid box of claim 29 further comprising a controller to control the at least one heating coil.

32. The hybrid VAV box of claim 31 wherein said controller is connected to a computer with a database.

33. The hybrid VAV box of claim 29 wherein the at least two air outlets are three to six air outlets and at least one air outlet does not have a heating coil.

34. The hybrid VAV box of claim 29 further comprising a sub plenum disposed between the at least two air outlets and a terminal wall of the hybrid VAV box and occupying a space of 10 percent to 20 percent of interior space of the hybrid VAV box.

35. A heating and air conditioning balancing apparatus comprising:

(a) a hybrid variable air volume box without a damper or with a free floating damper without a damper control having an inlet and a plurality of outlets with at least one heater coil inside the variable air volume box or in at least one of the plurality of outlets;

(b) a plurality of automated space control dampers disposed in a location remote from the hybrid variable air volume box wherein any damper control or air flow control is disposed in the plurality of automated space control dampers;

(c) a common supply duct connecting the at least one heater coil in one of the plurality of outlets to each one of said plurality of automated space control dampers;

(d) at least one of air flow and/or a temperature sensor associated with a zone or area served by each automated space control damper of said plurality of automated space control dampers; and (e) a controller to selectively open and close each of said plurality of automated space control dampers and record at least one of air flow or temperature in the zone or area served by each automated space control damper and set each damper in each of the plurality of automated space control dampers to balance each zone or area served by each automated space control damper.

36. The heating and air conditioning balancing apparatus of claim 35 further comprising a computer database to operate the heating and air conditioning apparatus.

37. The heating and air conditioning balancing apparatus of claim 36 further comprising a thermostat in each area or zone served by each automated space control damper.

38. The heating and air conditioning balancing apparatus of claim 36 further comprising a timer to time and record the last balancing of the plurality of automated space control dampers.

39. The heating and air conditioning balancing apparatus of claim 35 further comprising a program to periodically rebalance the plurality of automated space control dampers.

40. The heating and air conditioning balancing apparatus of claim 35 further comprising a self-diagnosing and reporting system on the mechanical condition of the components in the hybrid variable air volume box and each component in the plurality of automated space control dampers.

41. The heating and air conditioning balancing apparatus of claim 40 further comprising an occupancy sensor so as not periodically rebalance during occupancy.

42. The heating and air conditioning balancing apparatus of claim 35 wherein the air conditioning and balancing apparatus has a wired or wireless communication link.

43. The heating and air conditioning balancing apparatus of claim 35 wherein at least one of the plurality of automated space control dampers includes a supplemental heater.

* * * * *